United States Patent [19]

Baker et al.

[11] 4,353,298

[45] Oct. 12, 1982

[54] PARTIAL LINE TURNAROUND FOR PRINTERS

[75] Inventors: Gregory N. Baker; Willard B. Greene, both of Boca Raton; Ludwig R. Siegl, Highland Beach; Delbert C. Thomas, Jr., Boca Raton; Charles J. Weber, Boca Raton; Lee T. Zimmerman, Boca Raton, all of Fla.

[73] Assignee: International Business Machines Corporation, Armonk, N.Y.

[21] Appl. No.: 86,494

[22] Filed: Oct. 19, 1979

[51] Int. Cl.[3] ..... B41J 3/12

[52] U.S. Cl. ..... 101/93.05; 400/70; 400/124; 400/225; 400/616.1; 364/900

[58] Field of Search ..... 400/124, 126, 154.3; 101/93.05; 364/200 MS File, 900 MS File

[56] References Cited

U.S. PATENT DOCUMENTS

| | | | |
|---|---|---|---|
| 2,938,455 | 5/1960 | Jurgens et al. | 101/93.05 |
| 3,708,050 | 1/1973 | McCarthy, Jr. | 400/124 |
| 3,764,994 | 10/1973 | Brooks et al. | 400/124 X |
| 3,789,971 | 2/1974 | Deyesso et al. | 400/154.3 |
| 3,831,728 | 8/1974 | Woods et al. | 400/126 X |
| 3,833,891 | 9/1974 | Howard et al. | 101/93.05 X |
| 3,942,620 | 3/1976 | Dillinger et al. | 400/124 |
| 3,970,183 | 7/1976 | Robinson et al. | 400/124 |
| 3,999,644 | 12/1976 | Pape et al. | 101/93.05 X |
| 4,024,506 | 5/1977 | Spaargaren | 400/124 X |
| 4,050,563 | 9/1977 | Menhenett | 101/93.05 X |
| 4,050,564 | 9/1977 | Carmichael et al. | 400/126 |
| 4,114,750 | 9/1978 | Baeck et al. | 400/124 X |
| 4,169,684 | 10/1979 | Blom | 101/93.05 X |
| 4,179,738 | 12/1979 | Fairchild et al. | 364/200 |
| 4,204,777 | 5/1980 | Jen | 101/93.05 X |
| 4,208,137 | 6/1980 | Liu | 101/93.05 X |

OTHER PUBLICATIONS

IBM Technical Disclosure Bulletin, "Standard Printer or I/O Adapter Control Method and Apparatus", Hays et al., vol. 22, No. 1, Jun. 1979, pp. 269–271.

*Primary Examiner*—Ernest T. Wright, Jr.

*Attorney, Agent, or Firm*—D. Kendall Cooper; John C. Black; J. Jancin, Jr.

[57] ABSTRACT

A printer is provided with facilities for increasing the printing throughput. This involves a partial line turnaround operation. The printer has means to move a form or document past a print line, a ribbon drive assembly, and a print assembly incorporating a plurality of print wires arranged in print head groups, each group comprising a predetermined number of print wires. If, as an example, the print assembly has two, four, six, or eight print heads, each can accommodate eight wires in the embodiment described. The print wires are arranged in a slanted serrated pattern and provision is made herein to insure that the print heads move at least far enough to print their assigned character locations prior to the performance of any turnaround in individual lines being printed. Routine involves the accessing of tables stored in conjunction with a microprocessor, the tables indicating the optimum turnaround situations for the different print head configurations. In addition, an emitter is provided in the printer unit which has character emitters, margin emitters and other emitters as well as turnaround emitters that are used in conjunction with the turnaround decision making process to reverse direction of the print head assembly in order to start printing of a new line.

16 Claims, 75 Drawing Figures

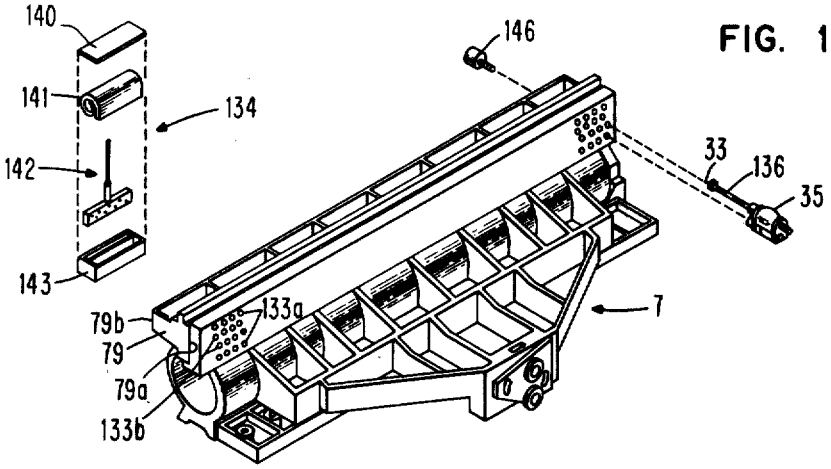
FIG. 14
FIG. 15
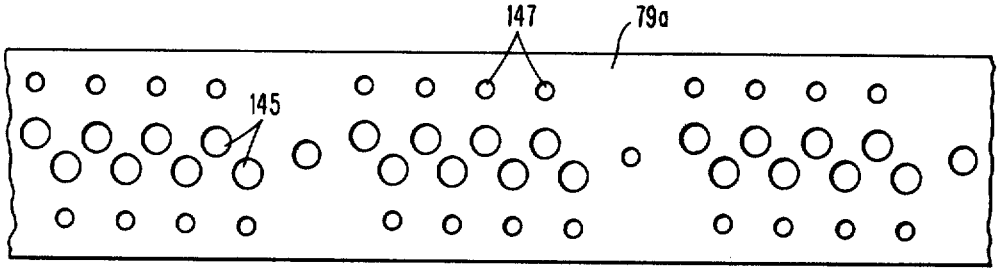
FIG. 16
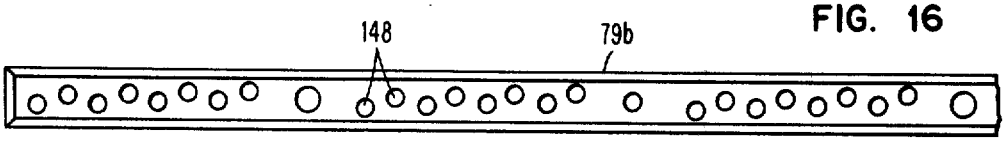

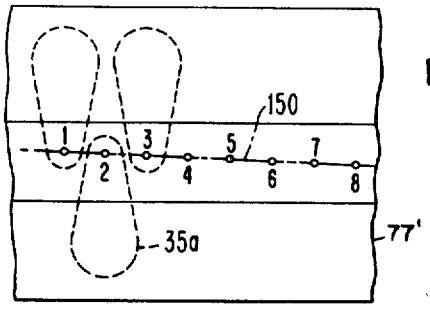
FIG. 17
FIG. 18
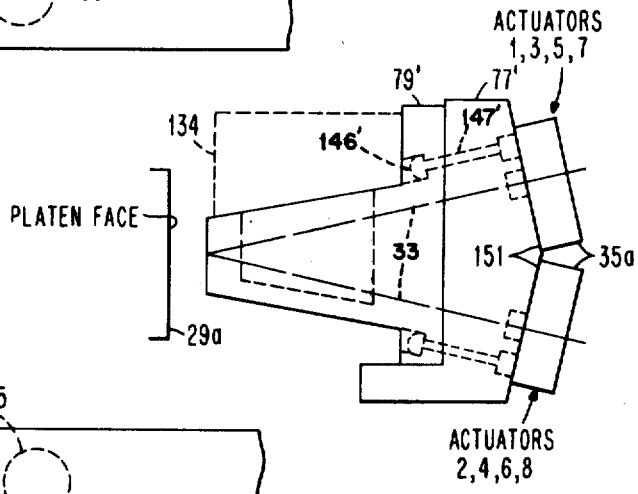
FIG. 19
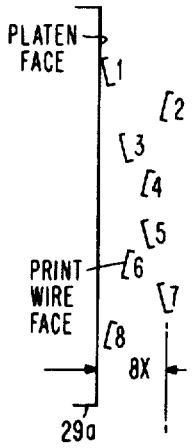
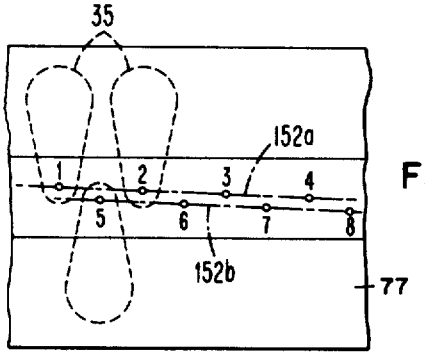
FIG. 20
FIG. 22
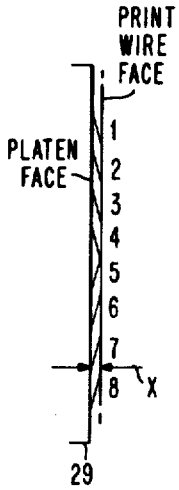
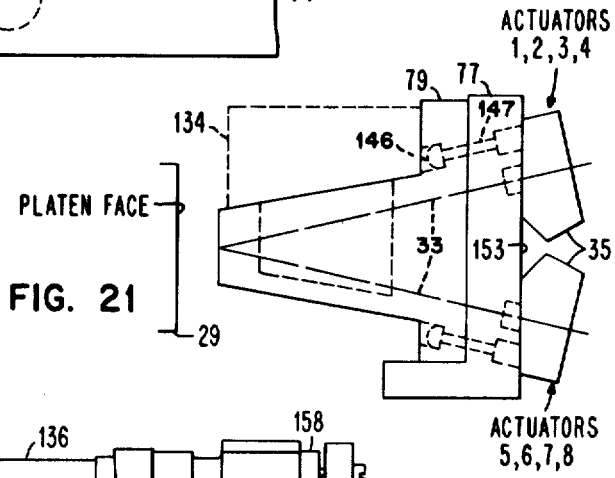
FIG. 21
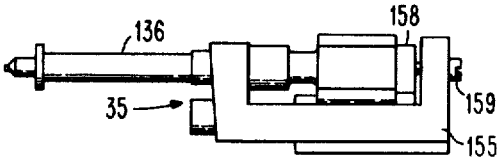
FIG. 23

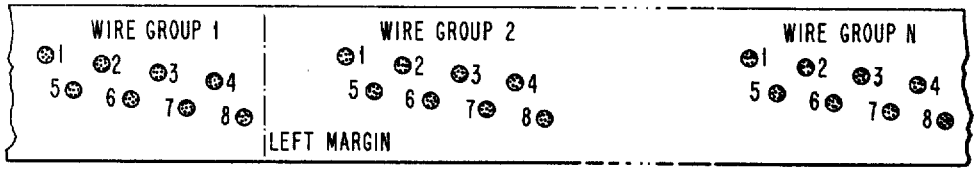
FIG. 29
FIG. 30
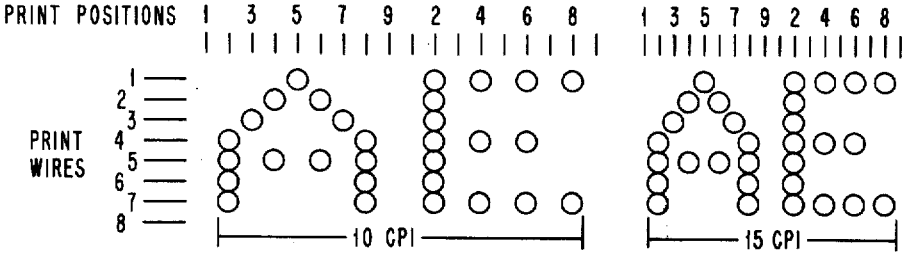
FIG. 31
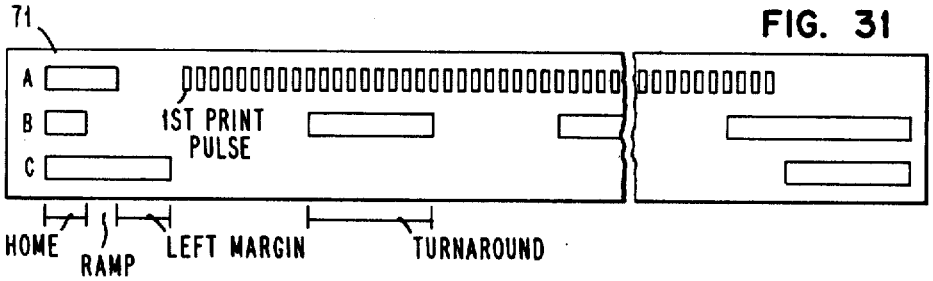
FIG. 32
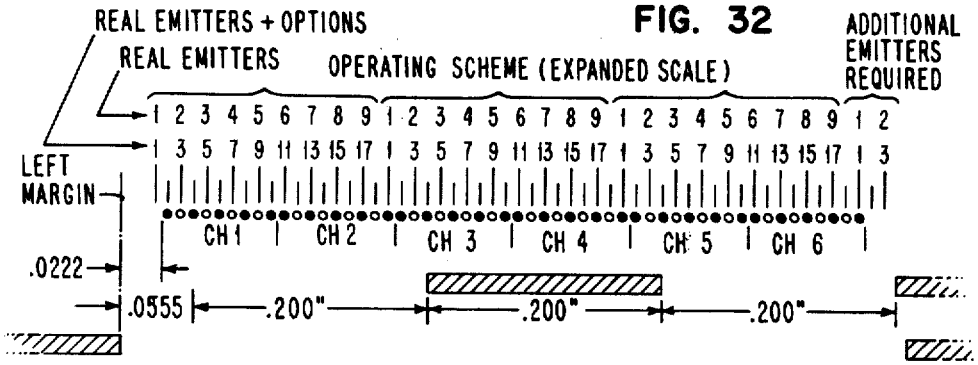

ADDRESSING HIGHLIGHTS

FOR A SINGLE PRINTER, ADDRESS IS 000
WITH CABLE CONNECTOR FEATURE, USABLE ADDRESSES ARE 000 TO 110
A BIT COMBINATION OF 111 INDICATES END-OF-MESSAGE & TERMINATES A TRANSFER SEQUENCE

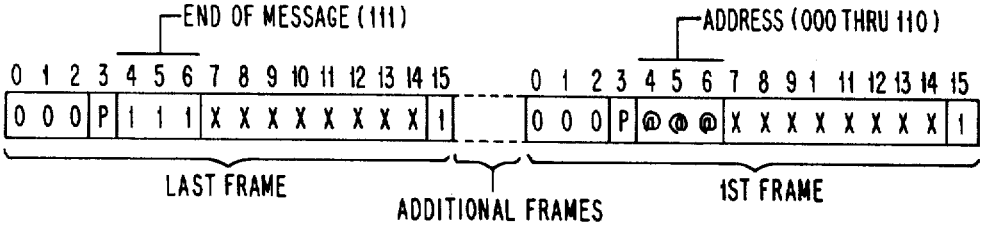

FIG. 44

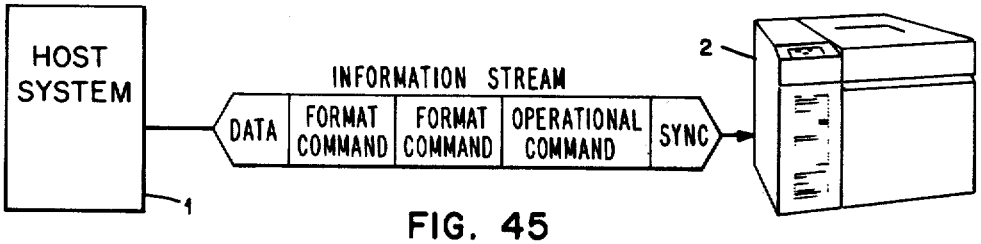

FIG. 45

SAMPLE TRANSFER SEQUENCE FOR PRINTING DATA

| | CONTROLLER | | PRINTER |
|---|---|---|---|
| 1 | → | POLL (FOR STATUS) | |
| 2 | ← | STATUS (2 FRAMES) | |
| 3 | → | WRITE DATA | |
| 4 | → | POLL (FOR STATUS) | |
| 5 | ← | STATUS (2 FRAMES) | |
| 6 | → | ACTIVATE WRITE | |
| 7 | → | DATA (UP TO 256 FRAMES) | |

1, 4: POLL COMMAND REQUESTS PRINTER STATUS
2, 5: RESPONSE STATUS FRAMES INFORM CONTROLLER OF PRINTER AVAILABILITY
3: WRITE DATA COMMAND PREPARES PRINTER FOR PRINTING OPERATION
6: ACTIVATE WRITE COMMAND STARTS PRINTING OPERATION
7: CONTROLLER SENDS DATA & EMBEDDED FORMATTING COMMANDS TO PRINTER

FIG. 46

| FIG. 51A | FIG. 51B |
|---|---|

COMMUNICATIONS MICROPROCESSOR (CMM)

CONTROL MICROPROCESSOR (CTM) FIG. 55

GOING LEFT FROM A TURNAROUND EMITTER OR FROM RIGHT MARGIN EMITTER

ANALYSIS - CONTINUED

ANALYSIS - CONTINUED

PARTIAL LINE TURNAROUND FOR PRINTERS

BACKGROUND OF THE INVENTION

This invention relates to printers and particularly to printers that operate at relatively high speeds in response to data signals from a data source, such as a host data processing system. More particularly, the invention relates to provision of decision-making facilities in the printer subsystem to increase printing throughput. In previous printer systems or subsystems that receive data from a host system, printing throughput has been improved by analyzing the lines of data as they are presented to the printer to determine the relative line lengths and locations with respect to one another with the objective of printing the lines in the fastest manner possible. In some cases, printer units are provided with a bidirectional printing capability which enables them to print lines either from left to right or right to left on a form or document inserted in the printer. In such a printer, the lookahead analysis of lines to be printed enables the printer to move the print head to the closest end of the next succeeding line of print thus saving time during printing operations. Most of the printer units have been based on conventional wire images. That is, considering a wire matrix type of printer, the data is presented to the printer and is actually printed on the document in a sequence of vertical columns of wire dots laid down by actuation of print wires in the printer. When nonconventional print wire images are used, the wire images in the printer unit do not conform to the conventional geometrics, and it is necessary to consider many additional factors in the lookahead analysis.

SUMMARY OF THE INVENTION

In accordance with the present invention, there is provided a printer unit incorporated in a printer subsystem which receives character wire image information from a host data processing system. The printer unit is provided with a plurality of print heads, each having a predetermined number of print wires. In a typical example, the printer unit may have 2, 4, 6, or 8 print heads each with 8 individual print wires and print wire actuators. The printer unit has a forms feed assembly, a ribbon drive assembly, and a print assembly mounting the print heads and arranged to drive the print heads along a print line of a document to be printed. The print heads are ordinarily positioned in a home or ramp location, and when printing is required, are moved through a left margin toward a right margin area. In the preferred embodiment described herein, the print wires in each print head group are arranged in a slanted serrated wire image pattern and it is important that each print head move completely through its assigned printing area along the print line before any turnaround action is performed in the printer. Each head is assigned the task of printing a given quantity of characters depending upon how many print heads are in the printer unit. If the number of characters to be printed in any line is less than the number of characters assigned to the first (leftmost) print head, only the print wires in that print head are activated and turnaround may occur at any earlier point. If the number of characters to be printed exceeds those for the first print head but is less than or equal to a nominal line length, then all print heads may be activated on a selective basis and a nominal line turnaround occurs. If the number of characters to be printed extends beyond the nominal line length for all print heads, then the last (rightmost) print head prints its assigned characters plus all characters extending beyond the nominal line length, and turnaround will occur later than nominal turnaround. The printer unit includes turnaround input means, margin means, and turnaround control means, all cooperating to accomplish these objectives. The printer subsystem incorporates microprocessors for communications and control functions and storage facilities. The storage facilities, besides storing significant control and data information, also are provided with tables which represent the various print head configurations and which are accessed during printing operations to determine the optimum turnaround points that are available. In conjunction with the printer unit, a print emitter is provided that is scanned during movement of the print heads. The print emitter has an additional track referred to as a turnaround track which is referenced upon completion of printing and which is utilized to insure a more accurate and effective turnaround operation.

CROSS-REFERENCE TO RELATED PATENT APPLICATIONS

The present patent application is one of a group of copending patent applications which concern the same overall printer subsystem configuration but which individually claim different inventive concepts embodied in such overall printer subsystem configuration. These related patent applications were filed on the same date, namely, Oct. 19 1979, are specifically incorporated by reference herein, and selected ones of these are more particularly described as follows:

(1) Application Ser. No. 086,484, entitled "Printer Subsystem with Dual Cooperating Microprocessors", the inventors being Messrs. William W. Boynton et al;

(2) Application Ser. No. 086,384 entitled "Font Selection and Compression for Printer Subsystem", the inventor being Mr. Lee T. Zimmerman;

(3) Application Ser. No. 086,490, now abandoned, entitled "Automatic Print Inhibit in Margins for Printer Subsystem", the inventors being Messrs. Willard B. Green et al;

(4) Application Ser. No. 086,491 now U.S. Pat. No. 4,304,497 issued Dec. 8, 1981 and entitled "Detection of Multiple Emitter Changes in a Printer Subsystem", the inventors being Messrs. Barry R. Cavill et al;

(5) Application Ser. No. 086,492 now U.S. Pat. No. 4,279,199 issued July 21, 1981 and entitled "Print Head Image Generator for Printer Subsystem", the inventors being Messrs. Abelardo D. Blanco et al;

(6) Application Ser. No. 086,568 now U.S. Pat. No. 4,285,604 issued Aug. 25, 1981 and entitled "Ribbon Shield for Printer", the inventor being Mr. Donald K. Rex;

(7) Application Ser. No. 086,483 now U.S. Pat. No. 4,278,020 issued July 14, 1981 and entitled "Print Wire Actuator Block Assembly for Printers", the inventor being Mr. Albert W. Oaten;

(8) Application Ser. No. 086,567 entitled "Microcomputer Control of Ribbon Drive for Printers", the inventors being Messrs. Earl T. Brown et al; and (9) Application Ser. No. 086,383 now U.S. Pat. No. 4,290,138 issued Sept. 15, 1981 and entitled "Wire Fire Mapping for Printers", the inventors being Messrs. Gary T. Bare et al.

For a better understanding of the present invention, together with other and further advantages and features thereof, reference is made to the description taken in connection with the accompanying drawing, the scope of the invention being pointed out in the appended claims.

BRIEF DESCRIPTION OF THE DRAWING

Referring to the drawing:

FIG. 14 illustrates a print wire block assembly and associated guide.

FIGS. 15 and 16 illustrate front and rear faces of the guide shown in FIG. 14.

FIGS. 17–19 illustrate an alternative mounting of print wire actuators with an angled face on the block assembly.

FIGS. 20–22 illustrate mounting of print wire actuators with a flat face on the actuator block assembly.

FIGS. 23–26 illustrate a print wire actuator, a plurality of which are mounted in the block assembly shown in FIG. 14.

FIG. 29 illustrates the arrangement of print wires in groups relative to a left margin in the printer unit.

FIG. 30 illustrates printing of characters at 10 characters per inch and 15 characters per inch.

FIGS. 31 and 32 illustrate the print emitter and its operating scheme.

FIG. 44 illustrates the bit configurations for printer addressing.

FIG. 45 shows command and data arrangements in the information stream.

FIG. 46 is a chart illustrating a typical transfer of data to be printed.

FIG. 61 illustrates a print emitter for a printer having two print head groups while

DESCRIPTION OF PRINTER SUBSYSTEM AND PRINTER MECHANISMS

In order to best illustrate the utility of the present invention, it is described in conjunction with a high speed matrix printer, typically capable of printing in a high range of lines per minute on continuous forms. The particular printer subsystem described herein is associated with a host system or processor, responds to command and data signals from the host system to print on the forms and in turn provides status signals to the host system during operations.

The printer itself is an output line printer designed to satisfy a variety of printing requirements in data processing, data collection, data entry, and communications systems. It can be used as a system printer or a remote work station printer. The following printer highlights are of interest:

- Print density of 10 or 15 characters per inch (25.4 mm) selectable by the operator or by the using system program;
- Condensed print mode, 15 characters per inch (25.4 mm) saves paper costs and makes report handling, mailing, reproduction, and storage easier;
- Line spacing of 6, or 8 lines per inch (25.4 mm) or any other line density selectable by the operator or by the using system program;
- Incremental and reverse forms movement selectable by the using system program;
- Sixteen self-contained character sets selectable by the using system program with a base language selected by hardware jumpers.
- Special graphics ability (special characters, graphs, plotting, etc.) selectable by the using system program;
- Matrix printing technology;
- Built-in diagnostics for problem determination by the operator;
- Microprocessor control unit;
- Maximum print line width—330.2 mm (13.2 in);
- Maximum print positions for 10 characters per inch (25.4 mm)—132;
- Maximum print positions for 15 characters per inch (25.4 mm)—198;
- Adjustable forms width—76.2 to 450 mm (3.0 to 17.7 in);
- Maximum forms length—76.2 to 317.5 mm (3.0 to 12.5 in).

Figure 1:
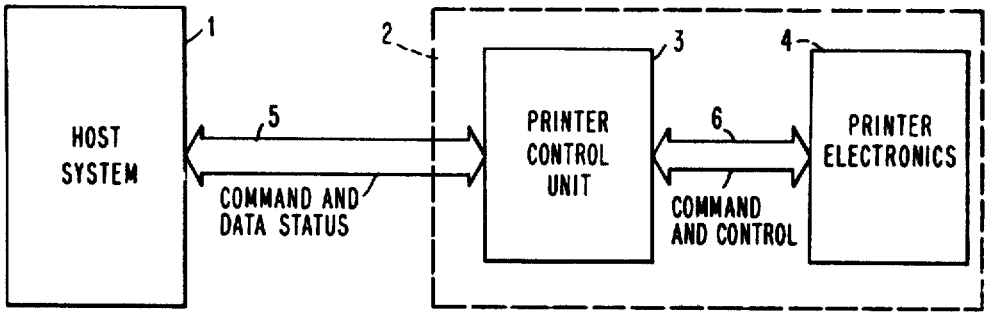
FIG. 1 is a simplified system diagram for the printer subsystem.

FIG. 1 illustrates a representative system configuration including a host system 1 and the printer subsystem 2 which includes a printer control unit 3 and printer electronics 4. Command and data signals are provided by the host system 1 by way of interface 5, and command and control signal are provided from printer control unit 3 to the printer electronics 4 by way of bus 6. Status signals are supplied by printer control unit 3 to host system 1 by way of interface 5. Typically, the host system 1 generates information including commands and data and monitors status. Printer control unit 3 receives the commands and data, decodes the commands, checks for errors and generates status information, controls printing and spacing, and contains printer diagnostics. Printer electronics 4 executes decoded control unit commands, monitors all printer operations, activates print wires, drives motors, senses printer emitters, and controls operator panel lights and switching circuitry. It controls the tractor/platen mechanism, the ribbon drive, the print head (i.e., actuator group) carrier 31, the operator panel 26, and the printer sensors.

The elements of the system, such as the printer control unit 3 and printer electronics 4, incorporate one or more microprocessors or microcomputers to analyze commands and data and to control operations.

Figure 2:
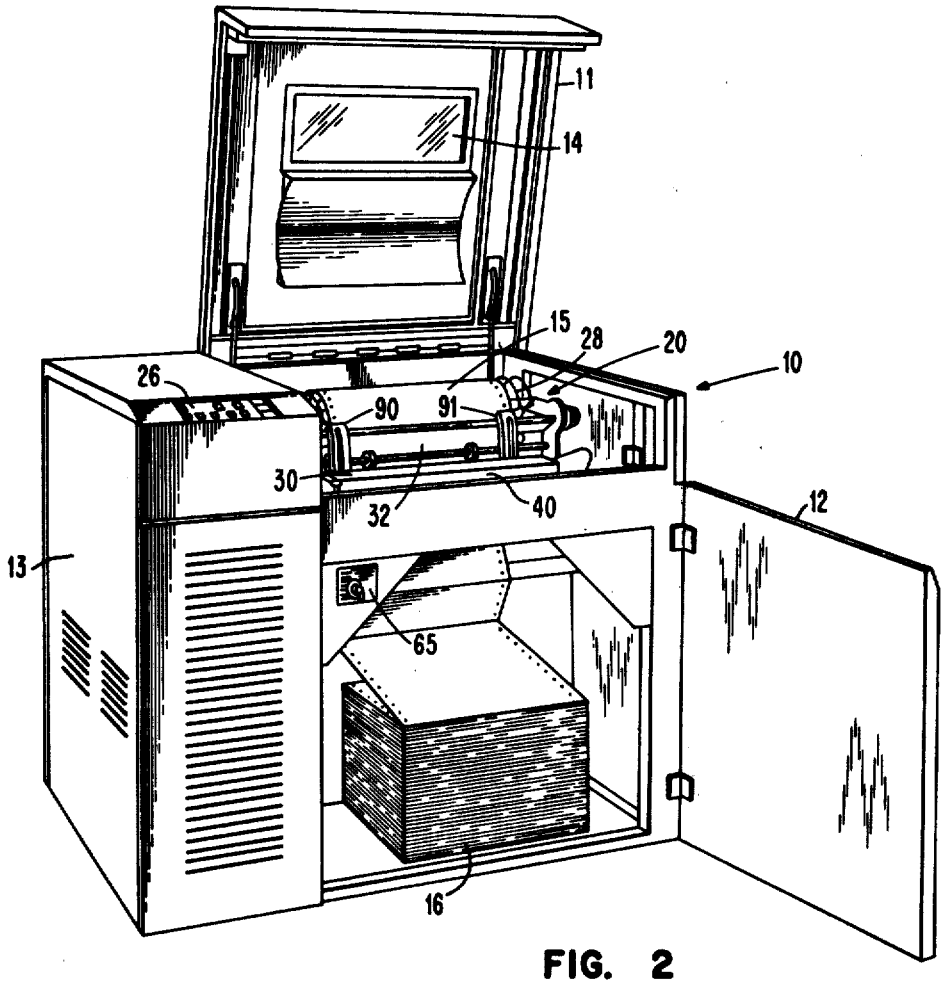
FIG. 2 illustrates the printer console and a number of printer components as well as forms feeding.
Figure 3:
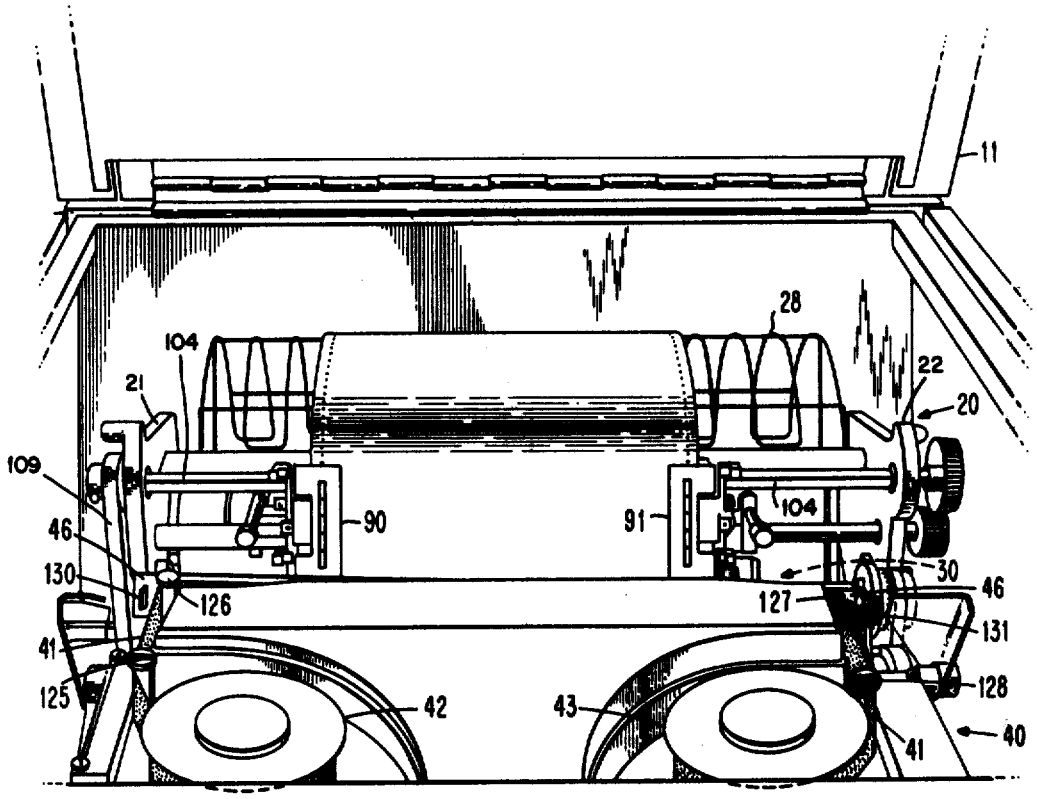
FIG. 3 is a frontal view of the printer unit in the printer console of FIG. 2.

FIGS. 2 and 3 illustrate various components of the printer all of which are housed in the console 10. Various access panels or covers such as those designated 11, 12, and 13 are provided. Top cover 11 has a window 14 that enables an operator to observe forms movement during operation of the printer and when the cover 11 is closed. Forms (documents) 15 are provided from a stack 16 and can be fed in one embodiment upwardly or downwardly as viewed in FIGS. 2 and 3 by means of a forms feed assembly 20 which includes one or more sets of forms tractors such as the upper set comprising tractors 90 and 91. A forms guide 28 guides the forms 15 after printing to a takeup stack, not shown but positioned below the printing mechanism and to the rear of the printer console 10. The printer subsystem 2 incorporates a print assembly 30 that is positioned generally in a horizontal relationship with respect to forms 15 at a print station 32. Print assembly 30 is more clearly visible in other views. This is also true of the printer ribbon drive assembly 40 which is located in closer proximity to the front of the printer. Printer control unit 3 and its associated microprocessors are generally located behind the side cover 13.

Figure 4:
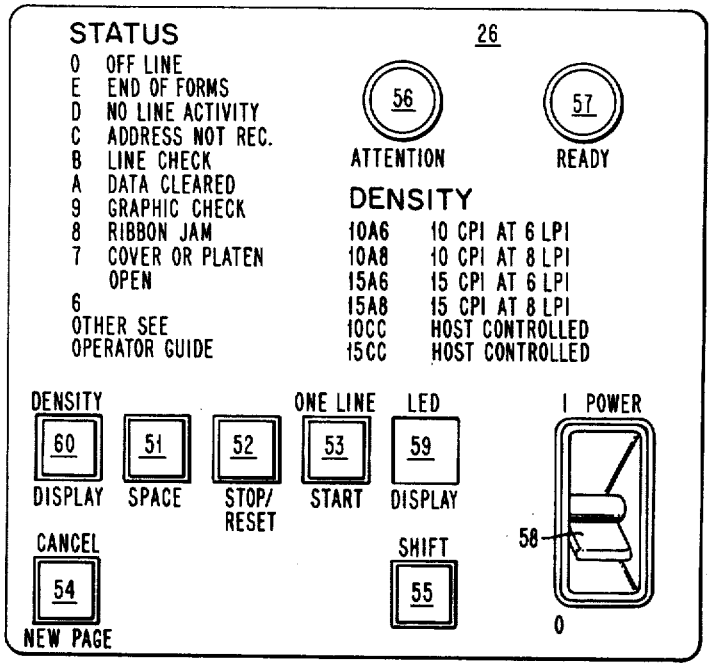
FIG. 4 illustrates an operator panel useful with the printer of FIGS. 1 and 2.

A ribbon 41 is provided on one of the spools 42 or 43, which is disposable. Each box of ribbons would preferably contain a disposable ribbon shield 46 that fits between print assembly 30 and forms 15 to keep ribbon 41 in proper alignment and to minimize ink smudging on forms 15. Two motors 49 and 50 shown more clearly in FIG. 8 drive ribbon 41 back and forth between spools 42 and 43. The printer control unit 3 detects ribbon jams and end of ribbon (EOR) conditions. A ribbon jam turns on an error indicator (display 59 shows "80", FIG. 4) and stops printing. An EOR condition reverses the ribbon drive direction.

The printer includes an operator panel 26 (shown in greater detail in FIG. 4) that consists of several operator control keys (pushbuttons 51–55 and 60), two indicator lights 56, 57, a power on/off switch 58, and an operator panel display 59. By using various combinations of the keys 51–54 and 60 in conjunction with the shift key 55 the operator can: start or stop printing and view the last line printed, set print density, position the forms 15 up or down one page or one line at a time, move the forms 15 incrementally up or down for fine adjustment, and start or stop the diagnostic tests when selected by a mode switch 65, FIG. 5, to be described.

The operator panel 26 notifies the operator that: the printer is ready to print data from the using system (57), the printer requires attention (56), the current print density setting (60), errors, if any, have been detected, and the results of the diagnostic tests (59).

Figure 5:
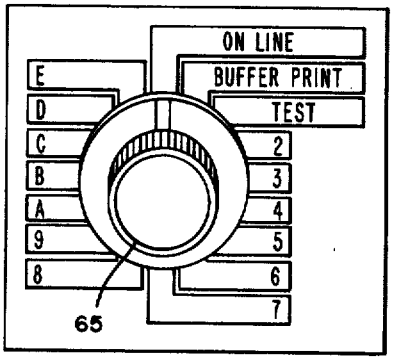
FIG. 5 shows a mode switch for control of on-line, off-line conditions.

A 16-position mode switch 65 is located behind the front door 12 and is shown in greater detail in FIG. 5. The on-line positions permit printing to be controlled by the using system. All other positions are off-line and do not allow printing to be initiated from the using system.

The first three switches positions are used by the operator to select these modes:

- On-line. The normal operating position. With the switch 65 in this position, the printer accepts commands from the using system. The operator panel display 59 indicates any detected error conditions.
- Buffer Print. An additional on-line position which print the EBCDIC values (hexadecimal codes) sent from the host system 1 and the associated character images. No control characters are interpreted. This feature allows the user to view the data stream sent to the printer.
- Test. For off-line checkout and problem determination. In test mode, when Start key 53 is pressed, the attention indicator (56) stays on and Ready indicator (57) is turned on until the diagnostic tests that are stored in the printer control unit 3 are finished or the Stop key 52 is pressed. If an error is detected, the printer stops and displays an error code in the operator panel display 59.

The remaining thirteen (13) positions of the mode switch 65 designated "2-9" and "A-E" are used by service personnel to select a variety of diagnostic tests to aid in off-line problem determination and confirmation of service requirements.

Figure 6:
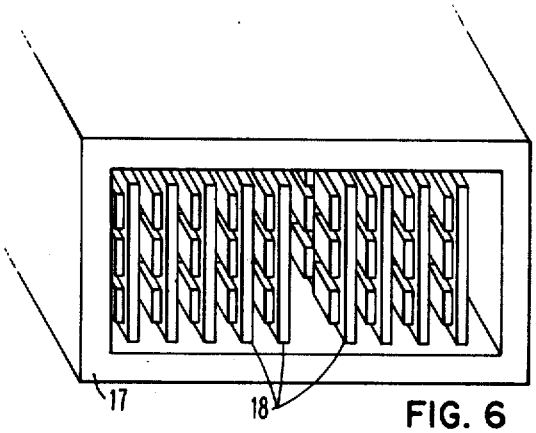
FIG. 6 shows a gate assembly with printed circuit cards.

FIG. 6 illustrates a gate assembly 17 located behind side cover 13, FIG. 2, the gate assembly 17 including modular printed circuit cards such as cards 18 that contain much of the circuit elements for printer control unit 3 and printer electronics 4, FIG. 1.

Figure 7:
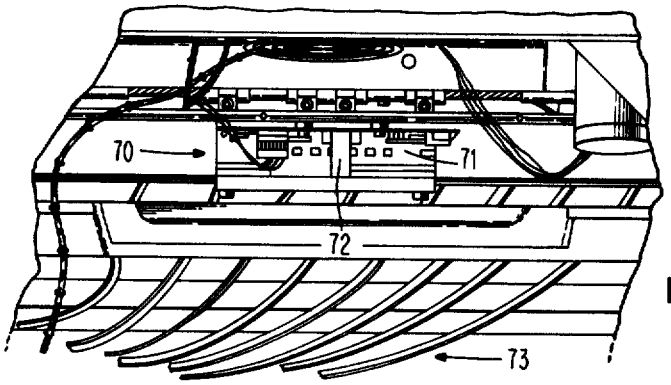
FIG. 7 is a frontal view of the printer console of FIG. 2 with the cover open showing a print emitter.

FIG. 7 is a frontal view of a print emitter assembly 70 that includes an emitter glass 71 and an optical sensor assembly 72. Glass 71 is vertically positioned with respect to sensor assembly 72 and is mechanically attached to print assembly 30 so that as the print heads 34, print actuators 35, and print wires 33 move back and forth left to right and conversely as viewed in FIG. 7, glass 71 also moves in the same manner with respect to sensor assembly 72 to indicate the horizontal position of the print wires 3. Cabling 73 supplies signals to the print actuators 35 which are described in detail below.

Overview of Printer Mechanisms

Figure 8:
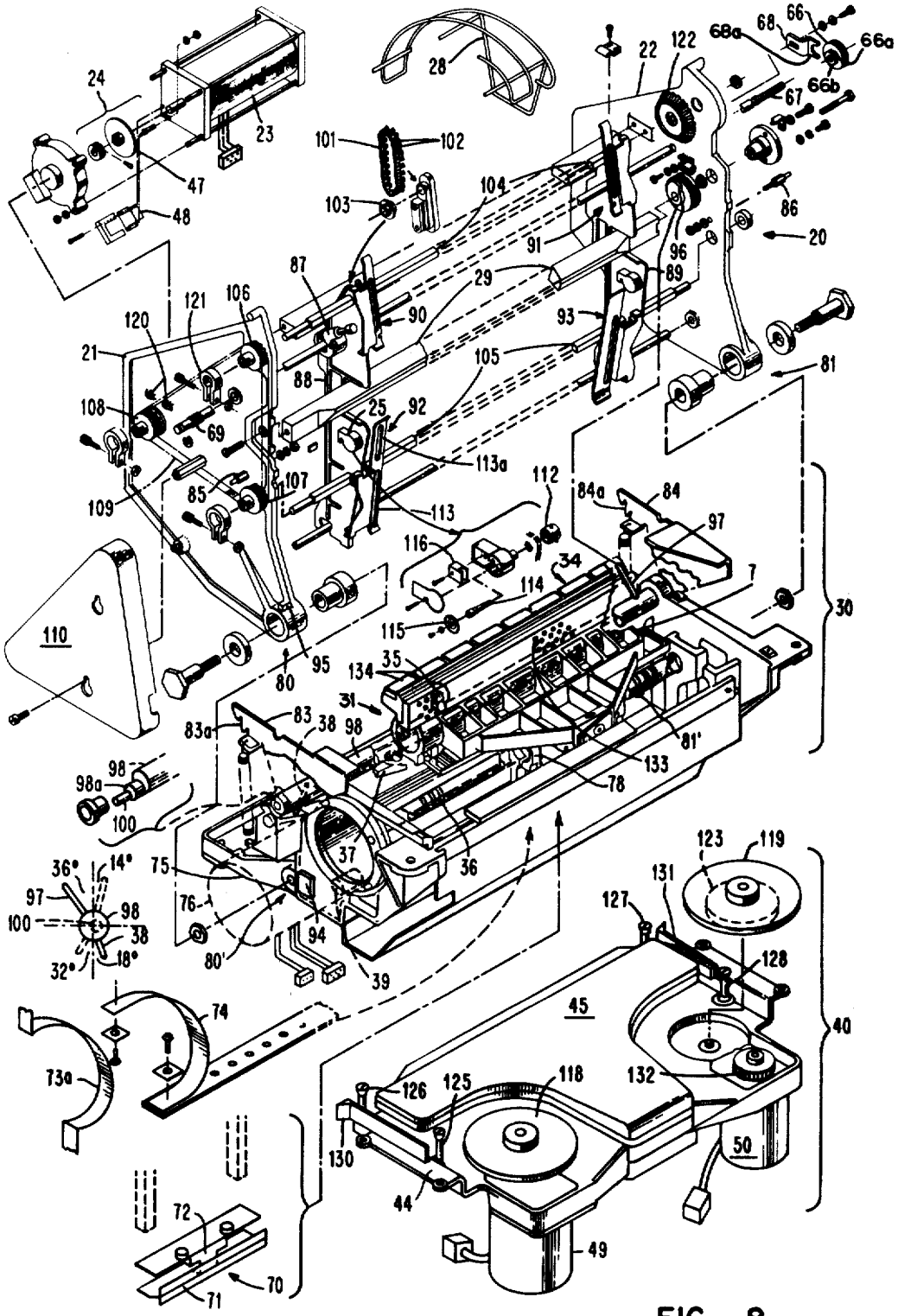
FIG. 8 is an exploded view of various printer assemblies including the forms feed assembly, the print assembly and the ribbon drive assembly.
Figure 9:
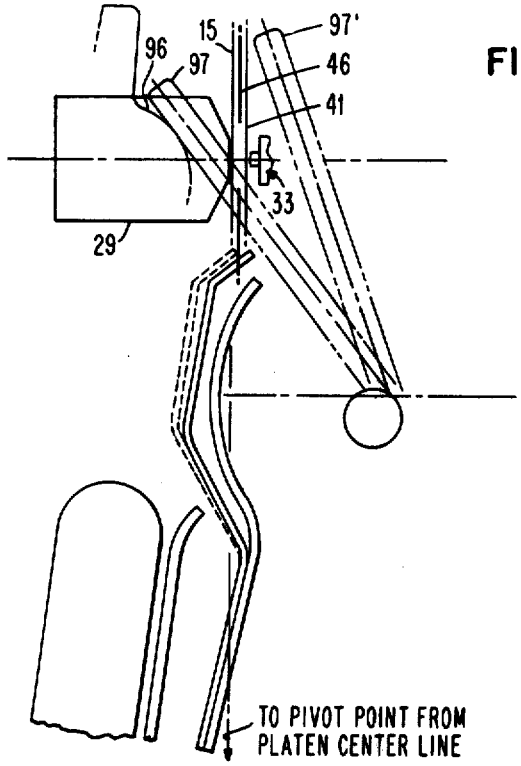
FIG. 9 is a cross-sectional view at the print line of the printer of FIGS. 2, 3, and 8.
Figure 10:
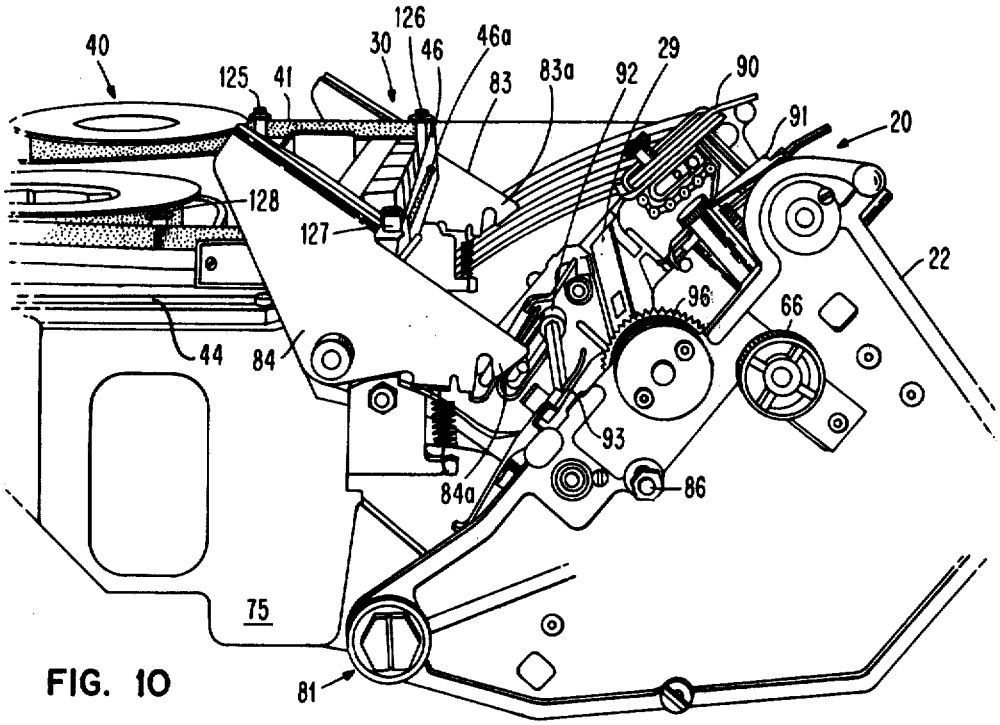
FIG. 10 is a right side elevation of various printer assemblies shown in FIG. 8.

FIGS. 8, 9 and 10, among others, show the details of construction of the forms feed assembly 20, the print assembly 30, the ribbon drive assembly 40, and various associated emitters. A general overview of these assemblies is first presented.

As best seen in FIGS. 8 and 10, forms feed assembly 20 has end plates (side castings) 21 and 22 which support the various forms feed mechanisms including a drive motor 23 to drive tractors 90-93, the motor 23 having a forms feed emitter assembly 24. The forms feed assembly 20 has a separate end of forms and jam detector emitter 25. Assembly 20 also includes a platen 29 located behind the forms 15 and against which the print wires 33 are actuated during printing. See FIG. 9.

The print assembly 30 includes a base casting 75 supporting various mechanisms including print motor 76, shown in phantom in FIG. 8 in order that other elements may be seen more easily, and connected to drive a print head carrier 31 with actuator block assembly 7 in a reciprocal fashion horizontally to effect printing on an inserted form 15. The print assembly 30 also drives the print emitter assembly 70 having emitter glass 71 and optical sensor assembly 72.

The ribbon drive assembly 40 includes a support casting 44, a cover 45, and drive motors 49 and 50.

Forms Feed Assembly

In order to load paper in the printer the forms feed assembly 20 pivots away from the base casting 75 at pivot points 80 (80') and 81 (81'), the latter pivot point being best seen in FIG. 10, to allow access to thread the forms 15 into position. Latches 83 and 84 are raised by the operator so that extremities **83*a* and 84*a* disengage eccentric pins 85 and 86 on the forms feed assembly 20. The forms feed assembly 20 then pivots away from the operator as viewed in FIGS. 3 and 8 and to the right as viewed in FIG. 10. This allows access to tractors 90-93 so that the operator may load paper. The forms feed assembly 20 is then reclosed and relatched by latches 83 and 84 for normal machine operation. During the time that the forms feed assembly 20 is pivoted back for service, a switch 94 prevents machine operation. Switch 94 is actuated by a tang 95 on forms feed assembly 20** when it is closed.

Referring to FIG. 8, the forms feed assembly 20 includes means for adjusting for forms thickness. As mentioned, the entire forms feed assembly 20 pivots back from the rest of the printer about pivot points 80 and 81. In the closed position the forms feed assembly 20 is in such a position that a spiral cam and knob assembly 96 engages a pin 97 on the main carrier shaft 98 of the print assembly 30. Pin 97 is movable, for example, to position 97' as illustrated in FIG. 9. Adjustment of the spiral cam and knob assembly 96 is such that it rotates the main carrier shaft 98. Assembly 96 is detented into a position selected by the operator. Associated with shaft 98 are eccentrics such as portion **98*a* on the left end of shaft 98 with tenon 100 onto which latch 83 is mounted. Rotation of shaft 98 thus moves latches 83 and 84 which changes the distance between assemblies 20 and 30 and thus the distance between the ends of print wires 33 and platen 29. This adjustment enables the printer subsystem 2 to accommodate forms 15 of various thicknesses. The printer can handle forms 15** from one part to six parts thickness.

The paper feeding is accomplished by the four sets of tractors 90-93 two above the print line and two below the print line. The individual tractors 90-93 include drive chains to which pins are attached at the proper distance to engage the holes in the form 15. As an example, tractor 90 has drive chain 101 with pins 102. Chain 101 is driven by a sprocket 103 attached to a shaft 104 which also drives the sprocket and chains for tractor 91. Tractors 92 and 93 are driven from shaft 105. Because the tractors 90-93 are above and below the print line, the printer is able to move the paper in either direction. The normal direction of forms drive is upwardly in FIGS. 3 and 8. However, it is possible to move the paper downwardly, as well.

Rotation of shafts 104 and 105 and forms feeding is accomplished by appropriate drive of motor 23 in the proper direction which in turn drives pulleys 106 and 107 (to which shafts 104 and 105 are connected) from motor pulley 108 by means of drive-timing belt 109. Cover 110 covers belt 109 and pulleys 106-108 during rotation. The forms feed emitter assembly 24 includes an emitter wheel 47 with marks to indicate rotation and a light emitting diode assembly 48 that serve to indicate extent of rotation of motor 23 in either direction and as a consequence, the extent of movement of the forms 15 as they are driven by motor 23.

The capability of the printer to feed paper in both directions offers some advantages. For example, in order to improve print visibility at the time the Stop pushbutton 52 (on operator panel 26) is depressed by the operator, the paper may be moved up one or two inches above where it normally resides so that it can be easily read and can be easily adjusted for registration. When the Start pushbutton 53 (on operator panel 26) is depressed, the paper is returned to its normal printing position back out of view of the operator. The printer may also be used in those applications where plotting is a requirement. In this case a plot may be generated by calculating one point at a time and moving the paper up and down much like a plotter rather than calculating the entire curve and printing it out from top to bottom in a raster mode.

End of forms and jam detection is accomplished by assembly 25 having a sprocket 112 just above the lower left tractor 92. The teeth in sprocket 112 protrude through a slot 113*a* in the flip cover 113. Sprocket 112 is not driven by any mechanism but simply is supported by assembly 25. Sprocket 112 engages the feed holes in the paper as it is pulled past by the tractor assemblies. On the other end of the shaft 114 from sprocket 112 is a small optical emitter disc 115. The marks in disc 115 are sensed by an LED phototransistor assembly 116 and supplied to electronics 4 of the subsystem 2. Electronics 4 verifies that marks have passed the phototransistor assembly 116 at some preselected frequency when the paper is being fed. If the mark is not sensed during that time, the machine is shut down as either the end of forms has occurred or a paper jam has occurred.

The castings 88 and 89 supporting the tractors 90–93 are adjustable left or right in a coarse adjustment in order to adjust for the paper size used in a particular application. After they are properly positioned they are locked in place on shaft 67 by locking screws such as locking screw assembly 87.

All tractors 90–93 are driven by the two shafts 104 and 105 from motor 23 as previously described. Motor 23 adjusts in the side casting 21 in slots 120 in order to provide the correct tension for belt 109.

Besides the coarse adjustment, there is also a fine adjustment which is used to finally position in very small increments laterally the location of the printing on forms 15. This is done by a threaded knob 66 which engages shaft 67 to which both tractor castings 88 and 89 clamp. Shaft 67 floats between side castings 21 and 22 laterally. The threads in knob 66 engage threads on the right end of shaft 67. Knob 66 is held in an axially fixed position by a fork 68, the portion 68*a* engaging notch 66*a* formed by the flanged portion 66*b* of knob 66. Therefore knob 66 stays stationary and the threads driving through the shaft 67 force it laterally left or right, depending upon the direction in which knob 66 is rotated. Shaft 67 is always biased in one direction to take out play by a spring 69 on the left end of shaft 67. As the forms 15 leave the top of the tractors 90, 91, they are guided up and toward the back of the machine and down by the wire guide 28.

In order to insure that the distance between the pins 102 in the upper tractors 90, 91 is in correct relationship to the pins 102 in the lower tractors 92, 93 an adjustment is performed. This adjustment is made by inserting a gauge or piece of paper, not shown, in the tractor assembly which locates the bottom pins 102 in the correct relationship to the top pins 102. This is done by loosening a clamp 121 on the end of shaft 104. Once this position is obtained, then clamp 121 is tightened and in effect phases the top set of tractors 90, 91 to the bottom set 92, 93 so that holes in the form 15 will engage both sets of tractors 90, 91 and 92, 93 correctly. Forms 15 may be moved through the tractor forms feed assembly 20 manually by rotating knob 122. Knob 122 simply engages the top drive shaft 104 of the upper tractor set and through the timing belt 109 (also shown in FIG. 13) provides rotational action to the lower tractor set, as well.

Print Assembly

Figures 11, 12, 13:
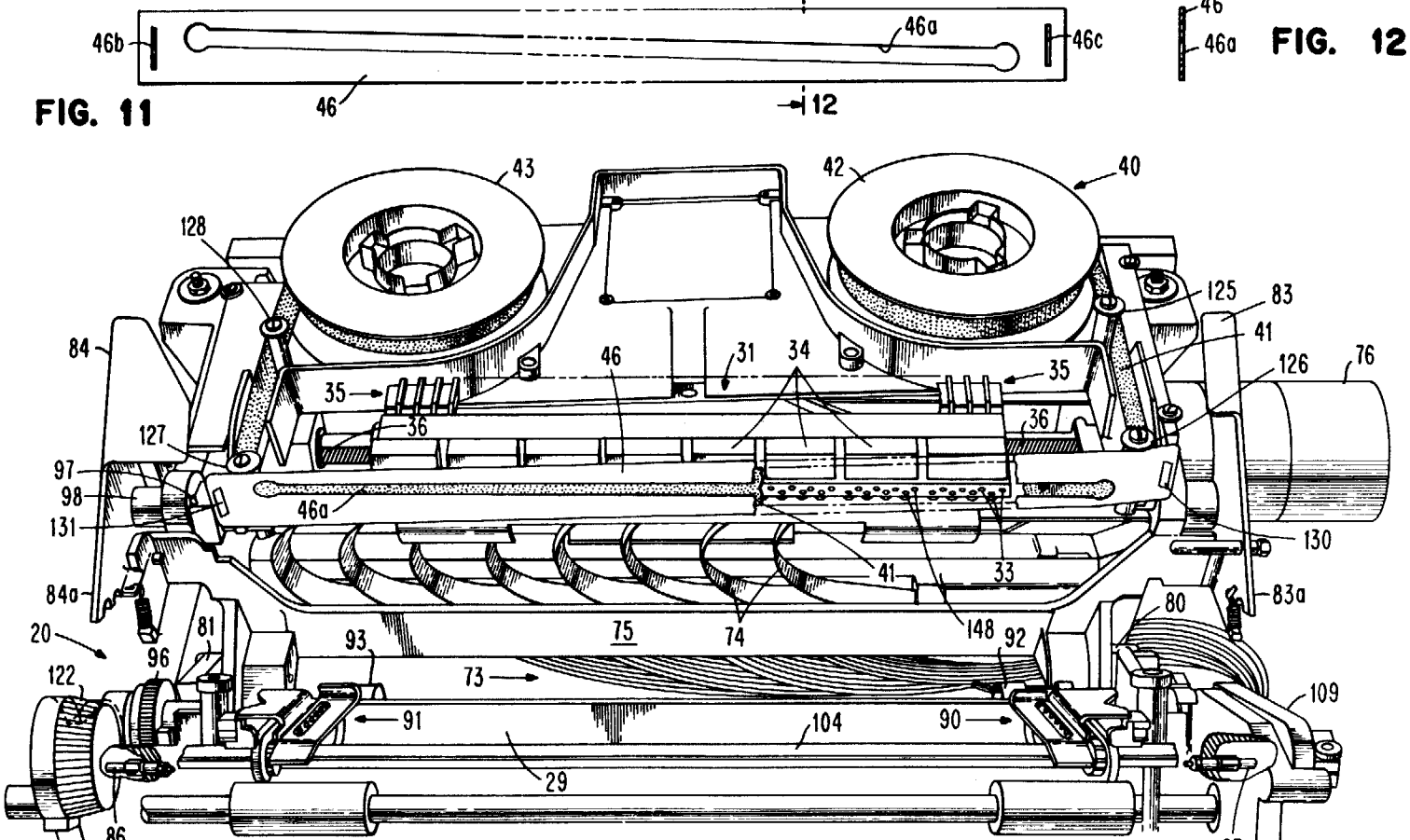
FIG. 11 is a view of a ribbon shield having a print aperture positioned in a horizontal plane.
FIG. 12 is a cross-sectional view of the ribbon shield on the line 12—12 in FIG. 11.
FIG. 13 is an overhead view of the printer slightly from the rear of the unit showing the forms feed open.

In FIG. 8, print assembly 30 comprising a carrier 31, actuator block assembly 7 and support 78 accommodates all the print heads 34 with their wire actuators 35 and print wires 3. Also, see FIGS. 13 and 14–26. Actuator block assembly 7 is designed to hold from two up to eight or nine print head groups of eight actuators 35 each. Thus, a printer with eight print head groups, as shown in FIGS. 8 and 13, has sixty-four print wire actuators 35 and sixty-four associated print wires 33. Print wires 33 project through apertures 148, FIG. 13. Only two actuators 35 are shown positioned in place in FIG. 8. The other sixty-two actuators 35 would be located in apertures 133 only a few of which are depicted. To insure long life of the print wires 33, lubricating assemblies 134 containing oil wick assemblies 142 (See FIG. 14) are positioned in proximity to the print wires 33. The print wire actuators 35 fire the wires 33 to print dots to form characters. Carrier 31 is engaged with and is shuttled back and forth by a lead screw 36 driven by motor 76. Lead screw 36 drives carrier 31 back and forth through nuts, not shown, which are attached to the carrier 31. When carrier 31 is located at the extreme left, as viewed in FIGS. 3 and 8 (to the right as viewed in FIG. 13), this is called the "home or ramps position". When the carrier 31 is moved to the home position, a cam 37 attached to the carrier 31 engages a pin 38, the pin 38 being attached to the main carrier shaft 98. If the machine has not been printing for some period of time, in the neighborhood of a few seconds, the printer control unit 3 signals the carrier 31 to move all the way to the left, in which case cam 37 engages pin 38 to rotate the main carrier shaft 98 approximately 15 degrees. The maximum rotation of shaft 98 is about 50° shown for pin 97 as $36° + 14° = 50°$ and for pin 38 as $32° + 18° = 50°$. On each end of the shaft 98 are the eccentrically located tenons, such as tenon 100, previously described. Tenons, such as tenon 100, engage then latches 83 and 84 so that the distance between the print assembly 30 and the forms feed assembly 20 is controlled by the latches 83 and 84. As shaft 98 rotates, the eccentrically located tenons, such as tenon 100, associated with latches 83 and 84 separate the forms feed assembly 20 from the print assembly 30.

The purpose of motor 76, of course, is to move the carrier 31 back and forth in order to put the print actuators 35 and print wires 33 in the proper positions to print dots and form characters. Since the motion is back and forth, it requires a lot of energy to get the mass of carrier 31 and actuators 35 stopped and turned around at the end of each print line. A brushless DC motor is used. The commutation to the windings in the motor 76 is done external to the motor 76 through signals sent out of the motor 76 via a Hall effect device emitter 39. In other words, the emitter 39 within the motor 76 sends a signal out telling the printer control unit 3 that it is now time to change from one motor winding to the next. Therefore, there are no rubbing parts or sliding parts within the motor 76, and switching is done externally via electronics 4 based on the signals that the motor 76 sends out from its emitter 39. The motor 76 draws about 20 amperes during turnaround time and, because of the high current it draws and because of the torque constant required from the motor 76, it is built with rare earth magnets of Semarium cobalt which provide double the flux density of other types of magnets.

Semarium cobalt is not just used because of the higher flux density but also because its demagnetization occurrence is much higher and, therefore, more current can be sent through the motor 76 without demagnetizing the internal magnets. During printing, carrier 31 that holds the print actuators 35 goes at a velocity of approximately 25 inches per second. The turnaround cycle at the end of the print line requires 28 milliseconds approximately, resulting in a Gravity or "G" load in the neighborhood of 4 G's. The carrier 31, with all the actuators 35 mounted, weighs about eight and a half pounds.

The current necessary to fire the print actuators 35 is carried to the actuators 35 via the cable assemblies 73, FIGS. 7 and 13, one for each group of eight actuators 35. The cabling, such as cable 73a, FIG. 8, is set in the machine in a semicircular loop so that as carrier 31 reciprocates it allows the cable 73a to roll about a radius and therefore not put excessive stress on the cable wires. This loop in the cable 73a is formed and held in shape by a steel backing strap 74. In this case there is one cable assembly such as cable 73a for each group of eight actuators 35 or a maximum of eight cable backing strap groups.

Ribbon Drive Assembly

The ribbon drive assembly 40 for the printer is shown in FIG. 8, but reference is also made to FIGS. 3, 9, and 13. Spools 42 and 43 are shown with spool flanges but may be structured without spool flanges and contain the ribbon 41. Spools 42 and 43 can be seen on either side of the machine near the front, FIG. 3 and are respectively driven by stepper motors 49 and 50. Spools 42 and 43 typically contain 150 yards of standard nylon ribbon 41 that is one and a half inches wide. Gear flanges 118 and 119, FIG. 8, support ribbon spools 42 and 43, respectively. Drive for spool 43, as an example, is from motor 50, pinion gear 132 to a matching gear 123 formed on the underneath side of gear flange 119 then to spool 43. In one direction of feed, the ribbon path is from the left-hand spool 42 past posts 125 and 126, FIGS. 3, 8 and 13, across the front of the ribbon drive assembly 40 between the print heads 34 and forms 15, then past posts 127 and 128 back to the right-hand ribbon spool 43. A ribbon shield 46 to be described in conjunction with FIGS. 11-13 is generally located between posts 126 and 127 and is mounted on the two attachment spring members 130 and 131.

Ribbon Shield

FIG. 11 illustrates ribbon shield 46 that is particularly useful in the printer described herein. FIG. 13 is a cross-sectional view along the line 12—12 in FIG. 11. Shield 46 has an elongated aperture 46a extending almost its entire length. The aperture 46a enables the print wires 33 to press against the ribbon 41 in the printer through the shield 46 in order to print on forms 15. Shield 46 has slits 46b and 46c at opposite extremities to permit easy mounting in the printer on spring members 130 and 131 of the ribbon drive assembly 40, FIG. 13.

Assembly View

FIG. 13 is an assembly view of the printer including forms feed assembly 20, print assembly 30, and ribbon drive assembly 40. Ribbon drive assembly 40 includes the two ribbon spools 42 and 43 which alternatively serve as supply and takeup spools. As mentioned, spools 42 and 43 typically contain 150 yards of standard nylon ribbon 41 that is one and one-half inches wide. If spool 42 is serving as the supply spool, ribbon 41 will be supplied past posts 125 and 126, through the ribbon shield 46 past posts 127 and 128 and thence to the takeup spool 43. Shield 46, FIGS. 11 and 13, and ribbon 41, FIG. 13, are illustrated slightly on the bias relative to horizontal which is their more normal relationship in the printer. The ribbon drive assembly 40 is also positioned on a slight bias relative to horizontal to accommodate the bias of shield 46 and ribbon 41. In this condition aperture 46a assumes a horizontal relationship with respect to the print wires 33 and forms 15. Thus, in FIG. 13, the rightmost end of shield 46 is somewhat elevated in relation to the leftmost end in order that aperture 46a is maintained in a relatively horizontal position with respect to the printer actuators 35 in print assembly 30. A few of the groups of print wires 33 are indicated at a breakaway section of shield 46. As previously noted, the print wires 33 are reciprocated back and forth laterally in relation to forms 15 not shown in FIG. 13, in order to effect the printing of characters. The reciprocation is by means of drive mechanisms activated from motor 76. The activating signals for the actuators 35 in print assembly 30 are supplied through cabling indicated at 73.

Actuator Block, Guide, and Actuators

Enlarged views of the actuator block assembly 7, guide 79, print wire actuators 35, lubricating assemblies 134, and various related mechanisms are shown in FIGS. 14-23. Referring to FIG. 14, this better illustrates the arrangement of apertures 133 in actuator block assembly 7 which can accommodate eight print heads 34 with eight print wire actuators 35. Apertures 133a are used to mount actuators 35 while apertures 133b allow passage of barrels 136 of actuators 35 through actuator block assembly 7 and guide 79 up to the print line. A typical lubricating assembly 134 comprises a cover 140, felt element 141, wick assembly 142, and housing 143 that contains lubricating oil.

FIG. 15 illustrates a portion of face 79a of guide 79 while FIG. 16 illustrates a portion of face 79b of guide 79. Barrels 136 of actuators 35 pass through apertures 145 on face 79a of guide 79 and are retained by bolts such as bolt 146 passing through apertures 147 from the opposite side of guide 79. Individual actuator barrels 136 and print wires 33 project through apertures 148, FIGS. 13 and 16.

FIGS. 17-22 illustrate several arrangements which permit mounting of a greater multiplicity of actuators 35, (35a) in a given amount of space through actuator block 77 (77') and guide 79 (79'). FIGS. 17-19 illustrate one possible mounting arrangement for the actuators 35a while FIGS. 20-22 illustrate the actual mounting arrangement previously described in conjunction with FIGS. 8, 13, and 14-16.

FIGS. 17-19 represent an alternative mounting arrangement. In this case, actuators 35a, actuator block 77' and guide 79' are retained by bolts such as bolt 146' passing through aperture 147'. Print actuators 35a and print wires 33 for one print head set of eight (1-8) are arranged on a straight slope 150. Slope 150, combined with actuator block 77' having a double angle configuration at 151, FIG. 18, results in a staggered print wire face-to-platen condition, FIG. 19. This print wire face-to-platen distance, shown as 8X, is critical to both the stroke and flight time of the print wires 33.

The preferred arrangement, FIGS. 20-22, has a number of attributes, including improved functioning, increased coil clearance, and ease of manufacture. In this method, print wires 33 arranged in a set 1-8 are mounted in two offset sloped subsets 152a and 152b forming a sloped serrated pattern. (See also FIGS. 15 and 16.) Subset 152a includes print wires 1-4 of the set while subset 152b includes print wires 5-8. This, combined with a straight surface 153 on actuator block 77 and angled actuators 35, FIG. 21, represent an in-line print wire face-to-platen condition as in FIG. 22. The print wire face-to-platen distance, shown as X, is at a minimum. This permits a higher printing rate and prevents wire breakage. The offset sloped print wire sets gives a greater clearance between wire positions which allows a larger actuator coil to be used.

Figure 24:
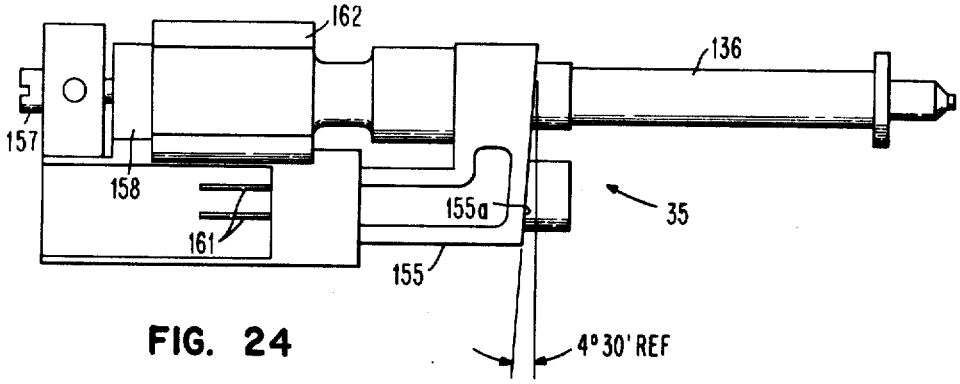

Use of a straight surface 153 instead of the double angle configuration 151 facilitates manufacturing of the actuator block 77 and thereby reduces cost. However, brackets 155 are still cut at an angle such as shown in FIG. 24. The angular relationships of the print actuators 35*a* with respect to the platen face in FIG. 18 and print actuators 35 with respect to the platen face in FIG. 21 are somewhat larger than would be encountered in an actual implementation but they are shown this way to make the relationships easier to see. In contrast, an actual angular relationship might be smaller such as the 4° 30′ angle front face 155*a* on bracket 155 of actuator 35 in FIG. 24.

FIGS. 23–26 illustrate a preferred form of actuator 35. Actuator 35 operates on principles described and claimed in U.S. patent application Ser. No. 043,183, filed May 29, 1979, having R. W. Kulterman and J. E. Lisinski as inventors and entitled "Springless Print Head Actuator". This application is assigned to the same assignee as the present application. In the Kulterman actuator, a print wire is provided having an armature which is retained in home position by a permanent magnet. When printing of a dot is required, an electromagnet is energized which overcomes the magnetic forces of the permanent magnet and propels the print wire toward the paper.

Figure 26:
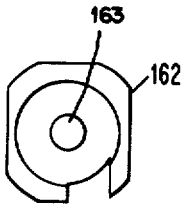
Figure 25:
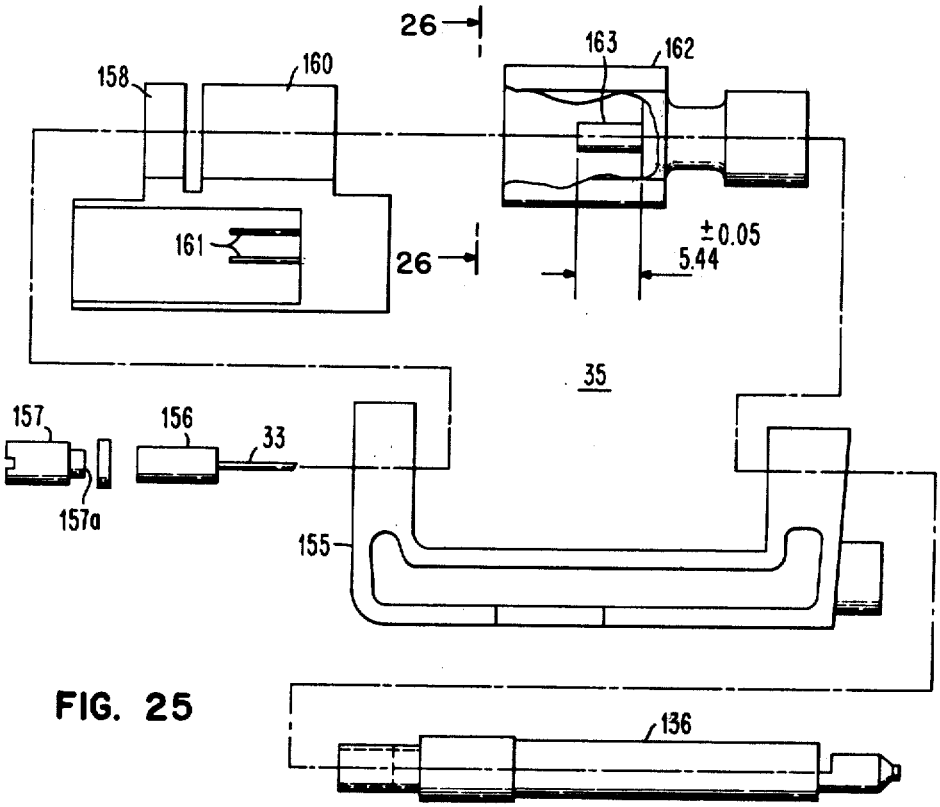

FIG. 23 illustrates one side elevation of the actuator 35, while FIG. 24 illustrates the opposite side elevation. The actuator 35 comprises a number of elements arranged in a generally concentric manner on bracket 155. It is noted that FIG. 24 is somewhat enlarged relative to FIG. 23. Reference is also made to FIGS. 25 and 26 for details of the individual components of the actuator 35. Also, it is noted that some slight structural differences appear between the actuator 35 shown in FIGS. 23–26 and those illustrated in FIGS. 17–22, the actuators 35, 35*a* in FIGS. 17–22 being more diagrammatically illustrated. The actuator 35 includes a barrel 136 for supporting print wire 33 in proper relationship for printing when mounted in actuator block 77 and guide 79. Attached to the leftmost end of print wire 33 as viewed in FIG. 25 is an armature 156 which is arranged against a stop portion 157*a* of an adjustment screw 157 by forces exerted from a permanent magnet 158. A lock nut 159, FIG. 23, retains adjustment screw 157 in proper position. Thus, when not active, armature 156 and print wire 33 abut against stop portion 157*a*. When it is desired to actuate print wire 33, electromagnet 160 is rapidly impulsed from an external source by way of connectors 161. Energization of electromagnet 160 overcomes the magnetic flux forces of permanent magnet 158 moving armature 156 and print wire 33 to the right as viewed in FIG. 25 thus causing the rightmost end of print wire 33 which is in proximity to the forms 15, to print a dot on the forms 15. A bobbin housing 162 is made of metallic substances to provide a shielding effect with respect to the coil of electromagnet 160. It is found that this has been beneficial when numerous print wire actuators 35 are mounted in position on actuator block 77 and guide 79 since it prevents stray impulses from reacting from one actuator 35 to another nearby actuator 35. This has proven to be extremely advantageous when multiple print actuators 35 are provided as in the present printer. A core element 163 provides a forward stop location for armature 156 in readiness for restoration by permanent magnet 158 against stop portion 157*a* as soon as current is removed from electromagnet 160.

FIG. 26 is an end elevation of housing 162 along the line 26—26 in FIG. 25.

Alternative Forms Feed Assembly

Figures 27, 28:
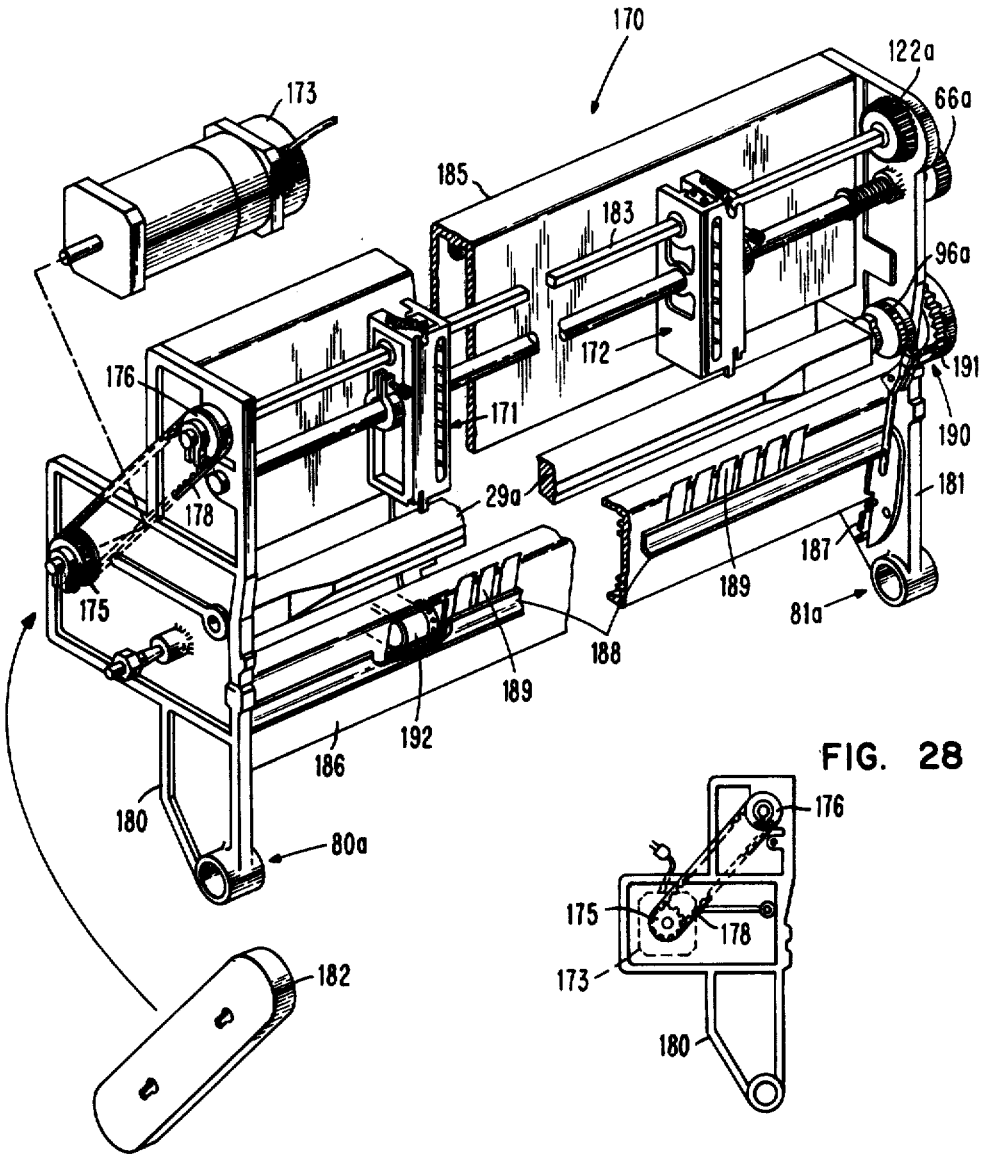
FIGS. 27 and 28 illustrate an alternative forms feed assembly for the printer unit.

FIGS. 27 and 28 illustrate an alternative single direction forms feed assembly 170 which feeds forms such as forms 15 only in the upward direction as viewed in these figures. In contrast with the forms feed assembly 20 previously described in conjunction with FIG. 8, this forms feed assembly 170 has only a single upper set of tractors 171 and 172. A driving motor 173 provides driving force through gears 175 and 176 by way of timing belt 178. The various elements comprising the forms feed assembly 170 are supported in a left end plate 180 and a right end plate 181. FIG. 28 is a left end elevation of the forms feed assembly 170 illustrating the positional relationships of motor 173, timing belt 178 and other elements. A cover plate 182 covers timing belt 178 during operations. Driving of the pin feeds on the two tractors 171 and 172 is analogous to the driving of the pin feeds for forms feed assembly 20 illustrated in FIG. 8 and previously described. In forms feed assembly 170, the tractor drive includes a drive shaft 183.

Lateral support for the forms feed assembly 170 is provided by an upper support 185 and a lower support 186. The assembly 170 also includes a platen member 29*a*. Other elements such as knobs 122*a*, 66*a*, and 96*a* are analogous to their counterpart elements 122, 66, and 96 shown in FIG. 8. The forms feed assembly 170 mounts to the printer base casting 75 in FIG. 8 at pivot points 80*a* and 81*a*.

In place of the two lower tractors 92 and 93 in FIG. 8, this forms feed assembly 170 includes a pressure drag assembly 188 with compliant fingers 189. These fingers 189 exert physical pressure against the paper when in position against platen 29*a* and in the immediate vicinity of the printing station which comprises platen 29*a*.

At the same time that forms feed assembly 170 is opened for insertion of new forms 15, the drag assembly 188 is also opened, but while the forms feed assembly 170 moves toward the rear of the printer, the drag assembly 188 moves toward the front. Spring element 187 enables drag assembly 188 to adjust to allow the forms 15 to slide through when loading the forms 15. One additional cam element 190 cooperates with a follower 191 to provide adjustment of the pressure exerted by the drag assembly 188 on the paper for the purpose of accommodating various thicknesses of forms 15.

The assembly 170 includes an End of Forms sprocket assembly 192 that could also serve to detect paper jams and that works in an analogous fashion to assembly 25 with sprocket 112 shown in FIG. 8.

Printing of Characters, Relationships of Print Wires, Character Locations and Emitters Characters that are printed are formed by printing dots on the paper. These dots are printed by wires 33 that are mounted in groups of eight on a carrier 31 that moves back and forth adjacent to the print line. Printing is bidirectional with complete lines of print formed right-to-left and left-to-right. See FIGS. 29, 30, 33A and 33B.

A character is formed in a space that is eight dots high by nine dots wide. As shown in FIG. 30, two of the nine horizontal dot columns (1 and 9) are for spacing between characters. Any one wire 33 can print a dot in four of the seven remaining horizontal dot positions (2 through 8). The printer can print 10 characters per inch or 15 characters per inch.

Most of the characters printed use the top seven wires 33 in the group to print a character in a format (or matrix) that is seven dots high and seven dots wide. The eighth (bottom) wire 33 is used for certain lower case characters, special characters, and underlining.

The number of print wire groups varies according to the printer model, and typically can be 2, 4, 6 or 8 groups. Printing speed increases with each additional wire group.

There are 16 characters sets stored in the printer control unit 3. Any of these sets may be specified for use by the using system program.

FIG. 31 is a representation of the emitter glass 71 also shown in FIGS. 7 and 8 and associated with the print assembly 30. It has sections called "Ramp", "Home", and "Left Margin". These are coded sections, designated Track A, Track B, and Track C. Track B is sometimes referred to as the "Turnaround" track. "Home" is indicated by all three tracks A, B, C being clear. "Ramp" is when Track A and Track C are clear, but Track B is opaque. "Left Margin" is when only Track C is clear, and Tracks A and B are opaque. Left Margin can be told from Right Margin because Track B is clear on Right Margin whereas Track B is opaque on Left Margin. For convenience, glass 71 is shown in a more normal representation with the left margin areas to the left and the right margin areas to the right. In actuality, the emitter glass 71 is physically located in the machine with the right-hand part in FIG. 31 toward the left and the left-hand part in FIG. 31 toward the right as viewed in FIGS. 7 and 8. This is due to the fact that the associated optical sensor assembly 72 is physically located at the rightmost area of the emitter glass 71 when the print assembly 30 is in home position, and glass 71 actually is moved past the optical sensor assembly 72 from left to right as the print assembly 30 moves from left to right away from home position.

FIG. 32 illustrates the development of emitter pulses from the emitter glass 71 shown in FIG. 31, the signals being termed "real emitters" when actually sensed from Track A. "Option" emitters (sometimes referred to as "false" emitters) are developed electronically in the printer control unit 3. The use of emitter assembly 70 in keeping track of printing location is described. The emitter assembly 70 tells the electronics 4 when the wires 33 are in a proper position to be fired to print the dots in correct locations. It essentially divides the print line into columnar segments, each one of which is available to the electronics 4 to lay down a print dot. Track A, the basic track which controls the printing of dots has spacings of 0.0222 inches. This corresponds to two print columns distance on the emitter assembly 70 in a normal print cycle and for ten characters per inch one optional mark referred to as an "option" is inserted halfway in between each real emitter.

Each emitter track A, B or C actuates one pair of light emitting diode-photo transistor (LED-PTX) sensors within sensor assembly 72. These sensors are described in conjunction with FIG. 69 of the William W. Boynton et al patent application Ser. No. 086,484 noted above. Track A provides print initiation pulses, Track B provides turnaround information, and Track C indicates if the print heads 34 are in either the left or right margin.

If the line to be printed is shorter than the maximum print line length, typically 13.2 inches, then a signal for turnaround (reversal of print motor 76 direction) is given as soon as the last character has been printed. The motor 76 now decelerates until it comes to a stop, and then immediately accelerates in the reverse direction until nominal speed is reached.

Figure 56:
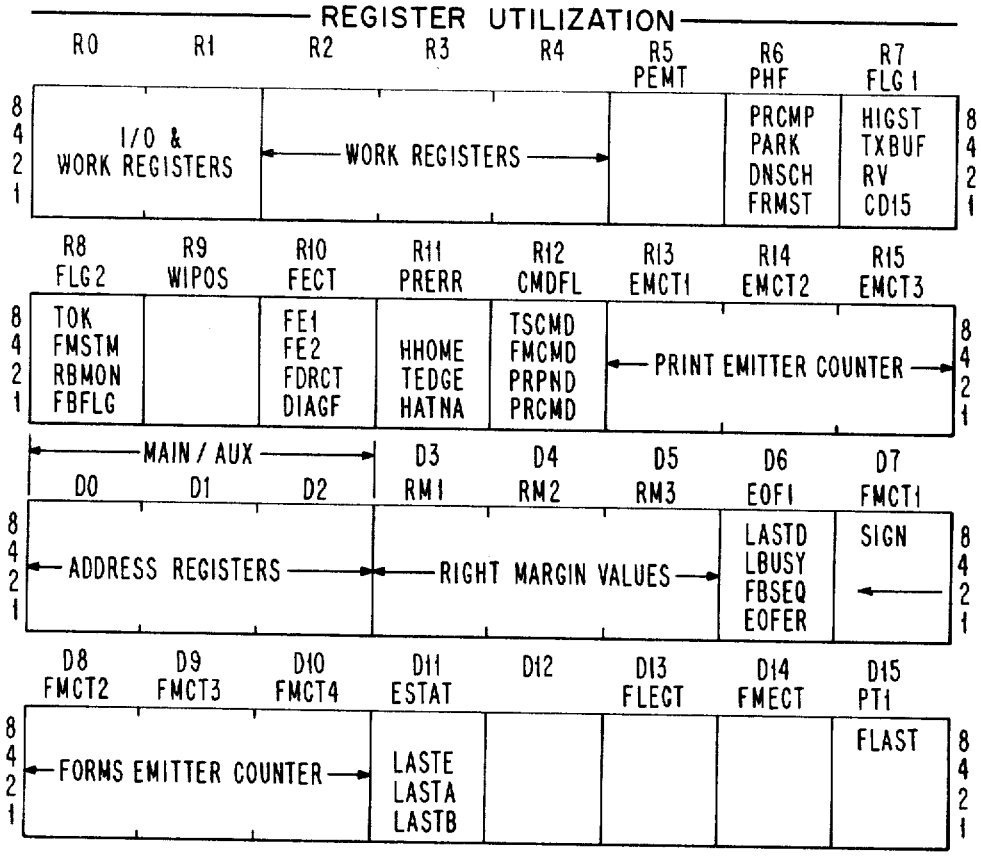
FIG. 56 illustrates utilization of registers in the Control microprocessor.

To keep track of the print head position, the number of emitter pulses of Track A are counted by utilizing the print emitter counter, FIG. 56. The count derived from Track A keeps increasing regardless of whether the print assembly 30 moves to the right or left. In order to indicate the true position of the print assembly 30, provision is made electronically to convert this count so that the count increases when the print assembly 30 moves in one direction and the count decreases when moving in the opposite direction.

In order to accomplish this, Track B has been added. It is assumed that the print assembly 30 is moving to the right. After the last character has been printed and the signal for turnaround has been given, the print assembly 30 will continue to move to the right and the count will increase. However, as soon as the next transition has been reached on Track B, the count is frozen. The print assembly 30 now comes to a stop and reverses. When it again passes the transition where the count was frozen, the emitter counts will now be subtracted and a true position indication is maintained by the counter, not shown, for Track A.

The length of the Track B segments are chosen to be longer than the distance it takes the print assembly 30 to come to a stop. The higher the print head speed and the longer the turnaround time, the longer must be the Track B segments. Thus, if the line is shorter than 132 characters at ten characters per inch, the carrier 31 need not travel all the way to the right end of the print line. It may turn around soon after the printing is completed.

Figure 33A:
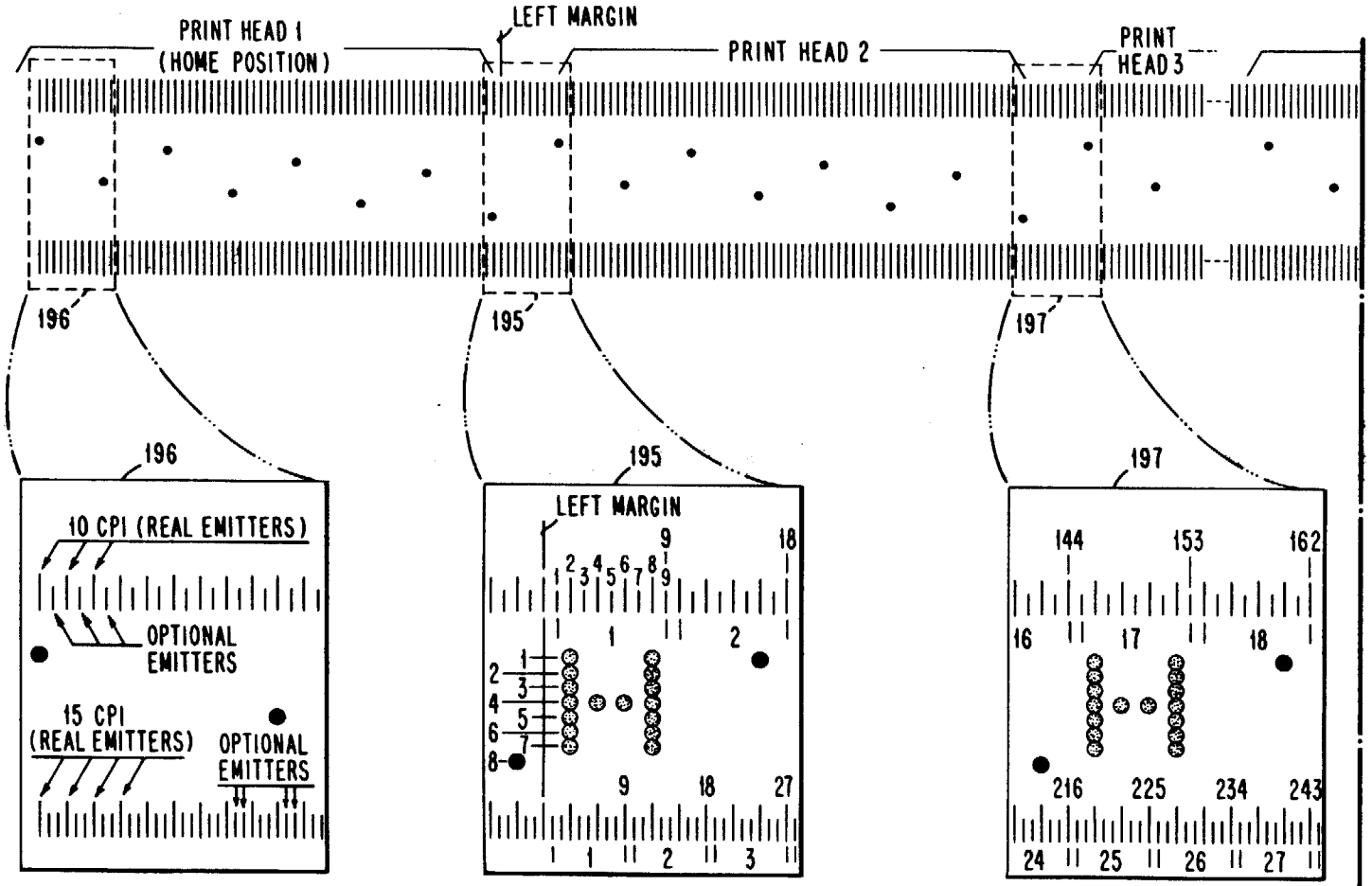
FIGS. 33A and 33B, when arranged as shown in FIG. 34, show in greater detail the relationship of the print wires to character locations on the forms to be printed.
Figure 33B:
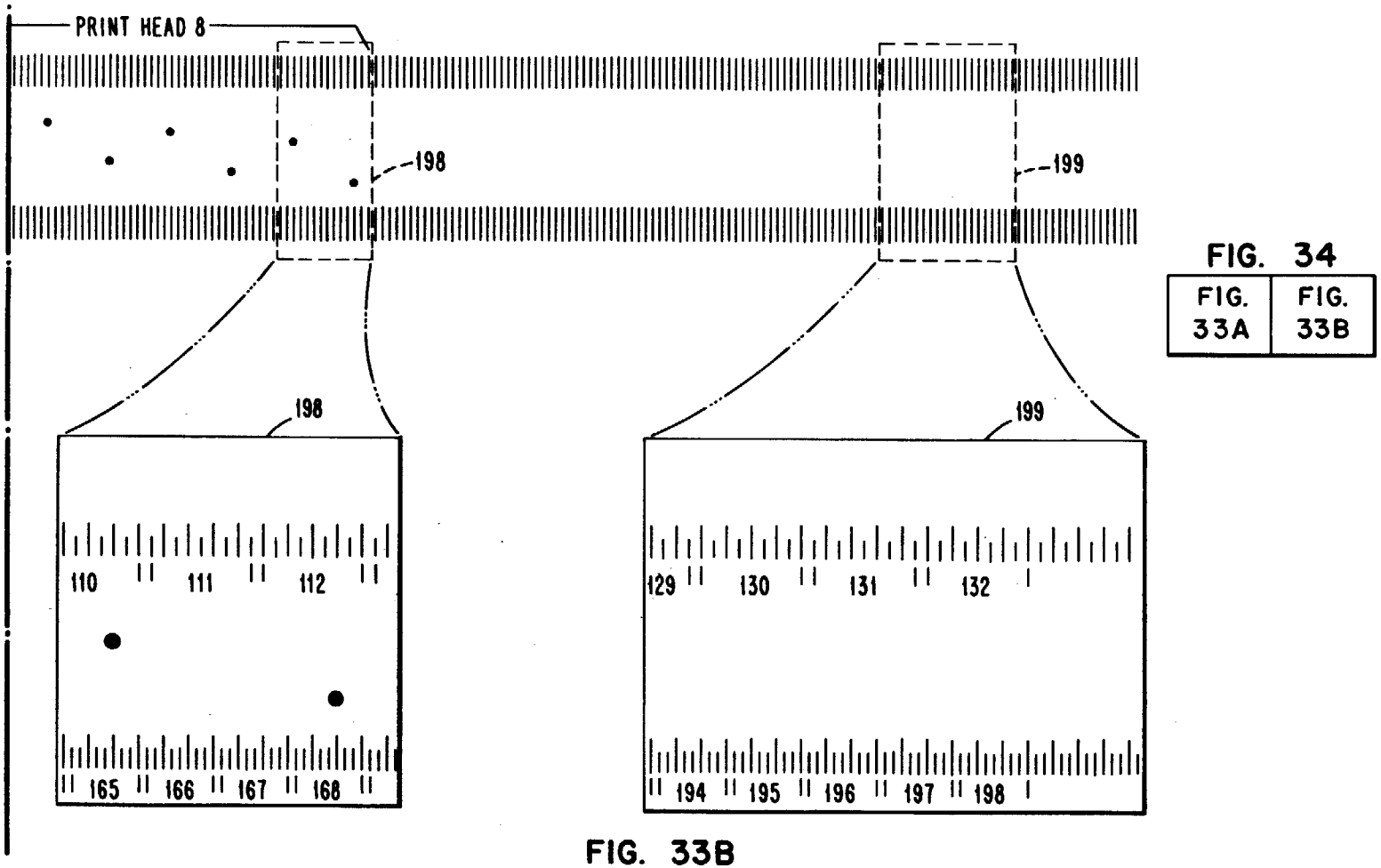

FIGS. 33A and 33B, when arranged as shown in FIG. 34, comprise a diagram showing the physical relationship of the print heads 34 when in the home position relative to character locations on a form 15 to be printed. In addition, the emitter relationships are shown.

In FIG. 33A, print head 1, comprising eight print wires 33, is normally to the left of the nominal left margin when in home position. Print head 2 lies to the right of the left margin when the print assembly 30 is in home position and the other print heads 3–8 up to eight, as an example, are physically located at successively further positions to the right in relation to the form 15. The print wires 33 are arranged in a sloped serrated pattern and are displaced two character positions apart horizontally and one dot location apart vertically. In order to print the character "H" as shown in inset 195, it is necessary that all of the print wires 33 in print head 1 sweep past the "H" character location to effect printing of the individual dots. As each wire 33 passes by and reaches the appropriate position for printing of its assigned dot locations in a vertical direction, it is fired. Thus, formation of characters takes place in a flowing or undulating fashion insofar as the printing of the dots is concerned. That is, an entire vertical column of dots as in the left-hand portion of the character "H" is not formed all at once but is formed in succession as the eight wires 33 in print head 1 sweep past that column. This is true of the printing of all other character columns, as well. As a result of this, each print head 1–8 is required to pass at least far enough so that all of the wires 33 in that print head 34 will be able to print both the first vertical column of dots in the first character required as well as the last column of dots in the last character to be printed in the group of character locations assigned to that print head 1–8.

Accordingly, print head 1, during printing movement of carrier 31, prints all of the characters that normally would appear underneath print head 2 when the print heads 1–8 are in their home position. The printing of dots associated with print head 2 takes place under the home position for print head 3 and so on.

Inset 196 illustrates the relationship of real and optical emitters, sometimes referred to as "false" emitters, for both ten characters per inch (CPI) and fifteen characters per inch (CPI). During the printing of characters at ten characters per inch, real emitters are found as indicated. These are physical real emitters derived from the emitter glass 71 as the print assembly 30 sweeps from left to right or right to left during printing. The same real emitters are used for printing at fifteen characters per inch. However, when printing is at ten characters per inch, one additional (optional) emitter is necessary between each successive pair of real emitters to form the individual characters while, if characters are printed at fifteen characters per inch, two additional (optional) emitters are required between each successive pair of real emitters to handle the printing of dots for those characters.

Inset 197, FIG. 33A, illustrates the character locations associated with the rightmost print wire 33 of print head 2 and the leftmost print wire 33 of print head 3. Print heads 4–7 are not shown since the relations essentially repeat those shown with respect to print heads 1–3. The rightmost wires 33 of print head 8 are shown in Inset 198, FIG. 33B. In addition, Inset 199 shows that for ten characters per inch, 132 characters can be accommodated in a full print line while for fifteen characters per inch, 198 characters are accommodated.

Figure 35:
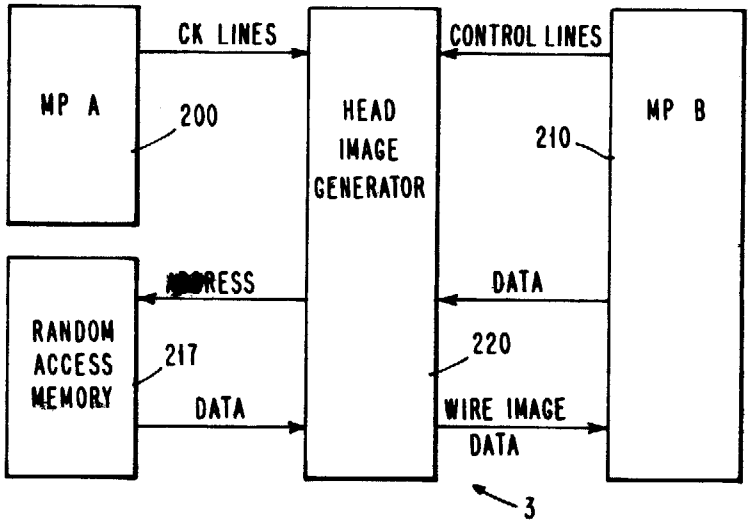
FIG. 35 is a generalized block diagram of the printer control unit shown in FIG. 1.

FIG. 35 is a highly diagrammatic block diagram of the general relationship of various system and control unit components including the two microprocessors 200 and 210 (Also designated MPA and MPB), the Head Image Generator 220 and the random access memory 217 and indicates how the information is transferred that is generated by the Head Image Generator 220 to print dots on the paper by actuation of the actuators 35.

The microprocessors 200 and 210 may be of the type described in U.S. patent application Ser. No. 918,223 filed June 23, 1978, now U.S. Pat. No. 4,179,738 which issued Dec. 18, 1979 having P. T. Fairchild and J. C. Leininger as inventors and entitled "Programmable Control Latch Mechanism for a Data Processing System".

Figure 37:
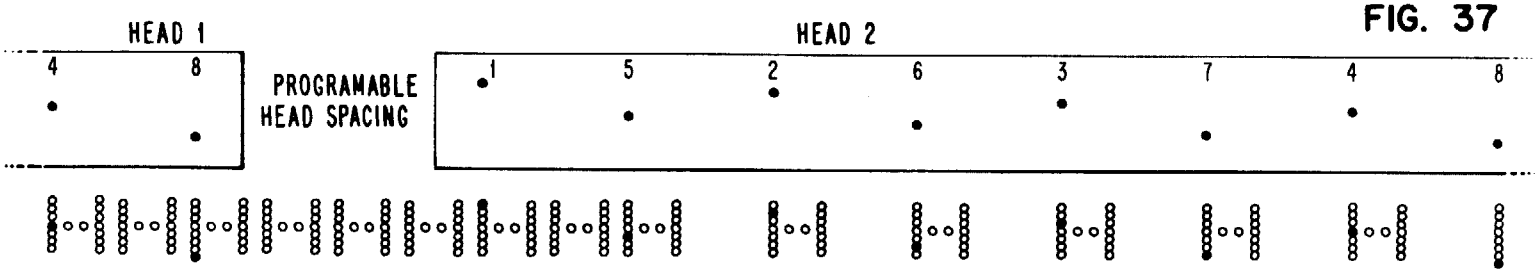

Microprocessor 200 handles communications; microprocessor 210 handles the control of the subsystems. Microprocessor 200 by way of Head Image Generator 220 sets up in memory 217 the count and the text buffer that is to be printed at a selected addressable location. The information is then passed over to microprocessor 210 or the buffer that is to be used. The count is passed to the Head Image Generator 220 and also the address in memory 217 which is the text buffer to be printed. Head Image Generator (HIG) 220, knowing the buffer to be printed, accesses memory 217 and defines the dots for the characters to be printed at each of the successive columns assigned to each print head 34 as print carrier 31 moves during printing. HIG 220 passes the data to the Control microprocessor 210 giving it all the dots to be printed at that particular time. This is represented in FIG. 37 which includes a portion of head 1 and all of head 2. FIG. 37 illustrates printing at ten characters per inch. A string of "H's" is assumed to require printing. The darkened dots of the "H's" represent the wires 33 above them that will actually print that dot. For example, in print head 1, wire 4 prints the fourth dot down in the first column of the leftmost "H". This is the second slice of firing for that particular character with another three actuations being required for wire 4 to complete the horizontal bar portion of the "H". The other seven wires 33 in print head 1 fire at appropriate times to complete their assigned horizontal rows in that character. At head 2, wire 1 is over an "H"; there is no wire 33 over the next "H"; and wire 5 is over the third "H". If printing was at fifteen characters per inch, there would be no wires 33 over two characters between wires 1 and 5 of head 2, rather than just one character as illustrated.

Figure 36:
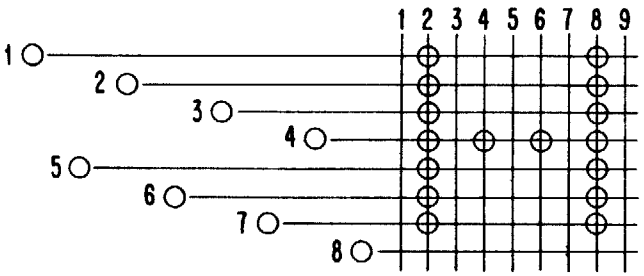
FIGS. 36 and 37 further illustrate the arrangement of dots to form characters and the relationship of the print wires to the various character locations.

The wire layout of "1 5 2 6 3 7 4 8" in FIG. 37 relates to the layout of FIG. 36 where it is shown how an "H" is laid out in relation to the actual wire slices.

Printer Attachment

The printer subsystems may be connected by an interface cable to a controlling device (controller). The printer can be connected to the controlling device itself, or to another printer (or work station unit) with additional cabling.

Controlling Device

Figure 38:
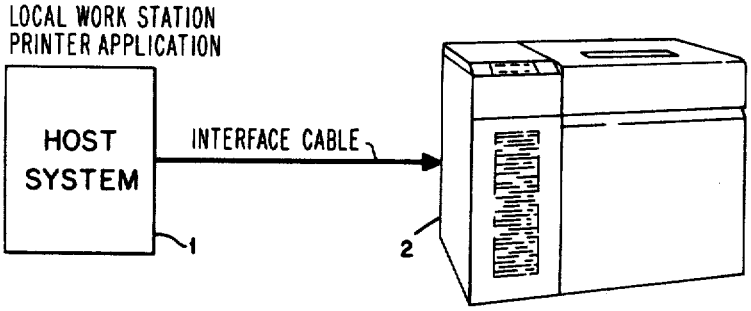
FIGS. 38–40 illustrate various systems in which the printer subsystem may be connected.
Figure 39:
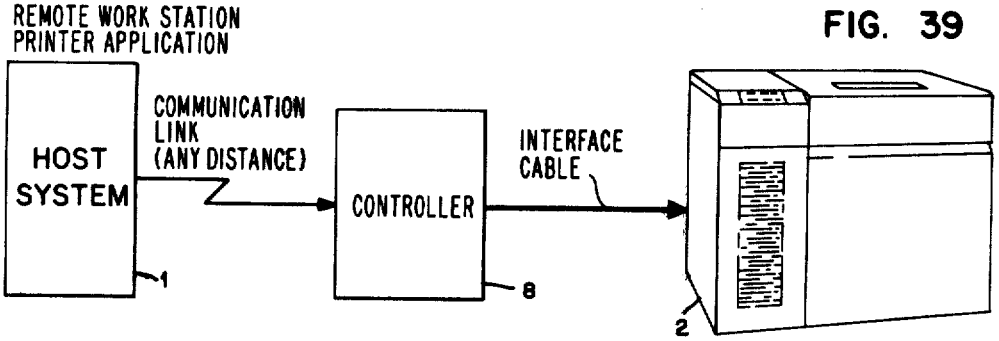

The controlling device to which the printer subsystem 2 is attached may be a host computer system 1, FIG. 38, or a controller 8 at a remote work station, FIG. 39. In either case, all information transfers (exchanges) between the controlling device and the printer control unit 3 are started from the controlling device by a command. Information transfers ordinarily are not initiated by the printer subsystem 2.

In some applications, the printer subsystem 2 may be directly connected to a host computer system 1, as in FIG. 38. In such applications, all commands (operational and formatting) are supplied by the host computer system 1, along with the data to be printed. Responses from the printer are sent directly to the host computer system 1 from the printer control unit 3.

In other applications, FIG. 39, the printer subsystem 2 may be connected to work station controller 8, which in turn is remotely connected to a host computer system 1 by a communications network—such as Systems Network Architecture/Synchronous Data Link Control (SNA/SDLC). In such applications, information (data) to be printed and printer formatting commands are transferred from the computer system 1 to the work station controller 8. The work station controller 8 then generates the operational commands and transfers all this information to the printer subsystem 2. Responses from the printer subsystem 2 are sent to the work station controller 8 then to the computer system 1 by the communications network.

Cable Through Connector

Figure 40:
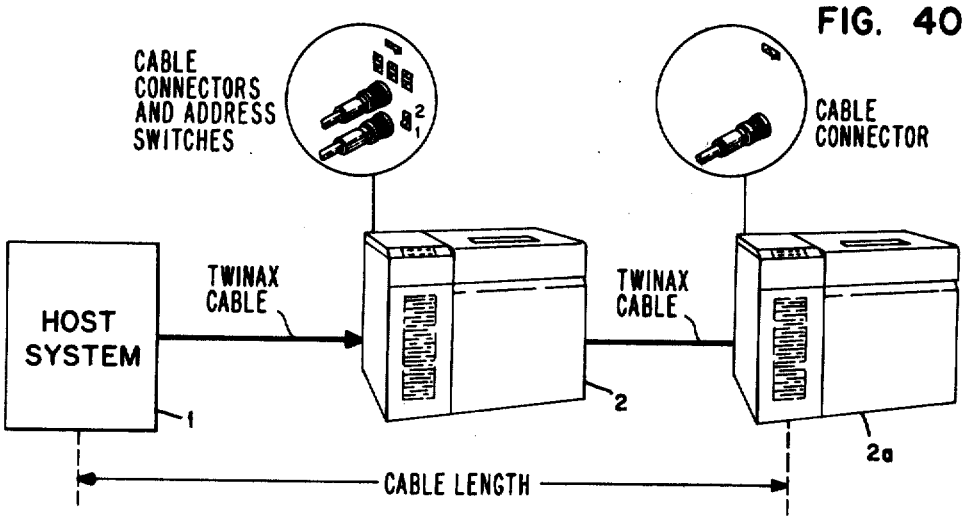

The Cable Through Connector feature, FIG. 40, connects multiple printers subsystems 2, **2*a* or other work station units on the same interface cable line to the host system 1 or controller not shown in FIG. 40**.

Units with this feature have address-setting switches and an additional cable connector. The customer assigns a unique address to each unit on the cable connector line and sets the address switches at installation time. The feature is not needed on the last unit on the line. The number of units that can be connected to the same line depends on the capability of the controlling device.

With this feature, the maximum cable length restriction is from the controlling device to the last unit on the line.

Audible Alarm

An audible alarm can be provided to produce a tone that alerts the operator to conditions that require operator attention.

Interface Cable

The interface cable may be either coaxial or twinaxial. Representative maximum cable lengths from the controller to the last device on the interface are:

Coaxial cable—610 m (2000 ft.)

Twinaxial cable —1525 m (5000 ft.)

The type of cable selected depends on the requirements of the controlling device to which the printer subsystem is attached.

Information Transfer

Data Stream

Figure 41:
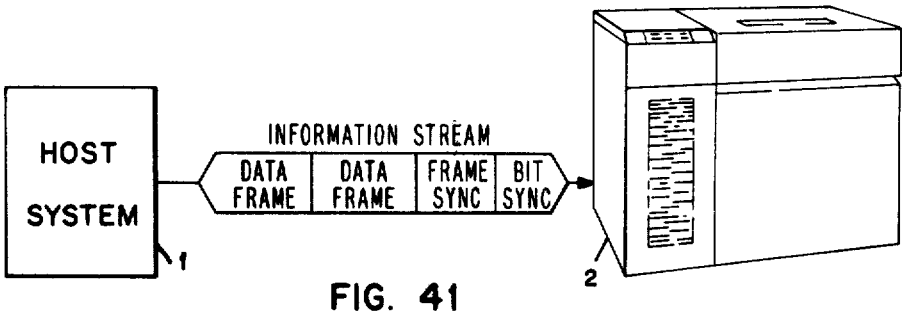
FIG. 41 illustrates a stream of information between the host system and the printer subsystem.

All information transferred between the controlling device, such as host system 1, FIG. 41, and the printer subsystem 2 is in the form of a serial "stream" of information bits, FIG. 41. Contained in this stream are:

Bit synchronization patterns

Frame synchronization patterns

Data frames

The bit and frame synchronization (sync) patterns establish timing control between the controlling device and the printer. The data frame is the unit of information used to transfer all commands, data to be printed, and status information.

The data stream can flow in either direction on the interface cable—but only in one direction at a time (half-duplex). The controlling device always initiates the data stream flow for either direction. Only one device on the interface can be communicating with the controlling device at a time.

The data stream flows on the interface for each transfer of single or multiple frames of information. The cable carries no signal between information transfers.

In a typical information transfer from controller to printer, the information stream may be a mixture of operational commands, formatting commands, and data to be printed. Blocks of up to 256 frames may be included in the information stream for a given transfer.

The information stream for any information transfer always begins with the bit-sync and frame-sync patterns, and ends with an end-of-message code in the last frame of the sequence. The end-of-message code causes turnaround on the cable, allowing status information to be transferred in the opposite direction on the cable on the next sequence.

Information Frame

Figure 42:
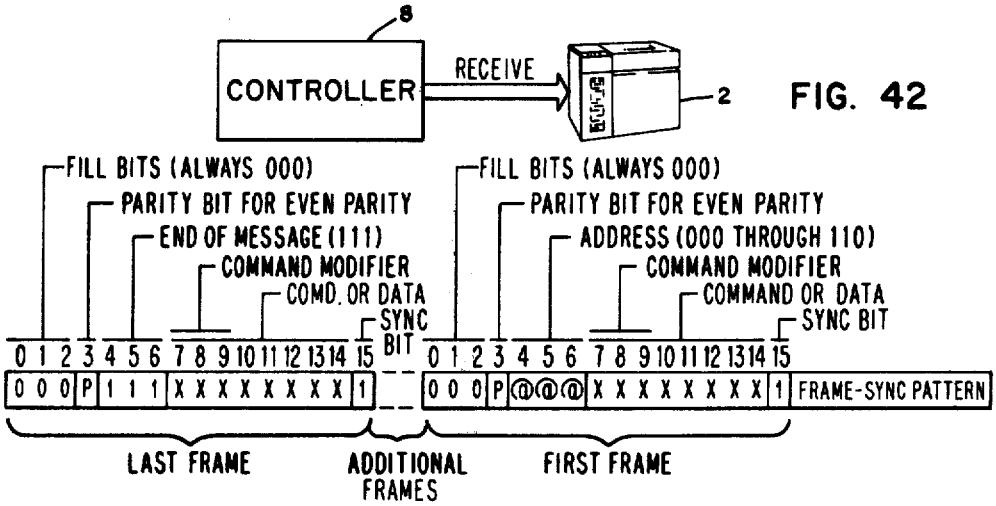
FIG. 42 illustrates significance of bits in the frames during a receive mode when information is transferred from the controller to the printer subsystem.
Figure 43:
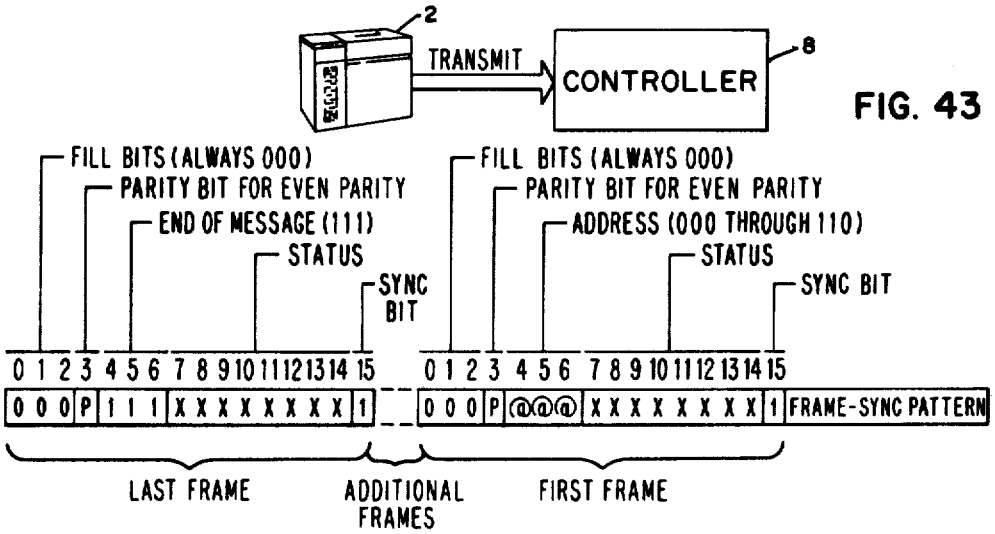
FIG. 43 illustrates bit significance for the frames during a transmit mode when information is transferred from the printer subsystem to the controller.

The basic unit of information transfer is a 16-bit information frame. The information frame is used for transferring all commands, data, and status information between the controlling device and the printer subsystem 2. A Receive mode from controller 8 to printer subsystem 2 is illustrated in FIG. 42 and a Transmit mode from printer subsystem 2 to controller 8 is illustrated in FIG. 43.

The 16 bits of the information frame are assigned the following significance: Bits 0 through 2, the fill bits, always 000, are for timing control. Bit 3, the parity bit, is set to maintain an even bit count (even parity) in each frame.

Bits, 4, 5, and 6 are the address bits for selecting a specific printer (or other work station unit) attached to the interface. Up to seven units can be addressed by combinations of these bits (000 through 110 are valid addresses). A bit combination of 111 indicates an end-of-message and causes line turnaround.

Bits 7 through 14 are for commands, data or status information. Bit 15, always on, is a synchronization bit.

Printer Addressing

Printer addresses are coded in bits 4, 5, and 6 of the information frame, FIG. 44. The address for a single printer on the interface cable is 000. With the Cable Connector feature, addresses can range from 000 through 110. Addresses of printers attached with the Cable Connector feature are set by the customer. A bit combination of 111 is used as an end-of-message indicator in the last frame of a transfer sequence and, therefore, cannot be used as a valid address.

The first frame following any signal turnaround on the cable is a command frame containing a valid printer address (000 through 110) for selecting a specific printer on the interface cable. Each successive frame following a command frame is then checked for the end-of-message code (111).

All response frames from the printer to the controlling device, except the end-of-message frame, contain the address of the selected printer.

Printer Responses

All information transfers between the controlling device and the printer are initiated from the controlling device by command frames. The printer, however, does transfer information to the controller 8 on request. These transfers are called printer "responses".

In general, printer response frames are requested by the controller 8 to determine the readiness (or "status") of a printer for accepting data from the controller 8. A variety of printer operational and error conditions are reported to the controller 8 by means of printer response frames. These conditions are described in detail in the section below entitled "Status and Error Information".

Printer Control Unit

The printer control unit 3 (See FIGS. 1 and 35, as examples) connects the printer to the interface cable from the controlling device, controls the flow of information to and from the controlling device and controls all internal printer functions.

When data is received for printing, the printer control unit 3 formats the data into print lines, using formatting commands (control codes) embedded in the data stream. Two print-line text buffers indicated in FIG. 56 are used so one line can be printed while the next line is being formatted. This comprises a "lookahead" function which allows bidirectional printing for maximum throughput.

Information Codes

All 256 8-bit codes of the Extended Binary Coded Decimal Interchange Code (EBCDIC) are recognized by the printer control unit 3. In a data stream hexadecimal codes of 00 through 3F represent formatting commands, 40 through FE represent data (FF is always a blank character.)

All of these codes may be used to represent characters.

Operational Commands

Figure 47A:
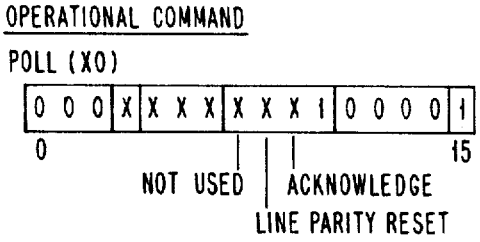
FIGS. 47A and 47B illustrate representative operational and formatting commands.

Operational commands, listed in Table I below, determine the printer function to be performed, such as Write Data, Read Status, etc. Also, see FIGS. 45 and 47A. FIG. 47A illustrates a representative operational command: "Poll." Some operational commands require an additional command or data frame. In these cases, the next frame transmitted must contain that command or data frame. Operational commands are embedded in the data stream wherever required for proper control of the printer.

Operational Command Sequence

The diagram in FIG. 46 illustrates a representative sequence of events between a controlling unit and the printer subsystem 2 to effect printing of data.

TABLE I

OPERATIONAL COMMAND SUMMARY

| Command Name | Hex Code* | Function |
|---|---|---|
| Poll | X0 | Poll causes a one-frame status response from the printer until a Set Mode command is issued; thereafter, Poll initiates a two-frame status response. Bit 8 set to 1 resets line parity error indication. Bit 9 notifies the printer to send current status frames. |
| Read Device ID | 0C | Initiates the transfer of the ID (Identifier) frame from the printer to the controlling device. Must be followed by an Activate Read command. |
| Read Status | 88 | Initiates the transfer of one frame of outstanding status from the printer. Must be followed by an Activate Read Command. |
| Activate Read | 00 | Required to complete Read Device ID or Read Status operations. This command signals the hardware that data is to start a transfer and is not placed in the command queue. |
| Write Data | 1E | Causes the printer to store all data frames after the Activate Write. |
| Activate Write | 01 | Causes printing of data frames that follow this command. This command signals the hardware that data is to start a transfer. This is not placed in the command queue. |
| Write Control Data | 05 | Resets exception or outstanding status. |
| Set Mode | 13 | Must be issued before the printer accepts any other command except Poll and Reset. Followed by a data frame that defines the interval between frames. |
| Reset | 02 | Resets printer to a power-on reset condition. |
| Clear | 12 | Clears all print data buffers. |
| End-of-Queue (EOQ) | 62 | Marks end of command queue loading |

*Bits 7 through 14 of a data frame

Formatting Commands

Formatting Command Function

Figure 47B:
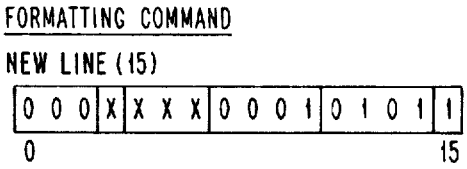

Formatting commands, shown in Table II below, control forms movement and line length. They are embedded in the information stream that follows the Write Data command, FIG. 45. Also, See FIG. 47B, which illustrates a representative formatting command: "New Line."

Some formatting commands require more than one frame. A code in the first frame identifies multiple frame commands. In some cases the code in the second or third frame further defines the total number of frames to be used. The formatting command codes are also referred to as "standard character string" (SCS) codes. SCS is an SNA control-character subset.

TABLE II

FORMATTING COMMAND SUMMARY

| Command Name and Abbreviation | Frame Sequence (Hex Code/Parameter) 1 | 2 | 3 | 4 | 5 | 6 | Description |
|---|---|---|---|---|---|---|---|
| Null (NUL) | 00 | | | | | | No Operation performed. |
| Carriage Return | 0D | | | | | | Moves the print position to the first position of the current line. |
| New Line | 15 | | | | | | Moves the print position to the first position of the next line. |
| Interchange Record Separator (IRS) | 1E | | | | | | Same as New Line. |
| Line Feed (LF) | 25 | | | | | | Moves the print position to the same horizontal position of the |

TABLE II-continued

| Command Name and Abbreviation | FORMATTING COMMAND SUMMARY Frame Sequence (Hex Code/Parameter) 1 | 2 | 3 | 4 | 5 | 6 | Description |
|---|---|---|---|---|---|---|---|
| | | | | | | | next line. |
| Form Feed (FF) | 0C | | | | | | Moves the print position to the first position of the next page. |
| Bell (BEL) | 2F | | | | | | Turns off Ready, turns on Attention and the audible alarm, and stops printing. |
| Absolute Horizontal Position (AH) | 34 | C0 | NN | | | | Moves the print position to the horizontal position specified in the parameter frame. The parameter frame NN immediately follows the AH command. |
| Absolute Vertical Position (AV) | 34 | C4 | NN | | | | Moves the print position specified in the parameter frame. The parameter frame NN immediately follows the AV command. |
| Relative Horizontal Print Position (RH) | 34 | C8 | NN | | | | Moves the print position horizontally towards the end of the line from the current print position the number of columns specified in the parameter frame. The parameter frame NN immediately follows the RH command frame. |
| Relative Vertical Print Position (RV) | 34 | 4C | NN | | | | Moves the print position vertically towards the bottom of the page from the current print position the number of lines specified in the parameter frame. The parameter frame NN immediately follows the RV command frame. |
| Set Horizontal Format (SHF) | 2B | C1 | NN | HH | | | Sets the print line length to the value specified in the parameter frames. The parameter frames NN and HH immediately follow the C1 command frame. |
| Set Vertical Format (SVF) | 2B | C2 | NN | VV | | | Sets the page length to the value specified in the parameter frames. The parameter frames NN and VV immediately follow the C2 command frame. |
| Set Graphic | 2B | C8 | NN | GG | UU | | Sets the unprintable character |

TABLE II-continued

| Command Name and Abbreviation | FORMATTING COMMAND SUMMARY Frame Sequence (Hex Code/Parameter) 1 | 2 | 3 | 4 | 5 | 6 | Description |
|---|---|---|---|---|---|---|---|
| Error Action (SGEA) | | | | | | | option and defines the default graphic that is specified in the parameter frames. The parameter frames NN, GG, and UU immediately follow the C8 command frame. |
| Transparent (TRN) | 35 | NN | | | | | Permits the codes normally used as control characters to be used as printable characters. The parameter frame NN specifies the number of frames that follows the 35 command frame. |
| Subscript (SBS) Not available for single direction paper feed. | 38 | | | | | | Line feeds 1.41 mm (4/72 in) to print subscript characters. |
| Superscript (SBS) Not available for single direction paper feed. | 09 | | | | | | Reverse line feeds down 1.41 mm (4/72 in.) to print superscript characters. |
| Set Character Distance (SCD) | 2B | D2 | 04 | 29 | P1 | P2 | Sets the characacter density to 10 or 15 cpi as specified in the P1 and P2 parameter frames. |
| Set Baseline Increment (SBI) Not available for single direction paper feed. | 2B | D2 | 04 | 15 | P1 | P2 | Sets the depth of one line of print to .176 mm (1/144 in.). |
| Set CGCS through Local ID (SCL) CGCS—Coded Graphic Character Set | 2B | D1 | 03 | 81 | P1 | | Loads 1 of 16 graphic characacter sets specified in the P1 parameter frame. |
| Absolute Move Baseline (AMB) Not available for single direction paper feed | 2B | D3 | 04 | D2 | P1 | P2 | Moves the print position forward in the vertical direction from the current print position to the new print position specified in the P1 and P2 parameter frames. |
| Relative Move Baseline (RMB) Not available for single direction paper feed. | 2B | D3 | 04 | D4 | P1 | P2 | Moves the print position forward or backward in the vertical direction from the current print position to the new print position specified in the P1 and P2 parameter frames. |
| Load Alternate | 2B | FE | NN | MM | | | Data allows customer designed |

TABLE II-continued

| Command Name and Abbreviation | FORMATTING COMMAND SUMMARY Frame Sequence (Hex Code/Parameter) 1 | 2 | 3 | 4 | 5 | 6 | Description |
|---|---|---|---|---|---|---|---|
| Characters (LAC) | | | | | | | fonts or characters to be loaded for printing. |
| Set Line Density (SLD) | 2B | C6 | NN | P1 | | | Selects vertical line density of 6 or 8 lines per inch or any distance in multiples of 1/72 inch up to 255. |

Status and Error Information

Poll Response Frames

Figure 48:
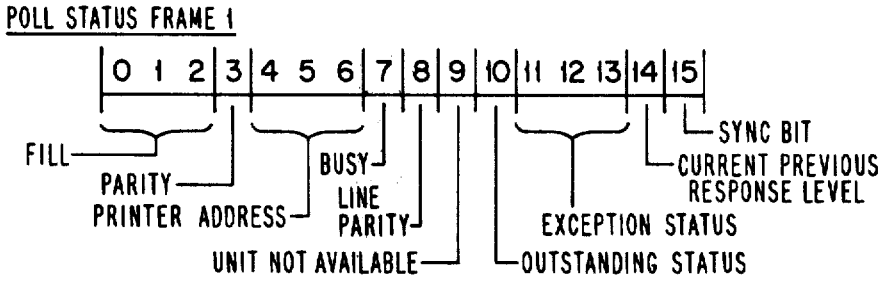
FIGS. 48 and 49 illustrate frame layout for status reports during a Poll operation.

Following a power-on reset (POR), the printer subsystem 2 responds to controller polling with a single status frame, FIG. 48. The printer continues to respond to controller polling with a single status frame until the printer receives a Set Mode command.

Figure 49:
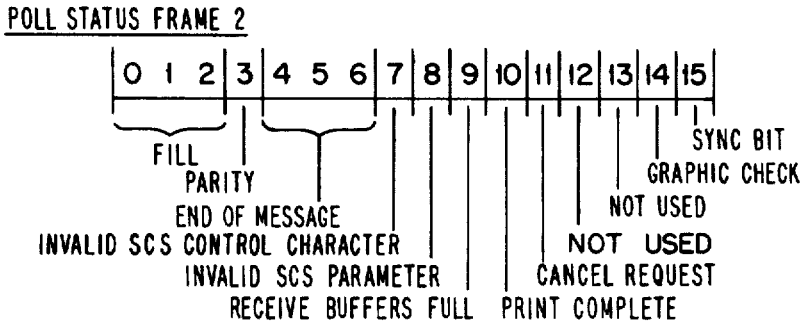

After receiving a Set Mode command, the printer responds to polling with two status frames, the second of which is shown in FIG. 49.

Status information described in frame 1, FIG. 48, is the same in either case.

Bits 0, 1, 2—Fill

These bits are always set to 000 and are used for timing control.

Bit 3—Parity

This bit is used to maintain an even bit count (even parity).

Bits 4, 5, 6—Printer address

These bits are used for selecting a specific printer attached to the interface. Up to seven printers can be addressed by the combinations (000 through 110). A bit combination of 111 indicates an end-of-message and causes line turnaround.

Bit 7—Busy

0=Not busy when operational command queue is empty.
1=Busy when operational command queue is not empty or an activate command is received.

Bit 8—Line parity

0=No line parity error is detected in a received frame.
1=Line parity error is detected in a received frame.

Bit 9—Unit not available

0=Unit available (the Ready light is on).
1=Unit not available.

Bit 10—Outstanding status.

0=No outstanding status.
1=Outstanding status (available by using the Read status command).

Bits 11, 12, and 13 indicate a variety of exception status conditions. Until the exception status is reset, only Poll, Set Mode, and Reset commands are processed. The Write Control Data Command (if the exception status is not power-on transition) is also processed. The power-on transition exception status is reset by the Set Mode command. The exception status conditions are reset by the Write Control command (see "Write Control Data").

| Bit 11 | Bit 12 | Bit 13 | Meaning |
|---|---|---|---|
| 0 | 0 | 0 | No exception status exists. |
| 0 | 0 | 0 | Activate lost - caused by a line parity error following a Write Data, Read Status, or Read Device ID. |
| 0 | 1 | 0 | Invalid activate command - caused when a Write Activate follows a Read Status or Read Device ID or, a Read Activate following a Write Data. |
| 0 | 1 | 1 | Reserved. |
| 1 | 0 | 0 | Invalid command - caused when a command is outside the operational command set or more than 240 microsecond interframe interval has been specified. |
| 1 | 0 | 1 | Input queue or input buffer overrun - caused when more than 16 commands and associated data frames or more than 256 data frames have been sent. |
| 1 | 1 | 1 | Power-on transition-causes only status frame 1 to be sent in response to a Poll command. |

Bit 14—Current/Previous response level

When bit 14 goes from 0 to 1 or 1 to 0, the using system determines that the response frame is current status. When bit 14 is unchanged from the previous response, the using system determines that the response frame is previous status. Any change in the response frame changes bit 14 from its previous state. Bit 14 is set to 0 after power-on.

Bit 15—Sync.

A synchronization bit that is always set to 1. Frame 2 contains information shown in FIG. 49.

Bit 0 through 6

Same as Poll status frame 1.

Bit 7—Invalid SCS (standard character string control

0=No Invalid SCS Control Code is detected.
1=Invalid SCS Control Code is detected.
Reset by a Reset or Clear command.

Bit 8—Invalid SCS (standard character string) parameter

0=No Invalid SCS parameter is detected.

1=Invalid SCS parameter is detected.
Reset by a Reset or Clear command.

Bit 9—Receive buffers full

Used by the using system to determine when data can be sent to the printer.
0=Receive buffers are not full.
1=Receive buffers are full.

Bit 10—Print complete

The print complete bit is set to 0 when the printer detects an Active Write command. The print complete bit is set to 1 by Power-on reset, a Clear command, a Reset command, or when all input data is printed.
0=Printing is in progress.
1=Printing is completed.

Bit 11—Cancel Request

The Cancel request bit is set to 1 when the operator presses the Cancel key on the Operator Panel. This bit is reset by the next Poll command (with Acknowledge bit set to 1), a Reset or Power-On reset.
0=No cancel request.
1=Cancel request.

Bit 12—Not used

Bit 13—Not used

Bit 14—Graphic check

This bit set to 1 indicates that an undefined character has been detected in the data stream. This bit is reset by the next Poll command (with Acknowledge bit set to 1), a Reset or Power-On reset.
0=No graphic error is detected.
1=Graphic error is detected.

Bit 15—Same as Poll status frame 1

Read Status Response Frame

One response frame is sent for every Read Status command. The response frame, sent only after the Activate Read command is received, contains a hex code that defines the status condition within the printer.

The hex code corresponds to the last two digits of the error code that may be available as a system error message (depending on the using system). The first digits of these hex codes are also automatically displayed on the printer operator panel 26 when the error occurs.

The defined conditions are:

| Hex Code | Error Condition |
|---|---|
| 11 | Printer controller error |
| 12 | Cable adapter error |
| 31 | Head drive problem |
| 32 | Margin emitter not detected |
| 34 | Turnaround emitter not detected |
| 35 | Print emitter not detected |
| 36 | Head busy (cannot be reset) |
| 37 | Printer control unit |
| 38 | Overcurrent |
| 41 | Forms drive problem (undetermined area) |
| 42 | Forms busy (cannot be reset) |
| 43 | Forms emitter B not detected |
| 44 | Forms emitter A not detected |
| 45 | Run latch failure (printer control unit) |
| 46 | Printer control unit |
| 47 | Overcurrent |
| 48 | Emitter sequence wrong |
| 80 | Ribbon jam |
| 81 | Ribbon jam (diagnostic mode) |

-continued

| Hex Code | Error Condition |
|---|---|
| 82 | Ribbon problem |
| 83 | Head Image Generator error |

Printer General Block Diagram

Figure 50:
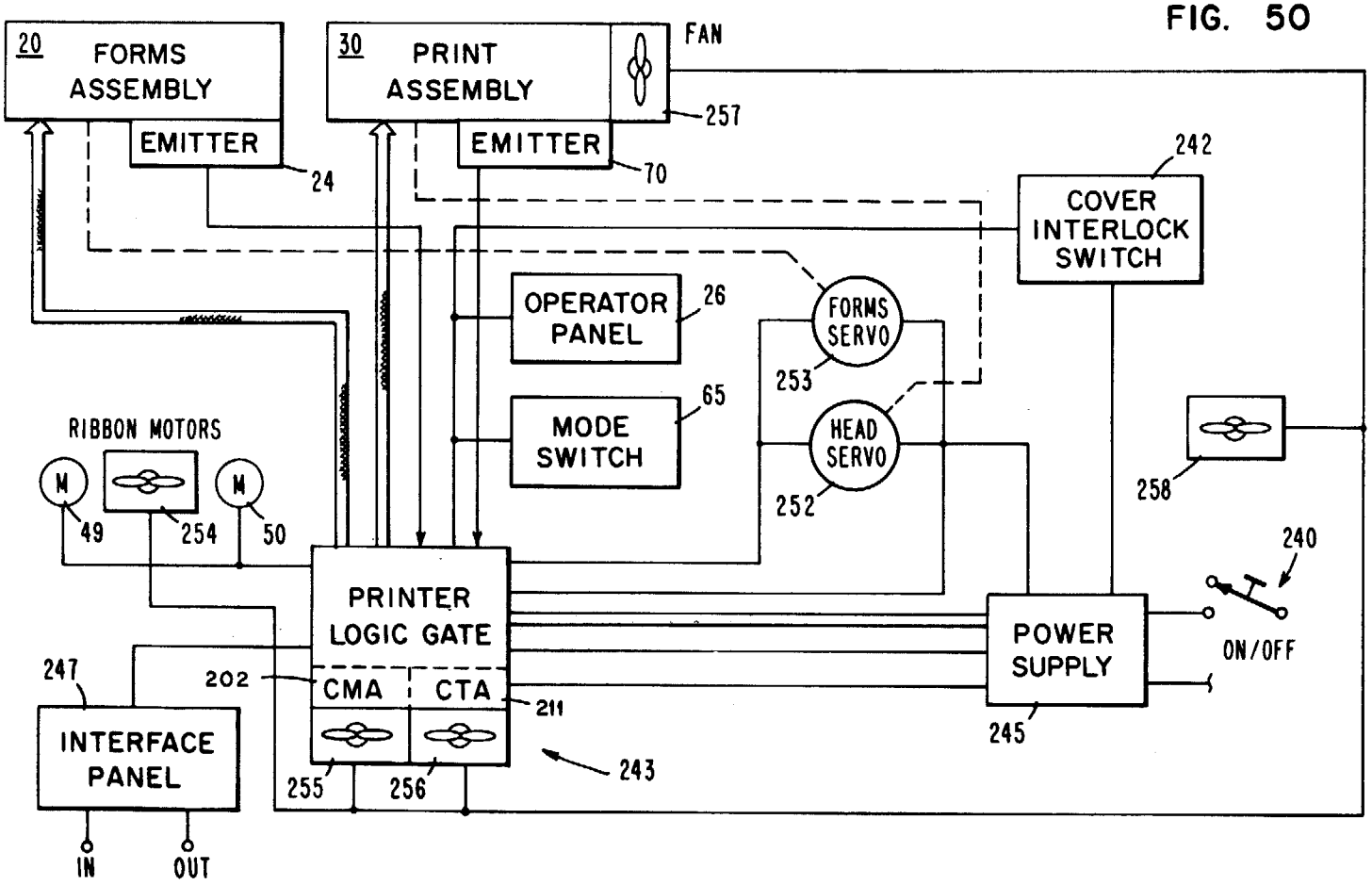
FIG. 50 is a block diagram of various circuit components used in the printer subsystem of FIGS. 1 and 2.

FIG. 50 illustrates various printer blocks of interest. A power supply 245 supplies the unit with all the power to drive and to control. The on/off switch 240 controls power supply 245 being on and off. From the power supply 245 the cover interlock switch 242 enables and disables the 48-volt drive which controls much of the printer logic 243. Logic 243, once enabled, looks at operator panel 26 for information as to the operations to be performed. Mode switch 65 tells the logic 243 which type of operation in testing procedures should be run. Print assembly 30 is controlled by the printer logic 243 along with the forms feed assembly 20. Emitter devices 24 and 70 supply positional information to the printer logic 243. The printer logic 243 also controls and talks with the interface panel 247 and passes information on the other parts of the printer. The ribbon motors 49 and 50 are controlled in an on/off fashion by printer logic 243 which accepts inputs from the ribbon drive assembly 40 to determine when the end of ribbon 41 has occurred. Head servo 252 is a control block that insures that the print head 34 is in the proper position at the proper time for the actuators 35 to fire. Forms servo 253 is a control block that moves the forms 15 to desired locations. Fans 254–258 are used to control temperature within the machine. As indicated in connection with FIG. 35, printer logic 243 includes two microprocessor adapter blocks 202 and 211. The first one included is the Communications adapter CMA 202 which accepts input and passes it to the second one which is the Control adapter CTA 211 that actually controls the printer. These will be discussed in connection with FIGS. 51A and 51B.

Microprocessor Control—Printer Subsystem

Figure 51A:
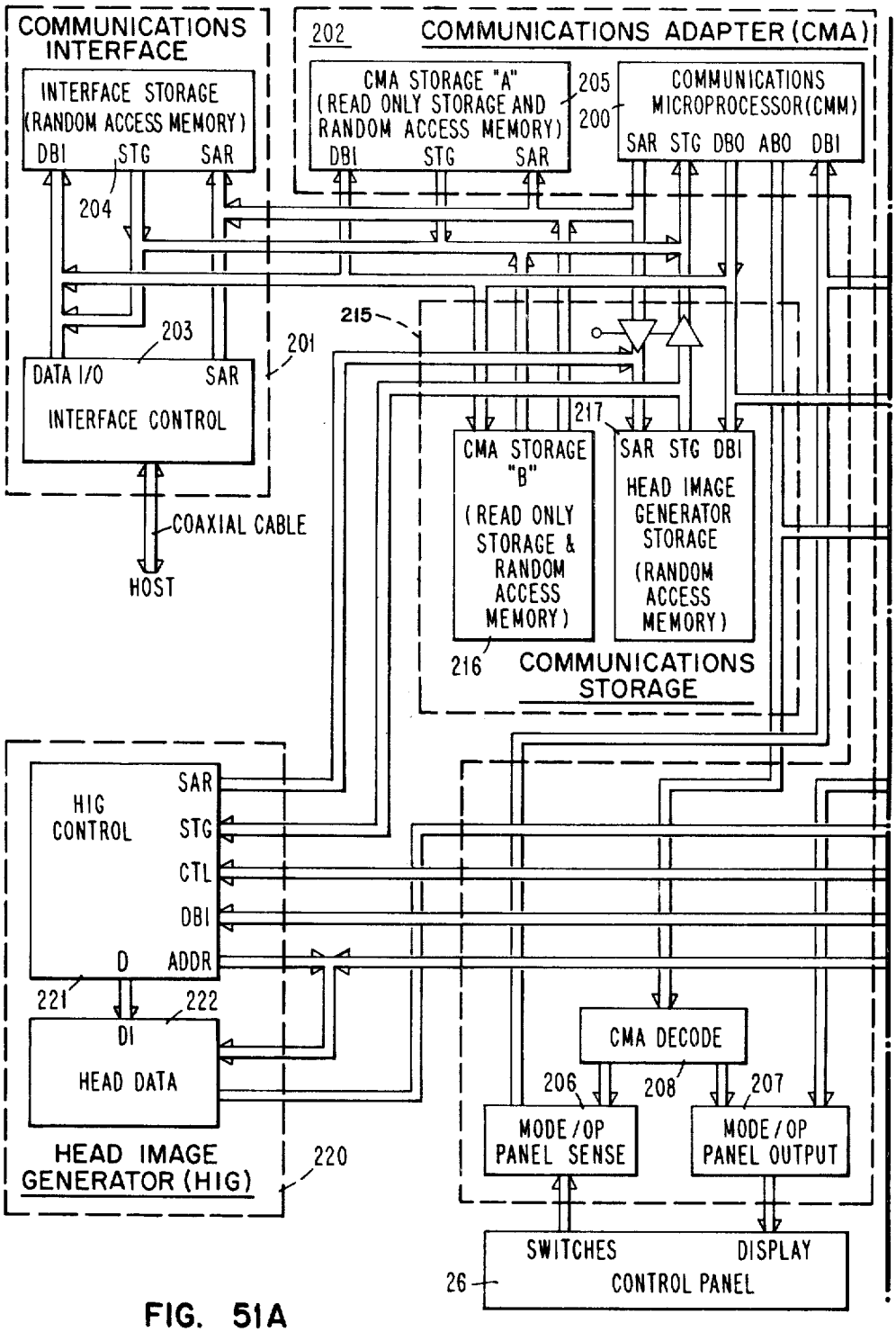
FIGS. 51A and 51B, when arranged as shown in FIG. 52, comprise a block diagram of the printer control unit including a Communications microprocessor (CMM) and a Control microprocessor (CTM) as well as a number of elements in the printer unit.
Figures 51B, 52:
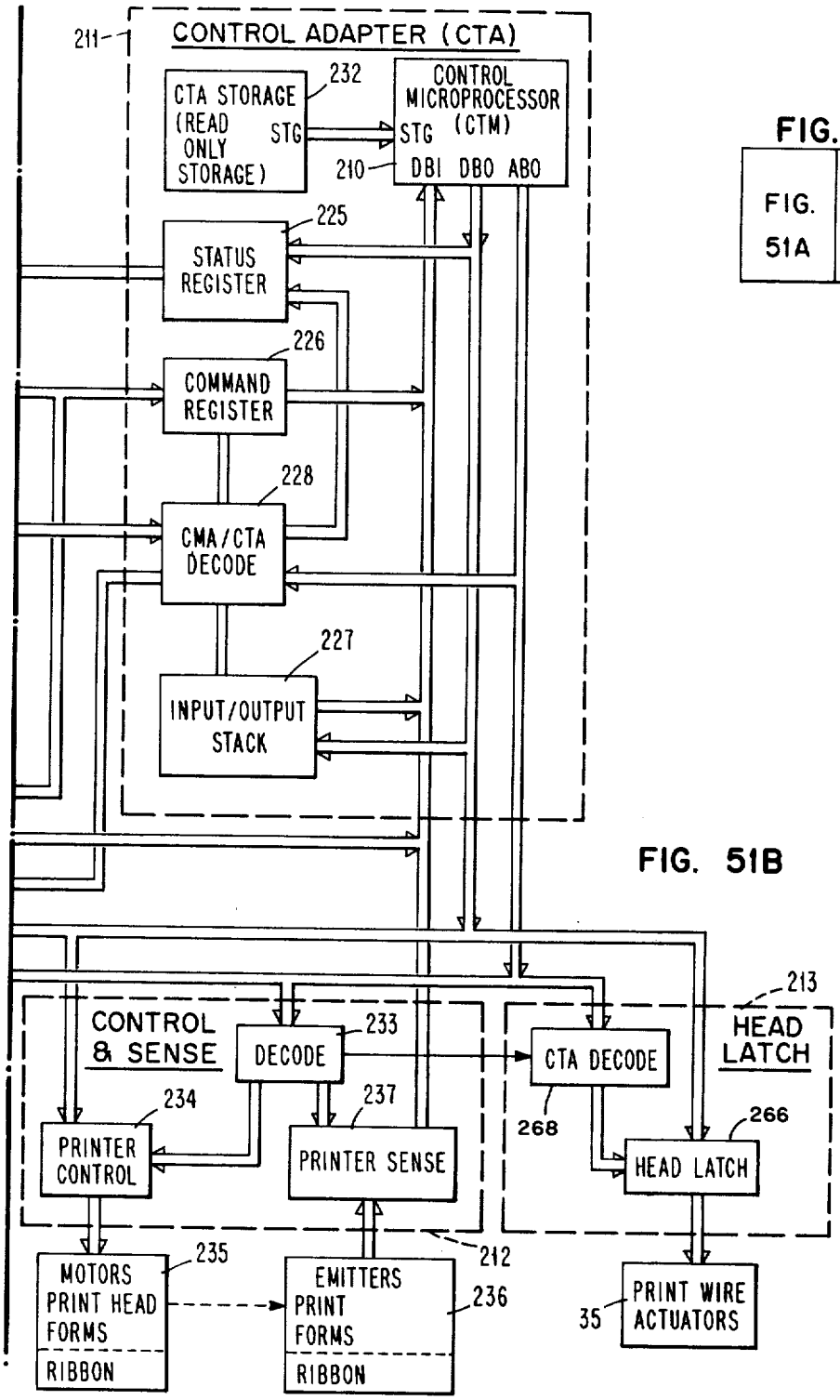

Two microprocessors 200 and 210 are provided for the printer subsystem 2, each having its assigned functions and both can operate concurrently to accomplish the required functions. FIGS. 51A and 51B join together as shown in FIG. 52 to illustrate the details of the Printer Control Unit 3 and Electronics 4, FIG. 1. Various abbreviations used herein are listed in Table III below:

TABLE III

| | | |
|---|---|---|
| ABO | — | Address Bus Out |
| CMA | — | Communications Adapter Card |
| CTA | — | Control Adapter Card |
| CTL | — | Control |
| D | — | Data |
| DI | — | Data In |
| DBI | — | Data Bus In |
| DBO | — | Data Bus Out |
| HIG | — | Head Image Generator |
| MODE/OP | — | Mode/Operation |
| ROS | — | Read Only Storage |
| SAR | — | Storage Address Register |
| STG | — | Storage Bus In |

There are actually seven main blocks comprising the Printer Control Unit 3 representing seven printed circuit cards. The first block is the Communications Interface 201 between the host system 1 and digital printer electronics 4. Interface 201 communicates with the Communications Adapter (CMA) 202 which is a microprocessor card that takes the host information and compiles it into a form that can be used by the rest of the printer. The CMA 202 includes Communications microprocessor CMM 200. From there, the information is passed on to the Head Image Generator 220 card for building images for the printer. There is another micropocessor card that is the Control Adapter Card (CTA) 211. The CTA 211 includes Control microprocessor CTM 210. The Control Adapter 211 handles the processed information from the Communications Adapter 202, controls all the mechanical elements of the printer, such as the motors 23, 76, and receives emitter signals indicating positions of the mechanical elements. Adapter 211 handles communication with the actual hardware through the Control and Sense card 212 and the Head Latch card 213 that stores the data to be outputted to the wire actuators 35.

Within the Communications Interface 201 are two blocks. One is the Interface Control block 203; the other is the Interface Storage block 204. The Interface Control block 203 interprets the information coming from the host system 1 in an analog signal form, processes it into digital form, and generates the necessary timing signals to be able to store this information in the Interface Storage 204. The Interface Storage 204 is a Functional Storage Unit (FSU) random access memory which is sized at one K (1 K) bytes. All data and commands from the host system 1 go into this Interface Storage 204; it acts as a buffer for the Communications Adapter 202. Within the Communications Adapter card 202, there are five blocks. There is the Communications microprocessor 200 (CMM) and its corresponding storage 205 designated "A" which includes both random access memory and read only storage (ROS). There is a Mode/Op Panel and Sense block 206 that can read the panel 26, a Mode Op Panel Output block 207 to output displays to the panel 26, and Decode Logic 208 for these functions. The Communications Adapter 202 translates the information that the host system 1 has sent over through high-level or hand-shaking type procecedures and translates it into much more simple terms such as characters to be printed or carriage returns, or line feeds—any other mechanical type control that needs to be performed. Its program is stored in the Read Only Storage (ROS) of the CMA "A" storage 205. There are 6 K bytes in this ROS. The CMA 202 also handles Hardware Operator commands involving printing the printer online, taking it off-line and displaying any type of status information through the display 59 on the Mode Operator Panel 26.

The Communications Storage 215 has two blocks entitled CMA Storage "B" designated 216 and Head Image Generator (HIG) Storage 217. Storage "B" block 216 contains up to 14 K bytes of ROS storage in FSU technology for the Communications Adapter microprocessor 200. The random access memory storage 217 has 3 K bytes for the Head Image Generator 220 and is where the Communications microprocessor 200 stores character images to be printed. The character images in storage 217 are used by the Head Image Generator 220 to generate actual images for the slanted heads 34. Also, in the block of Random Access Memory 217 are two text buffers and some scratch pad storage indicated in FIG. 56.

Because of the staggered slant geometry of the print heads 34 and the multiple head configuration, a fairly complex Head Image Generator 220 (HIG) is required to convert conventional character dot format to a slanted format. HIG 220 processes the character images as they would normally appear in a "straight-up" format, but slants them for the Head Latch block 213 to supply to the print wire actuators 35. This is done through hardware routines that are performed in the Head Image Generator 220. There are basically two blocks 221, 222 in the Head Image Generator 220, one block being the Control block 221 that actually performs the hardware routines to take the unslanted image and slant it. There is also a Data block 222 that is a small storage unit in which the Head Image Generator 220 stores the slanted information currently being worked on. The Control Adapter 211 can then read this storage 222 and output to the print wire actuators 35 through Head Latch 213. This is the slanted data.

The Control Adapter (CTA) 211 has six blocks within it. The Control microprocessor (CTM) 210 receives inputs from various sensors, e.g., ribbon reverse/jam, forms jam, head position, linear encoder, forms position encoder, as well as print commands and data from CMM 200 and HIG 220 and generates print wire firing signals and various control signals to control the forms feed assembly 20, print assembly 30 print wire actuators 35, and ribbon drive assembly 40. The Control microprocessor (CTM) 210 has a ROS storage 232 that is 12 K bytes of FSU ROS to contain its programs or routines. Certain communication registers including Status register 225 and Command register 226 allow the Communications Adapter 202 and the Control Adapter 211 to communicate with one another. Through these registers 225, 226 go commands such as Print commands, Forms commands, Carriage Returns, and the actual decoded messages that the host system 1 has sent over. An Input/Output stack 227 is used as a local storage, that is, it is a small random access memory for the Control Adapter 211 to store intermediate data and there is some associated decoding. The Decode block 228 handles the timing relationships for the Communications Adapter 202 and Control Adapter 211 to be able to talk to one another asynchronously.

The Control and Sense card 212 handles the information from the Control Adapter card 211 and interfaces with the actual printer electronics 4 to control by way of Decode block 233 and Printer Control block 234 the head motor 76, the forms motor 23, and the ribbon motors 49 and 50 represented by block 235. Through blocks 236 and 237 it senses the positional state of printer electronics 4 and mechanics such as the print emitters, forms emitters, etc.

The Head Latch card 213 is another interface card from the Control Adapter 211 that latches up the wire image data, the slanted data that is received from the Head Image Generator 220, and outputs it at the correct time to the print wire actuators 35 so that the dots get printed in the correct place on the form 15. It includes the CTA Decode block 268 and Head Latch block 266.

A typical print operation is now described. It is assumed that a single print line is provided by the host system 1 with a Forms Feed and Carriage Return at the end which is a typical situation. This information comes over in a serial stream from the host system 1 as analog signals into the Communications Interface 201 which digitizes the analog signal and stores it in its Interface Storage 204 in the form of characters to be printed. A command informs the Communications Adapter 202 that this is a line to be printed and that it has Line Feed and Carriage Return commands. The Communications Adapter 202 seeing this information appear, will take the characters to be printed out of the Interface Storage 204 and put them into a selected text buffer (FIG. 56) in CMA Storage "B" 216 on Communications Storage card 215. It then tells the Control Adapter 211 that it has information in a text buffer to be printed.

The Control Adapter 211, after receiving the information initially tells the Head Image Generator 220 (HIG) that there is data in the selected text buffer that needs to be slanted. Head Image Generator 220 then slants this information, while the Control Adapter card 211 starts the printer in motion; that is, it starts moving the print head carrier 31. It moves the carrier 31 through commands given to the Control and Sense card 212, and it looks for print emitter signals, or emitter signals which tell the Control Adapter 211 when to fire wires 33; it checks for these signals coming from the Control and Sense card 212. When these signals appear, the CTM 210 retrieves the slanted wire information from the HIG 220 and passes it to the Head Latch card 213 and fires the wires 33 to print dots. The Control Adapter 211 for each print emitter that it sees, asks the Head Image Generator 220 for a new set of slanted data. This is outputted to the Head Latch card 213 and is repeated until the entire text buffer has been printed, that is, all the information that the host system 1 sent over. Once the Communications Adapter 202 has seen that this has taken place, that is, the printing has been done, it passes the Forms command to the Control Adapter 211. Control Adapter 211 decodes this command and gives a command to the Control and Sense card 212 to move forms 15 a certain number of forms emitters. It senses these forms emitters through the Control and Sense card 212 again.

Figure 53:
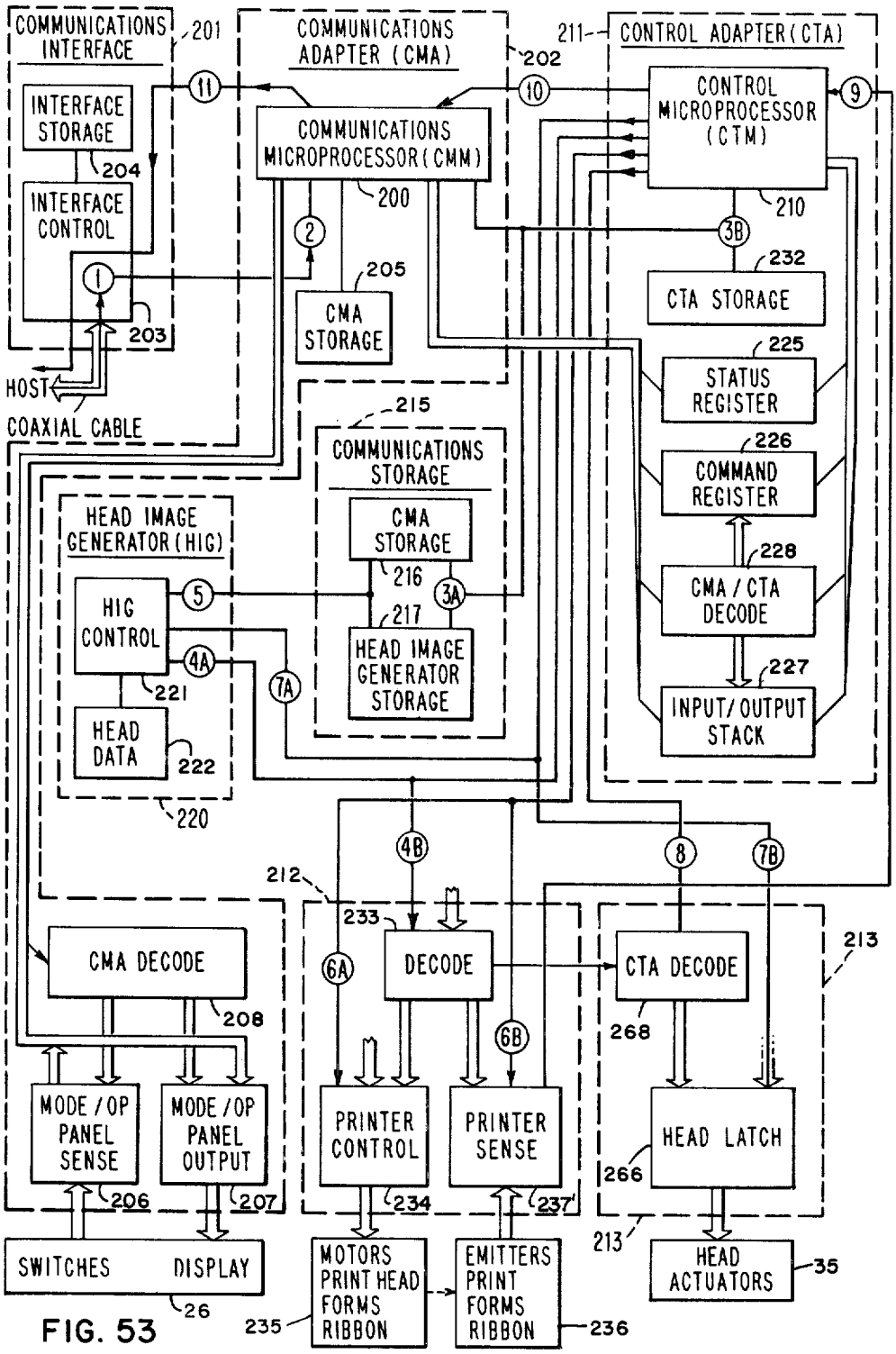
FIG. 53 illustrates a typical data transfer and printing operation in the printer subsystem.

This is further illustrated in FIG. 53. A typical operation is assumed to come from the host system 1 to the printer control unit 3. [Steps (paths) are illustrated by numbers in circles.] Path 1 represents receipt of the data and commands by interface 201. By path 2, the interface 201 prepares it and passes it on to the CMA 202. CMA 202, essentially in two operations, strips off printable characters and by the path labeled 3A transfers the characters to the text buffers in CMA Storage 216. Initially, font information is stored in HIG Storage 217. At the same time essentially by path 3B, the CMA 202 supplies print commands to the CTA 211 to start the operation. Next are two operations 4A and 4B. CTA 211 initiates operation 4A to HIG 220 which simply says there is data in the text buffer at a certain address, begin HIG operations. At the same time, the path 4B is effective to tell the Control and Sense card 212 to start any of a number of possible operations of the printer, such as: to move the heads 34 off the ramp, move the forms 15 as necessary, do not move the forms 15, move heads 34 to a certain absolute position or relative position, etc. Item 5 is a path from HIG 220, a flow from the HIG 220 to the storage blocks 216 and 217 which essentially fetches the data and the font information, that is the hexadecimal representation of the data that it is supposed to operate on to start its wire image generation. Path 6A represents verification by CTA 211 of electromechanical printer operations. This involves checking out the emitters, for example, timing out on the print emitters, etc. to determine that the printer is prepared to print and ready to fire reported back by path 6B.

Item 7 (two paths, 7A and 7B) represents fetching of data from the HIG 220 which is the head latch image that is transferred to the head latch card 213 and some checking is done on it at that point by the CTM 210.

Item 8 represents CTA 211 signalling the head latch block 213 to fire. This is a pedestal signal to fire the wires 33. Prior to that point, CTA 211 has to have received a print emitter at step 6B in order to issue the pedestal firing signal.

Step 9 represents a feedback signal from the Control and Sense Card 212 and from the head latch card 213 back to CTA 211. CTA 211 will recheck the Control and Sense Card 212 verifying that the operation was performed that was expected to be performed.

Step 10 is communications from the CTA 211 to the CMA 202 indicating that the operation that the CMA 202 initiated was accomplished without errors. If there were errors, CMA 202 will be so advised. CMA 202 then compiles status or error information and presents it at Step 11 to the Interface 201 as a poll response to the host system 1.

Communications Microprocessor (CMM) Operations

Figure 54:
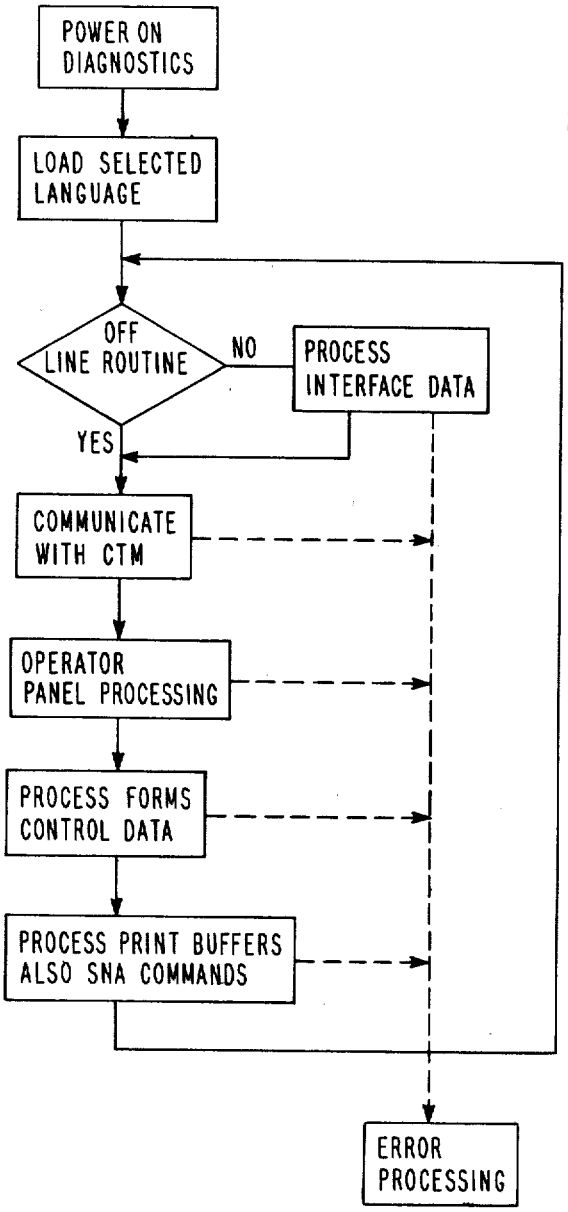
FIG. 54 is a generalized flowchart of the program routines for the Communications microprocessor (CMM) shown in FIG. 51A.

The Communications Microprocessor 200 (CMM) Flowchart, FIG. 54, represents its general operation and starts with the Power On Diagnostics being run. At the conclusion of the Power on Diagnostics, the selected language is loaded into a font portion of Memory 216, FIG. 51A for processing and printing. A decision is now made as to whether the Mode Switch 65 is in the off-line or on-line position. If it is in the on-line position, then the interface data is processed, or information coming from the host system 1 or going to the host system 1, is processed and prepared. If an off-line routine was indicated, then this process is skipped. In any case, the chart continues to the next block no matter which off-line routine is processed. This block represents communication with the Control microprocessor 210 (CTM). This allows the CMM 200 to receive any errors or information that needs to be passed to the host system 1 and it allows the CMM 200 to pass data and commands such as data to be printed, forms, spacing, etc. on to the CTM 210. Next, the Operator Panel 26 is accessed to determine whether the Start button 53, Stop button 52, or other buttons 51, 54, 55 or 60 have been depressed for entry of information from the Operator Panel 26. Next, the Process forms or Control data block is checked to determine the movement of forms 15 resulting from commands sent to the CTM 210. Next is to Process the text buffers which includes SNA commands or the off-line routines. The CMM 200 places them in the proper text buffer to be printed by the CTM 210 and directs the CTM 210 to pick this information up and place it on the paper as dots. All of these routines have a means of communicating with the error processing routine. At the end of the routine, the CMM 200 checks for on-line or off-line status and continues the process again.

Control Microprocessor (CTM) Operations

Figure 55:
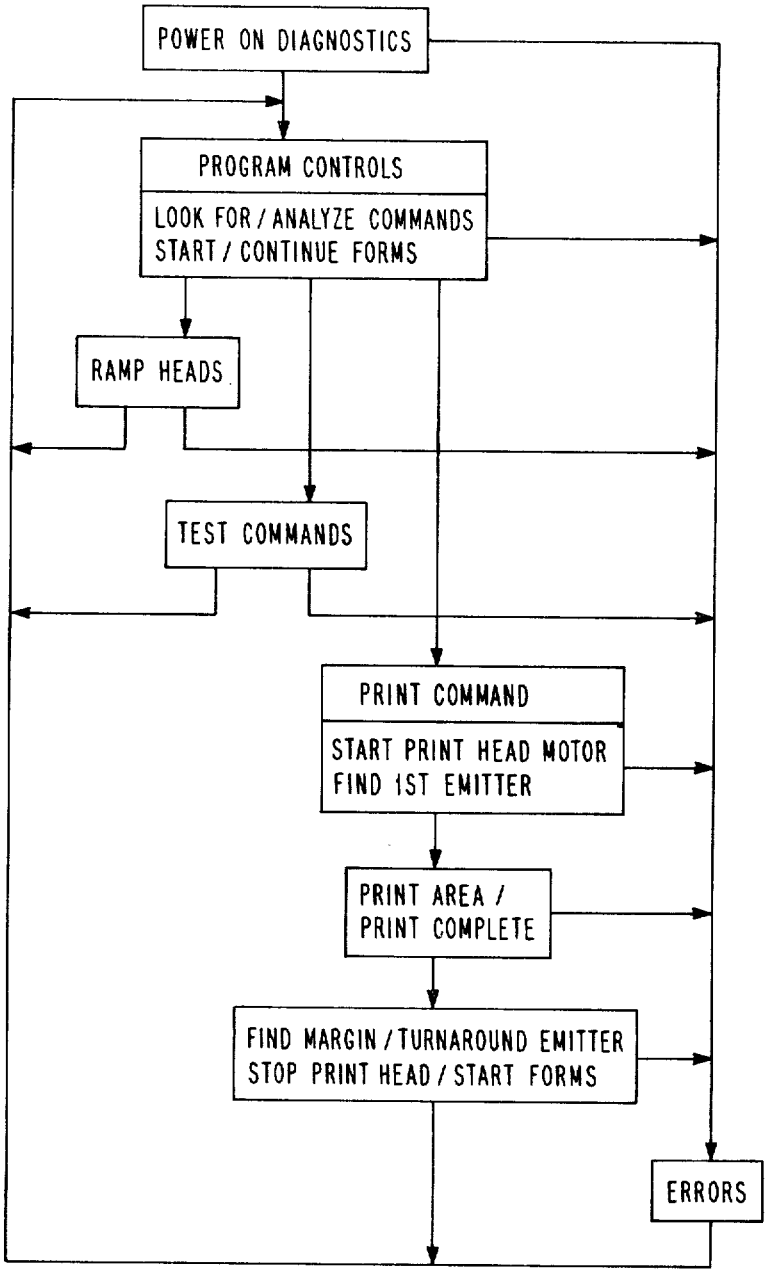
FIG. 55 is a generalized flowchart of the program routines for the Control microprocessor (CTM) shown in FIG. 51B.

FIG. 55 is an overall block diagram of the Control microprocessor 210 (CTM) operations. The CTM 210 goes through Power On Diagnostics upon Power Up and then upon successful completion of that proceeds to Program Controls. The function of this is to look for and analyze commands from the Communications microprocessor 200 (CMM) and start or continue forms operation. Initially, a check is made by the Ramp Heads block that print heads 34 are in the home or ramp position. A check is then made by Test Commands block for servicing or customer tests that may be required. When a command is determined, if it is a Print Command, CTM 210 starts the print head motor 76 and looks for the first print emitter. Upon finding the first print emitter, CTM 210 goes into the Print block and stays in that area printing the line of data until it reaches Print Complete representing complete printing of the line. Then CTM 210 goes into the margin routines to find the margins or a turnaround emitter. Once the margins or the turnaround emitter are determined, CTM 210 stops the print head 34, starts the forms 15 and returns to Program Control to look for and analyze further commands. If CTM 210 receives additional commands from the CTM 200, upon completion of the forms operation, it starts the next print operation. Out of any of these blocks, if an error is detected, CTM 210 exits and goes into an error routine to determine what and where the error is. It notifies the CMM 200 of the error. The CMM 200, based on the type of error, will either retry the command or stop the operation of the printer and notify the host system 1.

Control Microprocessor Registers

The register layout for the Control microprocessor 210 is shown in FIG. 56. As a convenience, the register assignments are listed below:

| | | | |
|---|---|---|---|
| I00 | EQU | R0 | Input/Output Register |
| I01 | EQU | R1 | Input/Output Register |
| | | R2 | Work Register |
| | | R3 | Work Register |
| | | R4 | Work Register |
| PEMT | EQU | R5 | Indicates Previous Emitters |
| PHF | EQU | R6 | Print Head Flags |
| FRMST | EQU | X'1' | Forms Start Flag |
| DNSCH | EQU | X'2' | Density Change Flag |
| PARK | EQU | X'4' | Ramp Command Flag |
| PRCMP | EQU | X'8' | Printing is Complete |
| FLG1 | EQU | R7 | Indicator Flags |
| CD15 | EQU | X'1' | Character Density Equals 15 CPI |
| RV | EQU | X'2' | Print Head is Going Left (Reverse) |
| TXBUF | EQU | X'4' | Head Image Generator Is to Use Text Buffer 2 |
| HIGST | EQU | X'8' | Head Image Generator Is to Start Print Lines |
| FLG2 | EQU | R8 | Ribbon Flags |
| FBFLG | EQU | X'1' | Wire Feedback Flag |
| RBMON | EQU | X'2' | Ribbon Motor Is On |
| FMSTM | EQU | X'4' | Forms Time Flag |
| TOK | EQU | X'8' | Turn Around Is OK |
| WIPOS | EQU | R9 | Wire Position Counter |
| FECT | EQU | R10 | False Emitter Counter |
| DIAGF | EQU | X'1' | Diagnostic Flag |
| FDRCT | EQU | X'2' | Direction of Forms Movement |
| FE2 | EQU | X'4' | False Emitter 2 |
| FE1 | EQU | X'8' | False Emitter 1 |
| PRERR | EQU | R11 | Printer Error Flags |
| | EQU | X'8' | Not Used |
| HHOME | EQU | X'4' | Head Home Flag |
| TEDGE | EQU | X'2' | Turnaround Edge Flag |
| HATNA | EQU | X'1' | Head Stopped At Turnaround Flag |
| CMDFL | EQU | R12 | Command Flags |
| PRCMD | EQU | X'1' | Print Command Flag |
| PRPND | EQU | X'2' | Print Command Is Pending |
| FMCMD | EQU | X'4' | Forms Command Flag |
| TSCMD | EQU | X'8' | Test Command Flag |
| EMCT1 | EQU | R13 | Emitter Counters—Used To Determine |

-continued

Control Microprocessor Registers

The register layout for the Control microprocessor 210 is shown in FIG. 56. As a convenience, the register assignments are listed below:

| | | | |
|---|---|---|---|
| EMCT2 | EQU | R14 | Head Position by |
| EMCT3 | EQU | R15 | the Number of Emitters From Left Margin |
| MAIN/AUX | EQU | D0,D0 Aux | Address Registers |
| MAIN/AUX | EQU | D1,D1 Aux | Address Registers |
| MAIN/AUX | EQU | D2,D2 Aux | Address Registers |
| RM1 | EQU | D3 | Indicates Right Margin |
| RM2 | EQU | D4 | When the Emitter |
| RM3 | EQU | D5 | Counter Attains This Value |

End of Forms Indicators

| | | | |
|---|---|---|---|
| EOFI | EQU | D6 | End of Forms Indicators |
| LASTD | EQU | X'8' | Last Forms Direction, 1 = Forward; 0 = Reverse |
| LBUSY | EQU | X'4' | Busy History Indicator |
| FBSEQ | EQU | X'2' | Busy Sequence Flag |
| EOFER | EQU | X'1' | End of Forms Detected Indicator |
| FMCT1 | EQU | D7 | 16 Bit Forms AB Emitter Counter |
| FMCT2 | EQU | D8 | |
| FMCT3 | EQU | D9 | |
| FMCT4 | EQU | D10 | |
| SIGN | EQU | X'8' | Counter Sign Bit |

Emitter Status Register

| | | | |
|---|---|---|---|
| ESTAT | EQU | D11 | |
| LASTE | EQU | X'4' | Last End-of-Forms Emitter Value |
| LASTA | EQU | X'2' | Last Forms A Emitter Value |
| LASTB | EQU | X'1' | Last Forms B Emitter Value |
| | EQU | D12 | |
| FLECT | EQU | D13 | Forms Lost Emitter Counter |
| FMECT | EQU | D14 | Forms Missing Emitter Counter |
| PT1 | EQU | D15 | Program Timer 1/Forms Command Count |
| FLAST | EQU | X'8' | 8 or More Forms Commands Flag |

Description of Printer Block Assemblies and Emitter Relationships

FIGS. 57–60 represent print wire actuator block assemblies 177*a*–177*d* that accommodate 2, 4, 6 and 8 print heads 34, respectively. Each of these figures has a three-numbered designation which supplies significant information. As an example, the designation in FIG. 57 which is for a printer unit having two print heads 34 is "2-8-4.4". The print heads 34 are so designated only in FIG. 57 but are representative of the other print heads incorporated in the actuator blocks of FIGS. 58–60. These numbers mean that the printer unit has two print heads 34 each having eight print wires 33 and that the first print wire 33 in one of the print heads 34 is 4.4 inches away from the first print wire 33 in the second print head 34. Taking the designation in FIG. 60 as another example, this is "8-8-1.8"; this means that this particular printer unit has eight print heads 34, each having eight print wires 33 and that the first print wire 33 in one of the print heads 34 is located 1.8 inches away from the first print wire 33 in the next succeeding print head 34.

Figure 57:
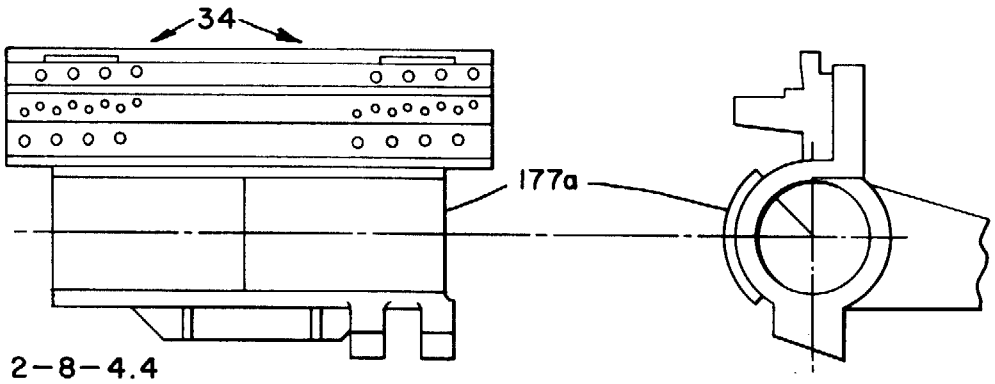
FIGS. 57–60 illustrate several actuator block configurations for 2, 4, 6, and 8 print heads.
Figure 58:
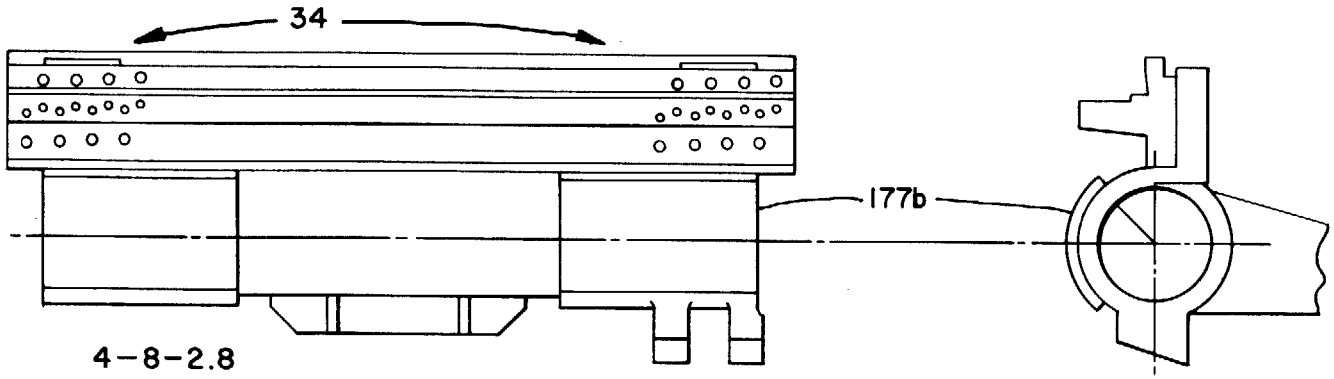
Figure 61:
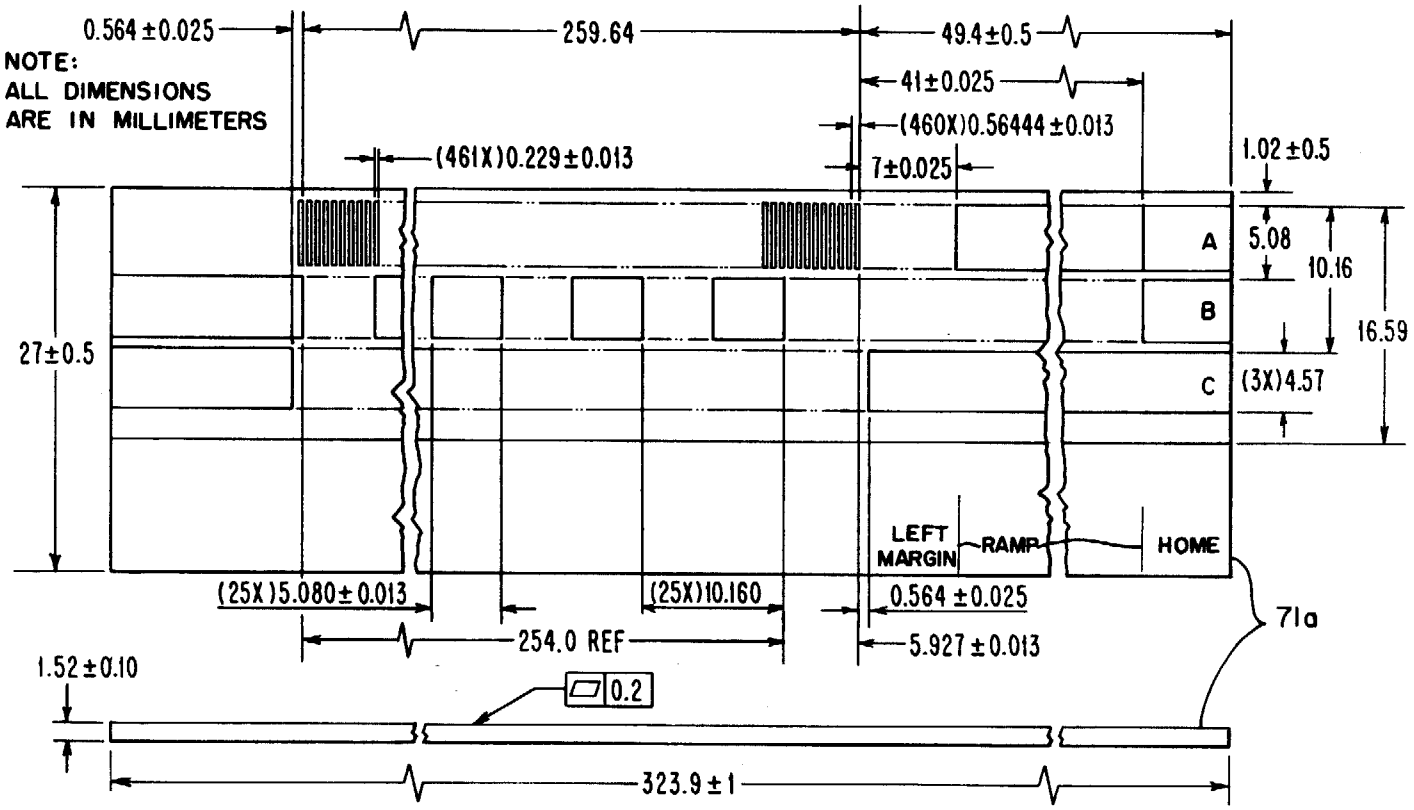

FIG. 61 illustrates a print emitter glass 71*a* (similar to emitter glass 71, FIG. 7) that is useful with a printer unit having two print heads 34 such as that illustrated in FIG. 57.

Figure 60:
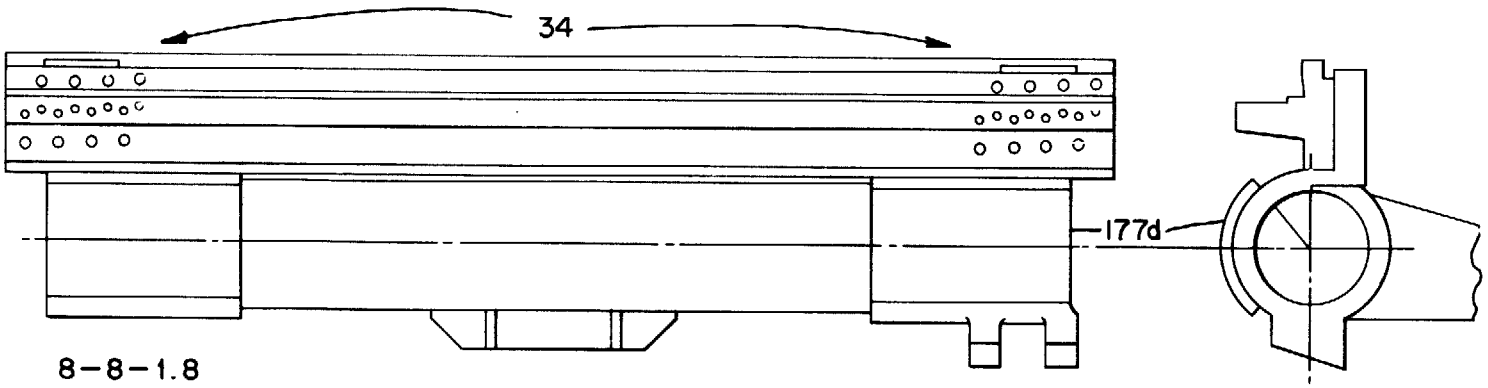
Figure 62:
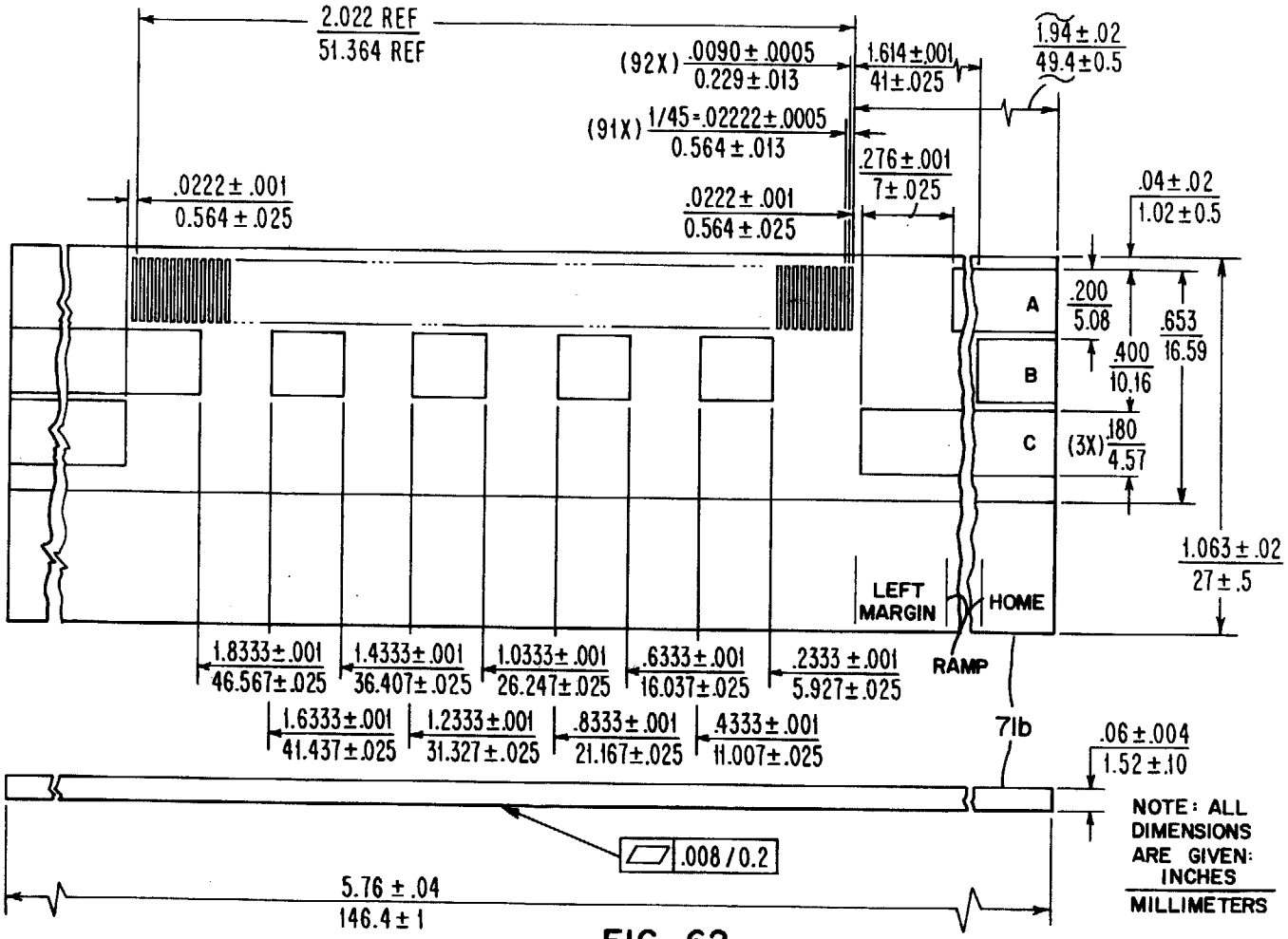
FIG. 62 illustrates a print emitter for a printer unit having two print head groups.

FIG. 62 illustrates a print emitter glass 71*b* (also similar to emitter glass 71, FIG. 7) that is useful in a printer unit having eight print heads 34 such as that shown in FIG. 60. Various dimensions and physical relationships of the emitter areas A, B and C are shown in FIGS. 61 and 62. The emitter glasses 71*a* and 71*b* in FIGS. 61 and 62 have three tracks of demarcations from top to bottom corresponding to Tracks A, B, and C of emitter glass 71, FIG. 31. Since the print heads 34 in a two-head unit are 4.4 inches apart, a longer emitter is required to provide positional information as the print heads 34 move along the print line. Since the two print heads 34 are mounted securely in a fixed relationship, FIG. 57, only one emitter is necessary to provide positional information.

Figure 59:
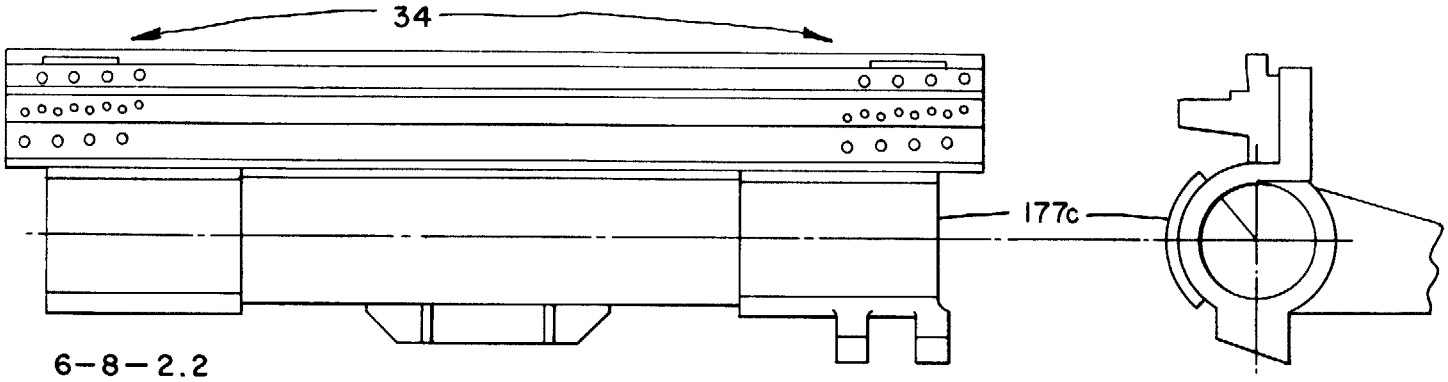

Referring to FIG. 60, the print heads 34 are located much more closely together and thus the shorter emitter shown in FIG. 62 will suffice. It is noted that only the print heads 34 at each extremity of the actuator block assembly 177*d* in FIG. 60 are illustrated but there are actually six additional intervening print heads 34 between the two print heads 34 shown. This also applies to the illustration in FIG. 58 since there are two intervening print heads 34 between those shown at the extremities. In FIG. 59 there are four intervening print heads 34 not shown, between the two print heads 34 shown at the extremities.

In FIG. 61, the dimensions are given in millimeters. Thus, the overall extent of print emitters in the upper track which corresponds to Track A in FIG. 31 is 259.64 millimeters. The dimensions in FIG. 62, on the other hand, are given both in inches and in millimeters. As one example, the overall length of the print emitter pulses corresponding to those shown in Track A in FIG. 31 is 2.022 inches which equates to 51.364 millimeters. The same principle applies to the other dimensions shown. It will be recalled that the print emitter glass 71 in FIG. 31 is illustrated in a more conventional sense with the left margin area to the left and the right margin area to the right. However, as was pointed out earlier, the emitter glass 71 is physically located in just the opposite manner in the printer unit as viewed from the front of the unit and with this in mind, the emitter glass 71*a* shown in FIG. 61, as well as emitter glass 71*b* shown in FIG. 62, have the ramp, home and left margin areas at the rightmost extremity.

Partial Line Turnaround

Figure 63:
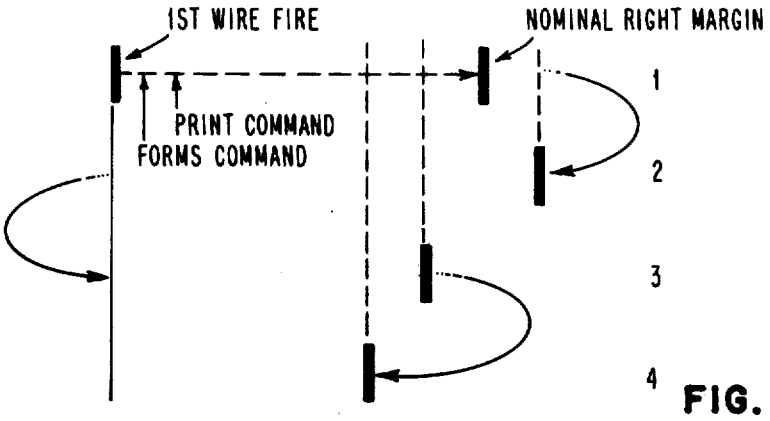
FIG. 63 illustrates various conditions that may be encountered during partial line turnaround.

FIG. 63 is a greatly simplified version of the relationships of the nominal right margin, the commands and various conditions that may be encountered during printing operations relative to the determination of a partial line turnaround. The first wire location is shown after which the forms and print command occurrences are indicated.

The nominal right margin is the minimum distance the print head 34 must move to print from one to "n" characters. The term "n" characters equals the nominal line length for a given head configuration. The nominal right margin is shown on line 1 with a turnaround indicated at line 2 if printing at least moves to the nominal right margin. If printing terminates sooner than the nominal right margin then turnaround may occur as indicated in lines 3 and 4.

Figure 64:
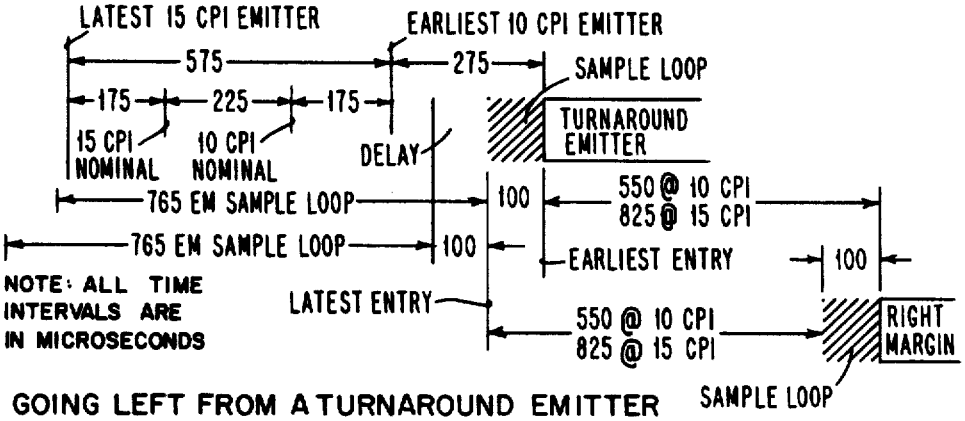
FIG. 64 illustrates various timing conditions when the printer is moving left from a turnaround emitter or is moving left from a right margin emitter area.

FIG. 64 is a chart illustrating various timing conditions when the printer is moving left from a turnaround emitter or is moving left from a right margin emitter area. The chart of FIG. 64 provides information for printing both at 10 characters per inch and 15 characters per inch. Relationships are set up in the Control microprocessor storage Input/Output stack 227, FIG. 51B, and provide an indication as to when the first print emitter to be printer on may be encountered at the two printing densities. A point of interest is that the speed of the print motor 76 is varied depending upon the print density. That is, the print motor 76 moves more rapidly at 10 characters per inch since there are fewer dots to be printed and moves more slowly at 15 characters per inch since there are more dots to be printed. As a consequence of this, the emitters will occur more frequently during a 10 character per inch print operation than they will during a 15 character per inch operation. Actually the distance traveled is identical, assuming that the same amount of information needs to be printed but it takes about one-third longer to get from one emitter to the next emitter location during the 15 character per inch printing operation than it does during the 10 character per inch operation. A number of figures in microseconds is provided to indicate the earliest and latest times for receipt of the first emitter pulse that can be used for printing operations after a turnaround or after having encountered the right margin area. This can be used by the Control microprocessor 210 based on the first detected real emitter to adjust the relationship between the false emitters and the real emitters which should always be 450 microseconds.

Layout of Emitters

Reference is again made to the description concerning FIG. 32 and its relevance to the emitter glass 71 shown in FIG. 31 for a discussion of the turnaround areas that are provided on the emitters. These turnaround areas are pictured in track B of the two emitters illustrated in FIGS. 61 and 62 as well. In connection with FIG. 32, the length of the segments in track B are chosen to be longer than the distance that it ordinarily takes the print heads 34 to stop. Thus, it is preferred that after it encounters the turnaround emitter edge, that the print heads 34 will be able to stop before encountering the opposite emitter edge for the same turnaround emitter area. The higher the print head speed and the longer the turnaround time, the longer are the track B segments.

The length of the track B segments may be reduced and print throughput correspondingly increased if an additional speed signal is introduced. Such a signal would provide a positive voltage when the motor 76 rotates in one direction, and a negative voltage when it rotates in the opposite direction.

By adding such a signal to the track B output, a distinction could then be made between the print heads 34 continuing in the original direction when entering a new track B segment, and the print heads 34 returning to the just passed segment.

The major advantage of the emitter turnaround arrangement is the elimination of unwanted emitter pulses. When the carrier 31 and with it the sensor 72 comes to rest at an emitter transition, Track A, then the slightest jitter of the carrier assembly may cause these unwanted emitter pulses. These emitter pulses are not registered with the scheme described since the emitter count will be frozen at the Track B emitter turnaround transition.

Summary of Principles Used for Determination of Partial Line Turnaround

The following summarizes the principles used in the determination of partial line turnaround.

When less than a full line of print is required, the print heads 34 can stop and turn around before they reach the end of the maximum line length. The following principles will work for any number of wire matrix heads 34 (#HD), head spacing (HDSP) and characters per inch (CPI).

Each print head 34 is assigned the option of printing a given number of characters during a single carrier movement. If the number of characters to be printed exceeds the maximum number of print positions for one head 34, then it becomes necessary to print a nominal line. A nominal line is defined as the number of print positions a print head 34 can print times the number of heads 34. This length is less than the maximum line length. Additional positions beyond a nominal line up to the maximum are defined as extended line printing (ELP). The additional positions will be printed with the rightmost print head 34, which may or may not print up to the maximum line length.

For each head configuration, a table is used that identifies the starting print position of the rightmost head 34 (RMH) and the distance between the leftmost wire 33 of each print head 34 (HDSP), see Table A.

TABLE A

| #HD | RMH | HDSP |
|---|---|---|
| 2 | 59 | 4.4 |
| 3 | 87 | 3.6 |
| 4 | 99 | 2.8 |
| 5 | 103 | 2.2 |
| 6 | 125 | 2.2 |
| 7 | 123 | 1.8 |
| 8 | 141 | 1.8 |
| 9 | 143 | 1.6 |

All additional numbers can be obtained from these two values. ELP is defined as RMH plus (HDSP) (CPI). K is a constant for each print head 34 and is defined as the distance from the leftmost wire 33 to the rightmost wire 33. In the case of all wires 33 being in a vertical plane, K would be 0. If the wires 33 are sloped, as in the printer unit herein (See FIGS. 33A and 33B), K is 1.4 inches. That is, there are fourteen character spacings at 0.1" per character. STOP is defined as the last print position the rightmost head 34 must print or pass through to complete a given character count (CHCT).

All line lengths can be defined into three areas and the following formulas are used in this sequence.

1. Definition of less than nominal line and its STOP formula.

$$CHCT < (HDSP)\ (CPI)$$

$$STOP = (CHCT) + (HDSP)\ (CPI)\ (\#HD - 1) + (K)\ (CPI)$$

2. Definition of nominal line length and its STOP formula.

$$CHCT < (\#HD)\ (HDSP)\ (CPI) - (K)\ (CPI)$$

$$STOP = (K)\ (CPI) + (HDSP)\ (CPI)\ (\#HD)$$

3. Extended line printing is anything not covered by 1 or 2 but does have its own STOP formula.

$$STOP = (CHCT) + (K)\ (CPI)\ (2)$$

The above description is for right partial line turnaround and left partial line turnaround would use the same type of calculations. There are two conditions to be considered for left partial line turnaround: (1) is to start a nominal line at the point the last line ended or some point that would allow all of the line to be printed or, (2) start to the left with ELP if ELP had been used and then finish with nominal printing. Less than nominal line length would be possible in all cases.

Advantages to be gained by use of partial line turnaround can be realized by inspection of the following table. This table uses the maximum line length printing time for each head configuration as a 100% and then shows the percentage increase when using partial line turnaround.

TABLE B

| Number of Print Heads | 10 CPI Partial Line Turnaround | 15 CPI Partial Line Turnaround |
|---|---|---|
| 2 | 113% | 118% |
| 4 | 97% | 102% |
| 6 | 48% | 52% |
| 8 | 9% | 9% |

The printing throughput is dependent upon the length of print lines, spacing, and skipping and does not vary with the character set used by the printer. Printing throughput is for both maximum forms width and partial line turnaround formatted width. Throughput for typical documents would typically fall between the partial line turnaround and maximum values shown in the chart.

Actual Examples

Figure 72:
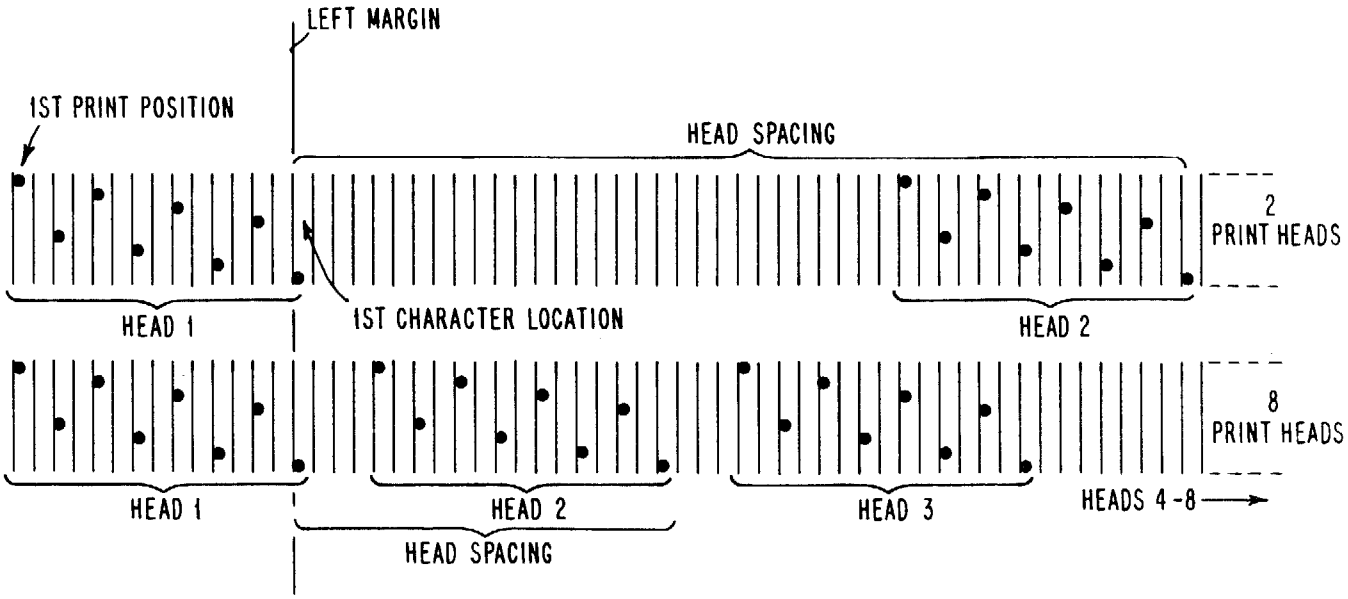
FIG. 72 further illustrates the relationship of print wires and print locations on a document during start-up of printing.

Reference is made to FIG. 72 which illustrates the relationships of the print wires 33 and printing or character locations on the document for printer units having two print heads 34 in one case and eight print heads 34 in another case. The principles of determining whether less than nominal line length, nominal line length, or extended printing is required is generally the same regardless of the number of print heads 34 involved, the head spacing, or the number of characters to be printed. The following discussion is predicated on a maximum print line length of 132 character locations and involves printer units with both two print heads 34 and eight print heads 34 with the spacing shown in FIG. 72. Character location numbers are not directly allotted to print position numbers.

The following examples will illustrate conditions encountered during actual print operations involving printer units having two print heads 34 and eight print heads 34, respectively.

A test is first made by the routines in the Control microprocessor 210 to check whether or not the number of characters is less than a nominal line length. The following information pertains to printer units with both two heads 34 and eight print heads 34.

Situation No. 1: The leftmost print head 34 will print the characters when they total less than the nominal line length and are all located in its assigned area.

| 2 Print Heads | 8 Print Heads |
|---|---|
| CHCT < (HDSP)(CPI) | CHCT < (HDSP)(CPI) |
| CHCT < (4.4)(10) | CHCT < (1.8)(10) |
| CHCT < 44 (IF NOT, TEST FOR NOMINAL) | CHCT < 18 (IF NOT, TEST FOR NOMINAL) |
| STOP = CHCT + [(HDSP)(CPI)(#HD − 1)] + (K)(CPI) | STOP = CHCT + [(HDSP)(CPI)(#HD − 1)] + (K)(CPI) |
| STOP = CHCT + [(4.4)(10)(1)] | STOP = CHCT + [(1.8)(10)(7)] |

-continued

| 2 Print Heads | 8 Print Heads |
|---|---|
| +[(1.4)(10)] | +[(1.4)(10)] |
| STOP = CHCT+44+14=58 | STOP = CHCT+126+14=140 |

The last print buffer position covered by the rightmost wire 33 in the rightmost print head 34 will be as follows:

| | |
|---|---|
| Rightmost wire, print head 2 will traverse print positions 59-101 so that characters 1-43 will be printed in their entirety. | Rightmost wire, print head 8 will traverse print positions 141-157 so that characters 1-17 will be printed in their entirety. |

Referring to the information for the printer unit with two heads 34, as an example, if the character count is less than forty-four, then all printing can be handled by Head No. 1. That is, Head No. 1 can print up to and including forty-four characters. For a printer unit with eight heads 34, a test is made to see whether the character count exceeds eighteen characters.

If, in the case of the printer unit with two print heads 34, the number of characters in any selected line to be printed exceeds forty-four in number, then the routine proceeds to the next test which is to determine whether or not a nominal line length exists. The following information is pertinent for printer units with two heads 34 and eight print heads 34.

Situation 2: Print Head 1 plus other print heads 34 are utilized in their assigned areas to print characters when they number less than or are equal to the nominal line length for the leftmost print head 34.

| 2 Print Heads | 8 Print Heads |
|---|---|
| CHCT ≦ (#HD)(HDSP)(CPI) − (K)(CPI) | CHCT ≦ (#HD)(HDSP)(CPI) − (K)(CPI) |
| CHCT ≦ (2)(4.4)(10) − (1.4)(10) | CHCT ≦ (8)(1.8)(10) − (1.4)(10) |
| CHCT ≦ 88 − 14 | CHCT ≦ 144 − 14 |
| CHCT ≦ 74 (If not, then use extended) | CHCT ≦ 130 (If not, then use extended) |
| STOP = (K)(CPI) + (HDSP)(CPI)(HHD) | STOP = (K)(CPI) + (HDSP)(CPI)(HHD) |
| STOP = (1.4)(10) + (4.4)(10)(2) | STOP = (1.4)(10) + (1.8)(10)(8) |
| STOP = 14 + 88 = 102 | STOP = 14 + 144 = 158 |

The last print buffer position covered by the rightmost wire 33 in the rightmost print head 34 will be as follows:

| | |
|---|---|
| Rightmost wire, print head 2 will traverse to print position 102 in order that characters 44-74 will be printed in their entirety. | Rightmost wire, print head 8 will traverse to print position 158 so that print heads 2-8 can print characters 18-130, in their entirety and as may be assigned to their respective printing areas. |

From the tabulation, it can be seen that any line of printing that has less than or equal to seventy-four characters maximum can be printed by utilizing both of the print heads 34 in a printer unit having two print heads 34. In the case of a printer unit with eight heads 34, the significant character count is 130.

If the number of characters in a line to be printed exceeds 74 in the case of two heads 34, or 130 in the case of eight heads 34, then the routine proceeds to determine whether extended line printing is necessary and the following information is pertinent for this determination.

Situation 3: When the number of characters in a line extends beyond the nominal line length for all print heads 34, the rightmost print head 34 prints all characters located beyond the nominal line length up to the maximum line length. (Example: 132 characters maximum for 10 characters per inch).

| 2 Heads | 8 Heads |
|---|---|
| STOP = CHCT + (K)(CPI)(2) | STOP = CHCT + (K)(CPI)(2) |
| STOP = CHCT + (1.4)(10)(2) | STOP = CHCT + (1.4)(10)(2) |
| STOP = CHCT + 28 | STOP = CHCT + 28 |

The last print buffer position covered by the rightmost wire 33 in the rightmost head 34 will be as follows:

| | |
|---|---|
| Rightmost wire, print head 2 will traverse print positions 103-160 so that characters 75-132 will be printed in their entirety in extended line mode. | Rightmost wire, print head 8 will traverse print positions 159-160 so that characters 131-132 will be printed in their entirety in extended line mode. |

Considering the printer unit with two print heads 34, if 132 characters need to be printed in a given line, that is the maximum number of characters that can be accommodated at 10 characters per inch, the blank areas in the left and right margin portions of the print line also need to be taken into account. These areas comprise 14 character locations each for a total of 28 character locations. When this is added to the 132 character maximum for 10 characters per inch, a total of 160 print positions is involved. So under these circumstances, and considering the printer unit with two print heads 34 again, the two print heads 34 will handle 74 characters of printing which is the nominal line length and Print Head No. 2 will continue past character position 74 for extended printing on up to the assumed maximum character count of 132.

When a printer unit has eight print heads 34, the extended printing in the line involves only a short distance for Print Head No. 8 in order to print character locations 131 and 132.

Figure 69:
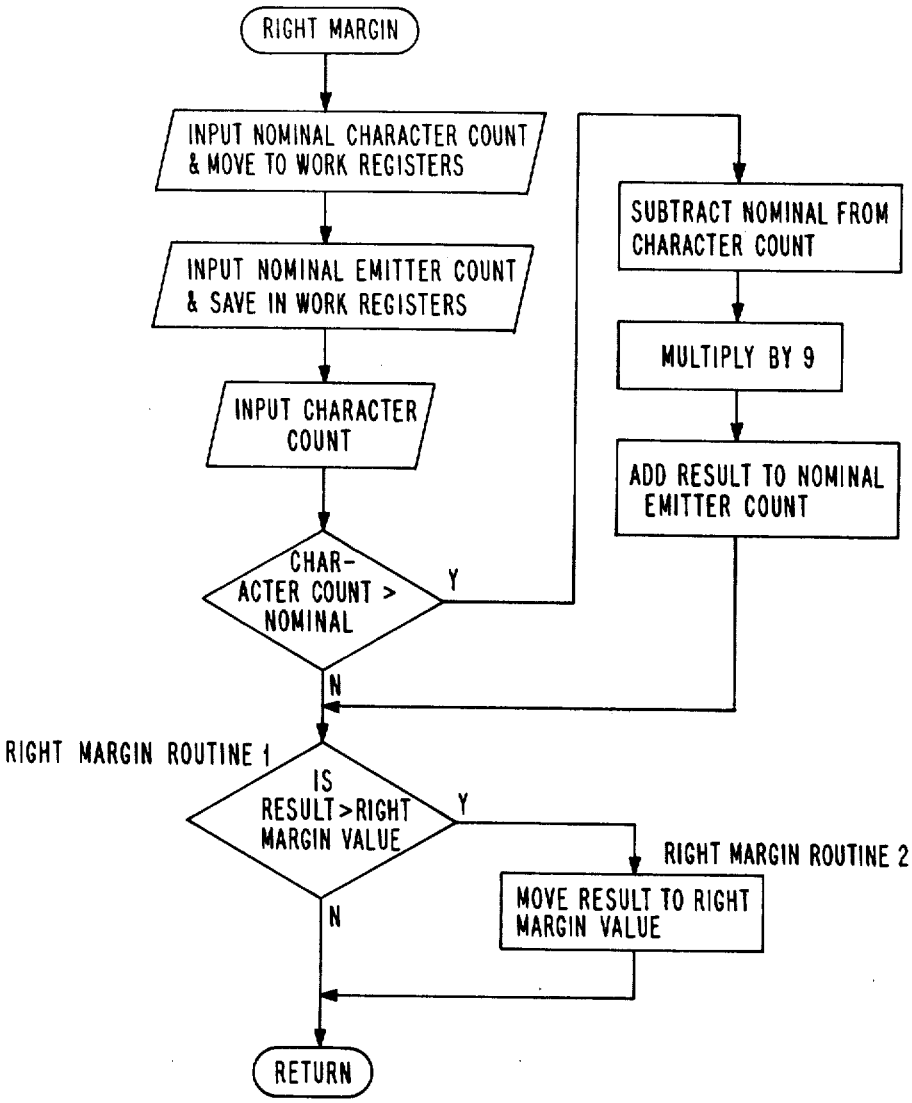
FIG. 69 is a flowchart representing a right margin routine.
Figure 70:
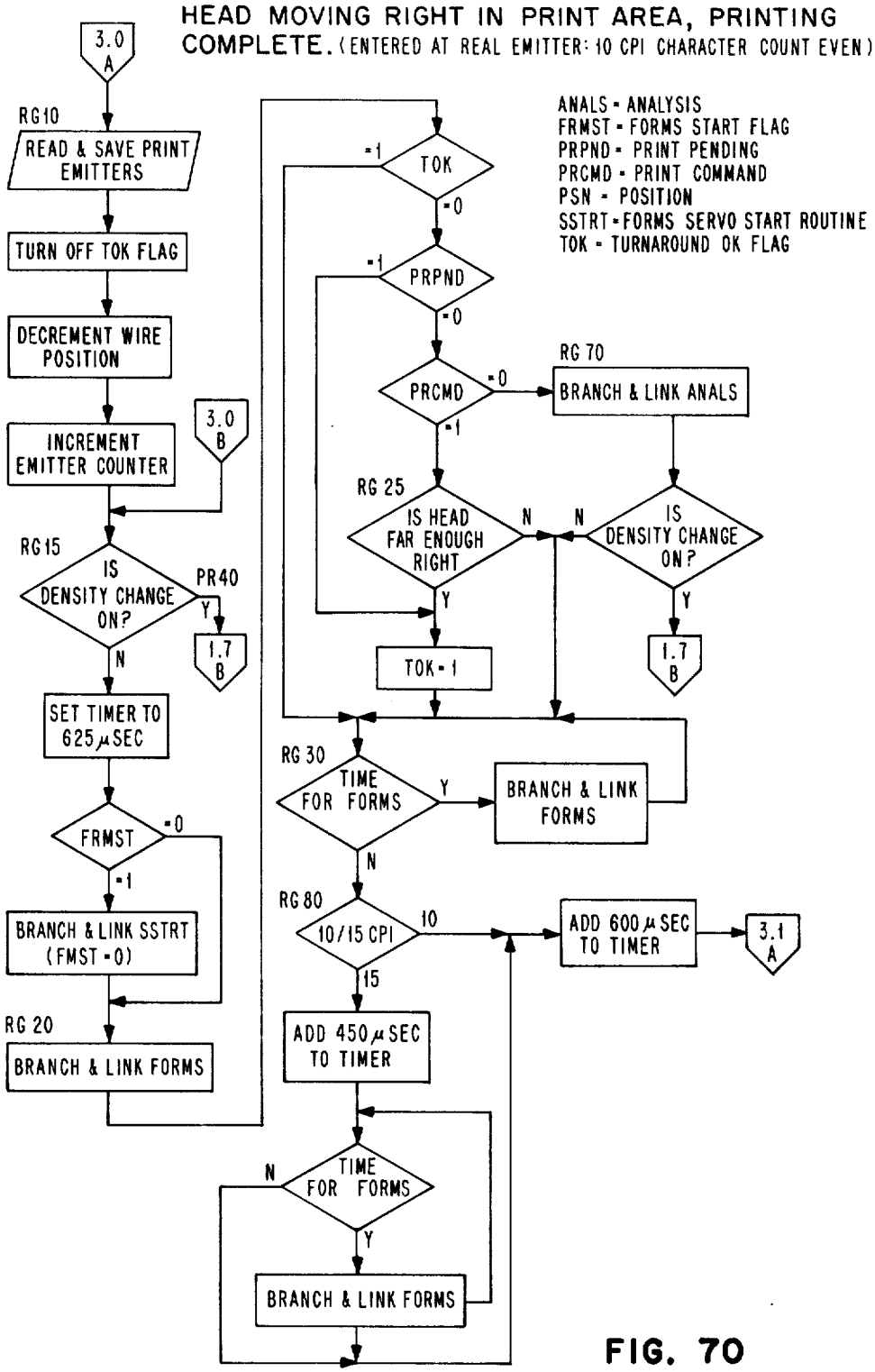
FIGS. 70 and 71 are flowcharts representing head moving right in print area, printing complete (entered at real emitter: 10 CPI character count even).
Figure 71:
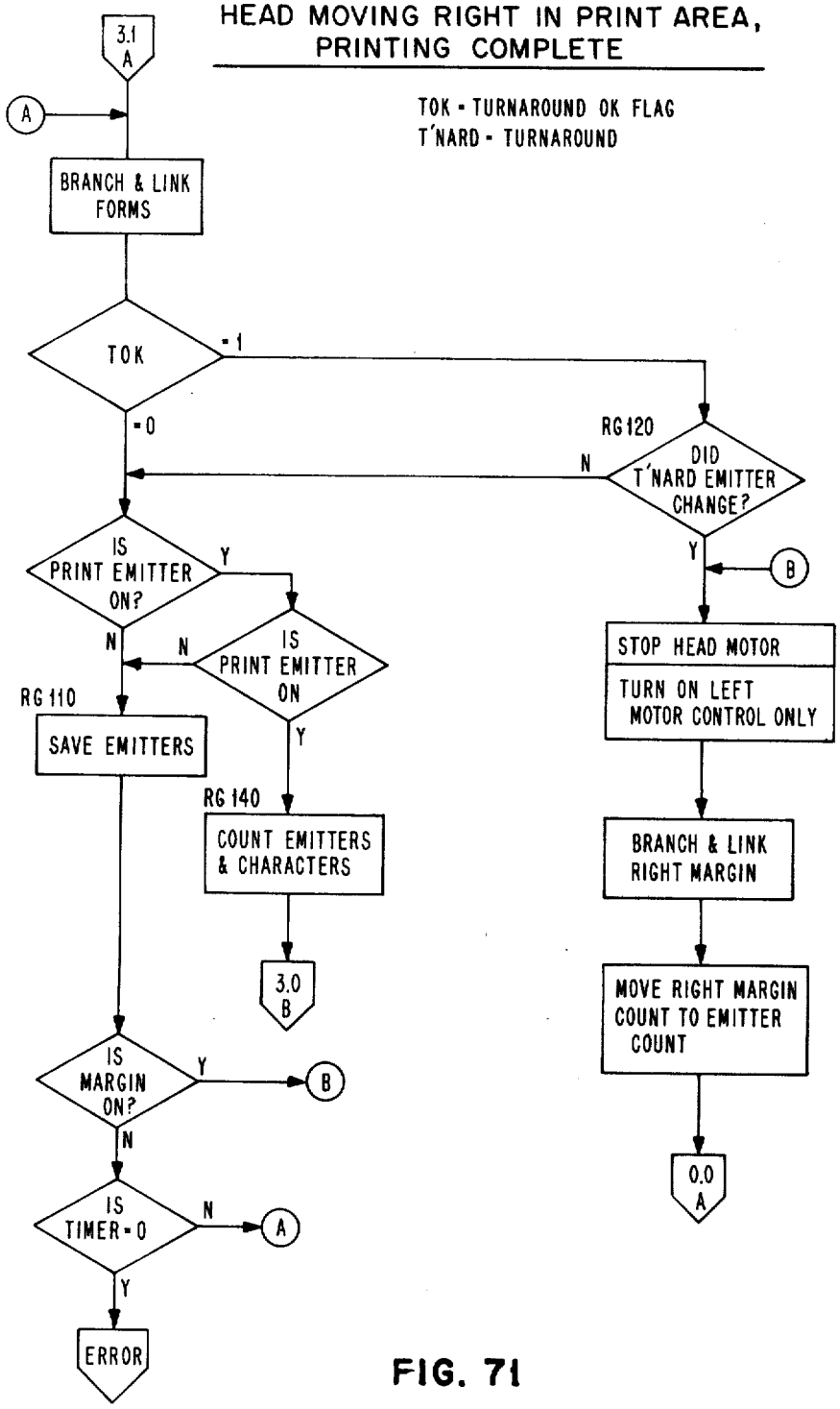

Microprocessor Routines for Analysis, Right Margin, and Print Line Determinations FIGS. 65-68 concern Analysis routines used by the Control microprocessor 210 in analyzing commands and in preparing for print operations. FIG. 69 illustrates a Right Margin routine that is useful in determining the actual right margin emitter location utilizing the nominal values based on the principles just described. FIGS. 70 and 71 illustrate movement of the print heads 34 into the print area and completion of printing. Control microprocessor 210 makes use of many "registers" and "counters" that are maintained in local storage in specific locations that are addressable and that are utilized by the Control microprocessor 210 in performing the routines described in FIGS. 65-71. FIG. 56 is a representative layout of many of the registers and counters utilized. See, for example, EMCT1–EMCT3, the Print Emitter Counter.

FIG. 72 further illustrates the relationship of print wires 33 and print locations on a document during start-up of printing.

Figure 65:
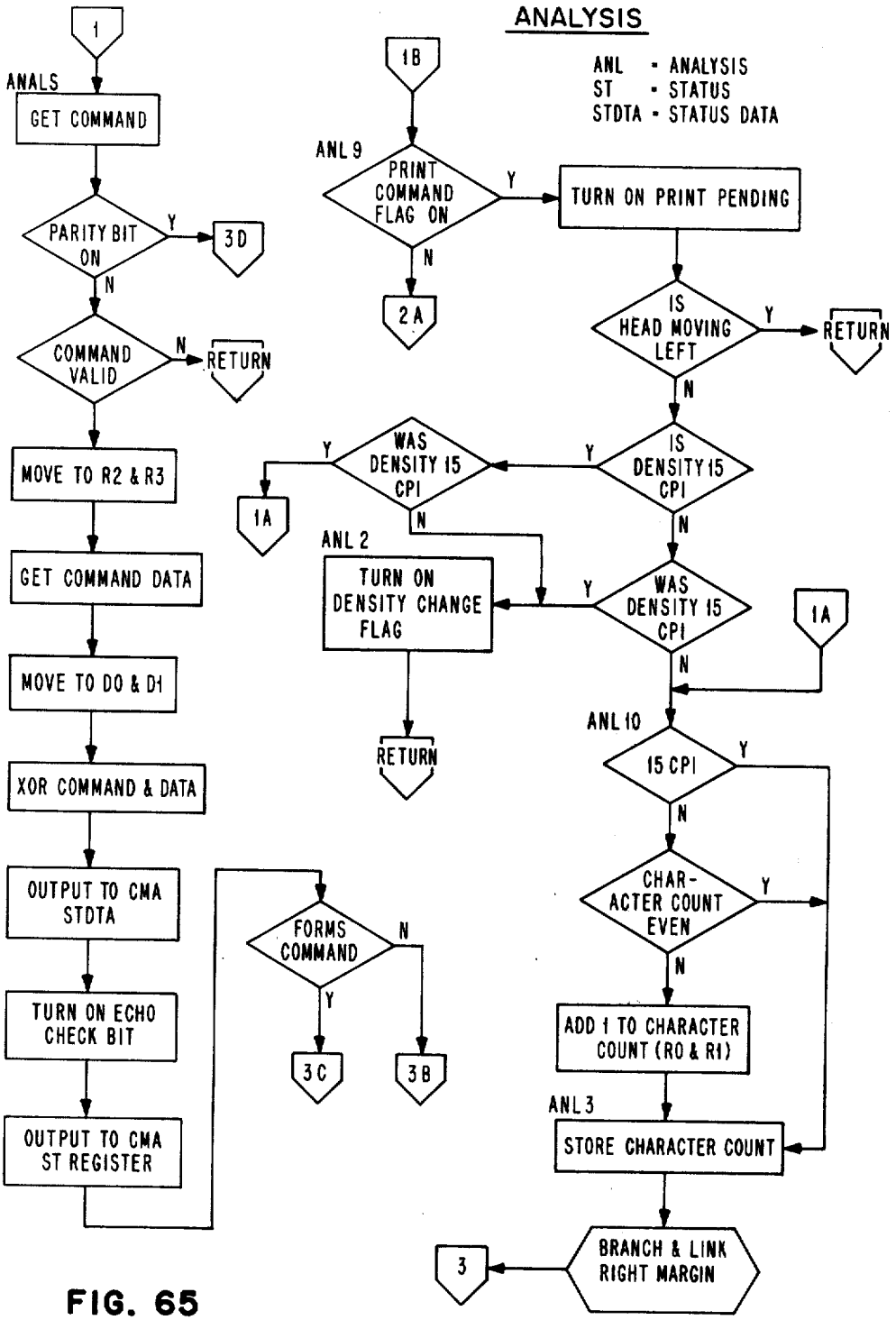
FIGS. 65–68 illustrate flowcharts for Analysis routines.

In FIG. 65 step 1 of the Analysis routine is to read the command register (indicated and listed in the Boynton et al application) from the Communications microprocessor 200 and test if the parity bit is on. The parity bit being on dictates that the Communications microprocessor 200 has had a parity check and has stopped, and the routine proceeds by way of exit 3D to FIG. 67. No further printing action would then be taken by the Control microprocessor 210. Next a check of the command validity bit is made which indicates that this command has been put in the register by the Communications microprocessor 200. If the validity bit is not on, the analysis routine is then finished and a return is made to the calling program. If the validity bit is on, the command is moved to registers 2 and 3 in the Control microprocessor 210 and the microprocessor 210 fetches the command data from the communications registers 225,226 discussed in connection with the Control adapter 211, FIG. 51B. The command data is thereafter moved to Exclusive Or registers D0 and D1 indicated in FIG. 65, and the communications data are Exclusive Or'd together and outputted to the Communications adapter 202 through the communications registers 225,226, FIGS. 51A and B. The echo bit is turned on at this time and an output made to the Status register 225, FIG. 51B. The purpose of this is to route all command data from the Communications microprocessor 200 through the Control microprocessor 210 back to the Communications microprocessor 200 in order to test the integrity of the communications path between the two microprocessors 200,210. If the data received back by the Communications microprocessor 200 does not compare with the data that was sent, then an error is detected and the printer is stopped. Next a test is made to see if a Forms command has been received. If the answer is Yes, an exit is made to 3C, FIG. 67. The program tests to see if a Forms command is presently being performed. If a Forms command is being performed, the routine returns immediately. If a Forms command is not being performed then a check is made of the low order byte of the Forms Command and it is stored in the Input/Output register stack in location FCT1 or FCT2 as may be appropriate. If the low order byte is stored in FCT2, the Forms command flag is turned on and the Forms Start flag is turned on. Also, the validity bit is reset to indicate to the Communications microprocessor 200 that the command has been accepted and the analysis routine returns. At point 3B, FIG. 67, an entry is made if a Forms command was not received and a test made to see if it is a Print command that has been received. If not, the next check is to see if it is a Test command that has been received. If it is a Test command, the command data is stored in the Input/Output stack 227, FIG. 51B, in the test mode value, a Test command flag is turned on, the command validity is reset and the analysis returns. If it was not a Test command, a test is made to see if a command is being performed and if any command is presently being performed, the analysis routine does not accept the command at this time and returns. If a command is not being performed, the Park flag is turned on, validity is reset and analysis returns.

Returning to the analysis routine, entry 1B in FIG. 65, a Print command is assumed to have been received. A test is performed to see if the Print command flag is on. If the print command flag is on which means a print command is presently being performed the routine turns on the Print Pending flag and checks to see if the print head 34 is moving left. If the print head 34 is moving left, the analysis routine returns. If not, a check is made to see if print density is at 15 characters per inch. If the present density is not at 15 characters per inch, a check is made to see if the density was at 15 characters per inch. If the result is Yes, the Density Change flag is turned on indicating that the next print line is at a different density than the present print line. After testing to see if the print density has been changed, if the acquired Print command is at 10 characters per inch, the character count is not even, it is adjusted to an even character count. The character count is not adjusted if it is an even number. The purpose of this is to keep the timing of the entry into the right margin routine identical for both 10 characters per inch and 15 characters per inch. The character count is then stored and there is a Branch and Link to the right margin routine FIG. 69 to calculate the emitter count for this particular line of print. The right margin routine will be discussed shortly. Also, by way of exit 3 to FIG. 67 Print Pending is checked.

Figure 66:
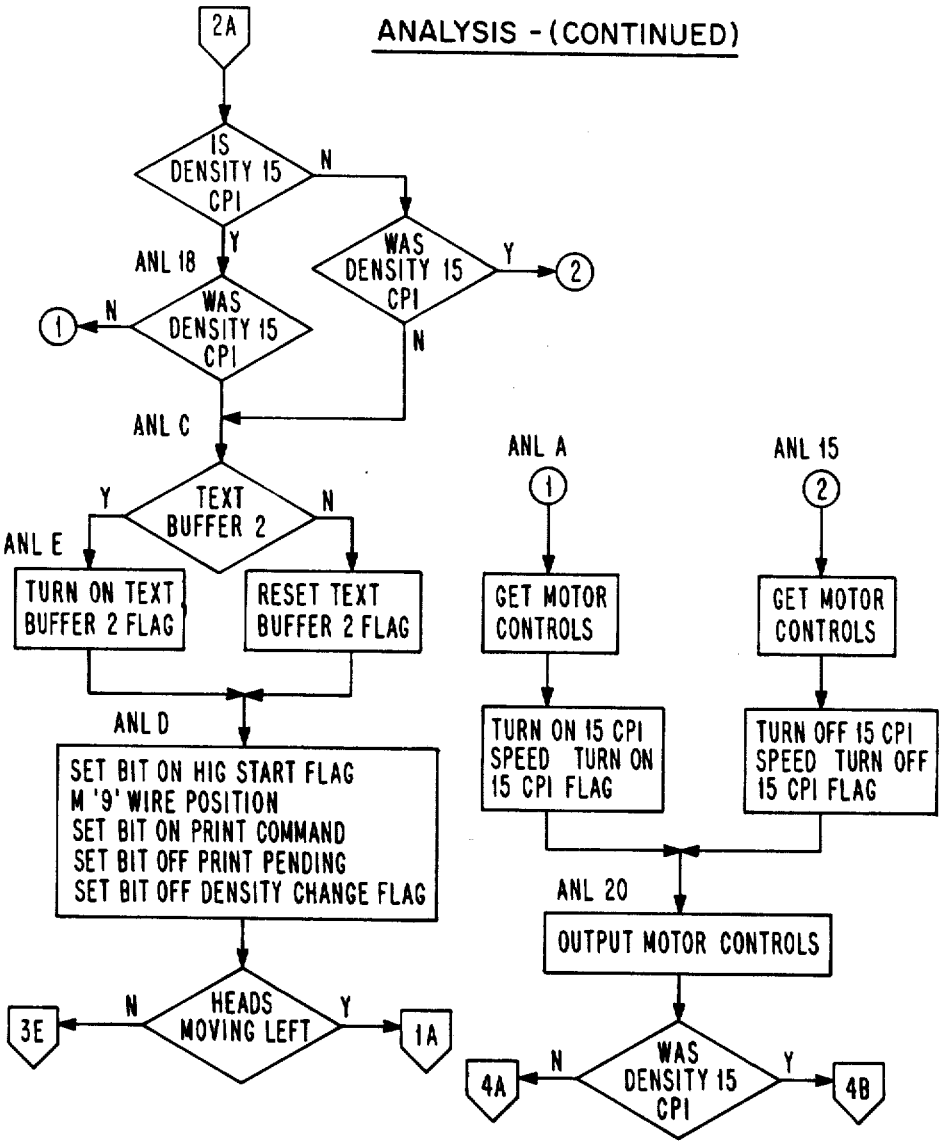
Figure 67:
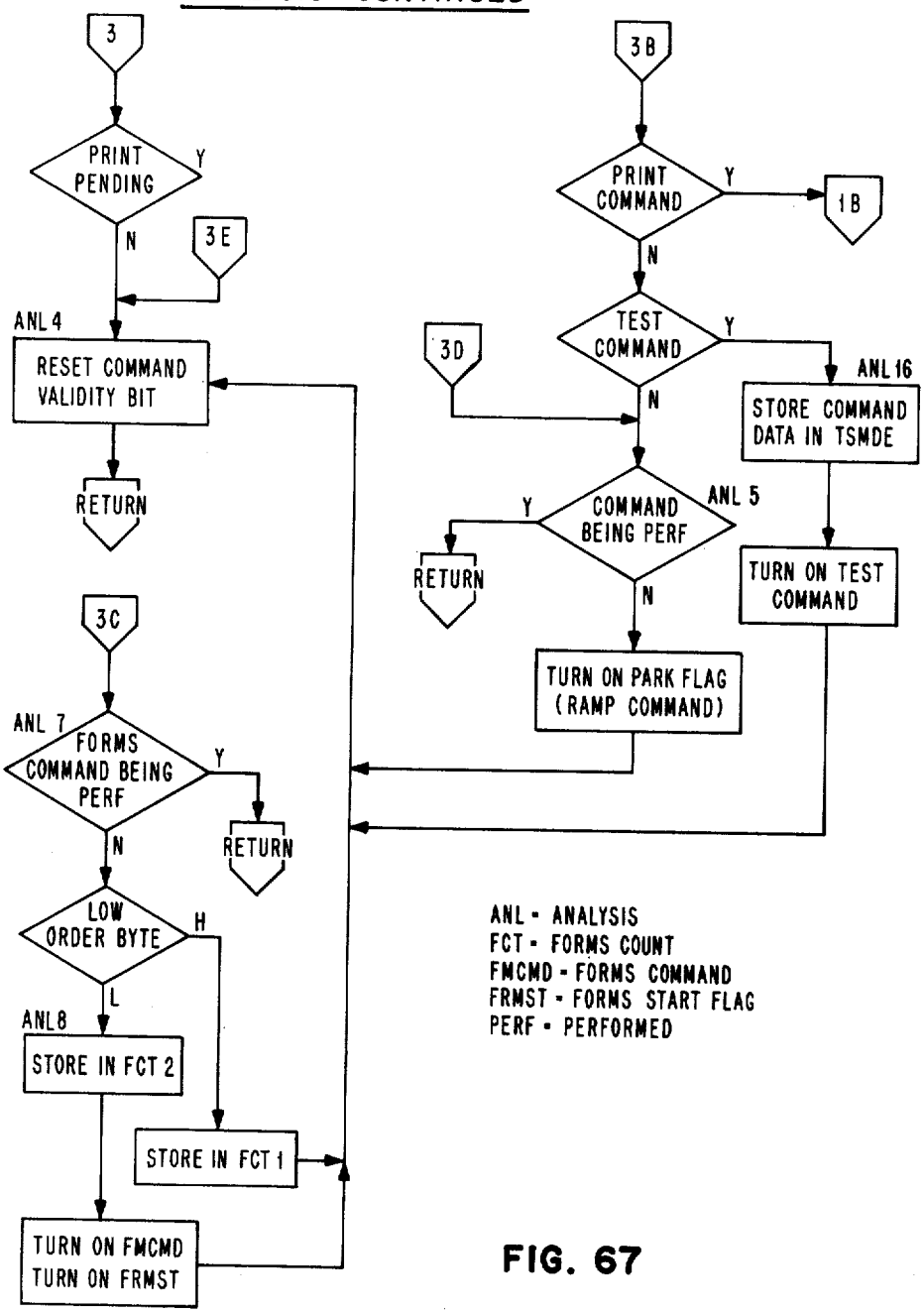

If upon entry at 1B, FIG. 65, the Print command flag was not on, an exit is made from 2A, FIG. 65, to 2A, FIG. 66.

At entry point 2A, FIG. 66, the print density at 15 characters per inch is checked. If a No results, then a check is made as to whether the density was previously 15 characters per inch. If the result is Yes, the routine proceeds to the circle 2 to get the motor controls. The 15 character per inch speed flag is turned off and the 15 character per inch flag is also turned off. Going the other route, if the present density is 15 characters per inch and the density was not previously 15 characters per inch then the routine goes to circle 1, FIG. 66. At this time the motor controls are fetched and the 15 character per inch flag and 15 character per inch speed control are turned on. In both cases an output is directed to the motor controls and an exit made to FIG. 68 whether or not the print density was 15 characters per inch. The density routine in FIG. 68 will be discussed shortly.

Continuing, at entry 2A, FIG. 66, after the change of density is processed, a check is made as to whether Text Buffer 2 is to be used and the flag for Text Buffer 2 is turned on or off as appropriate. The Head Image Generator Start flag is then turned on and wire position maintained by Head Image Generator 220, as described in detail in the Blanco et al patent application, is initialized to a count of 9. The Print command flag is turned on, the print pending flag is turned off, the density change flag is turned off and the routine exits if the print heads 34 are moving left to 1A, FIG. 65, or to 3E, FIG. 67.

Print Density Analysis

Figure 68:
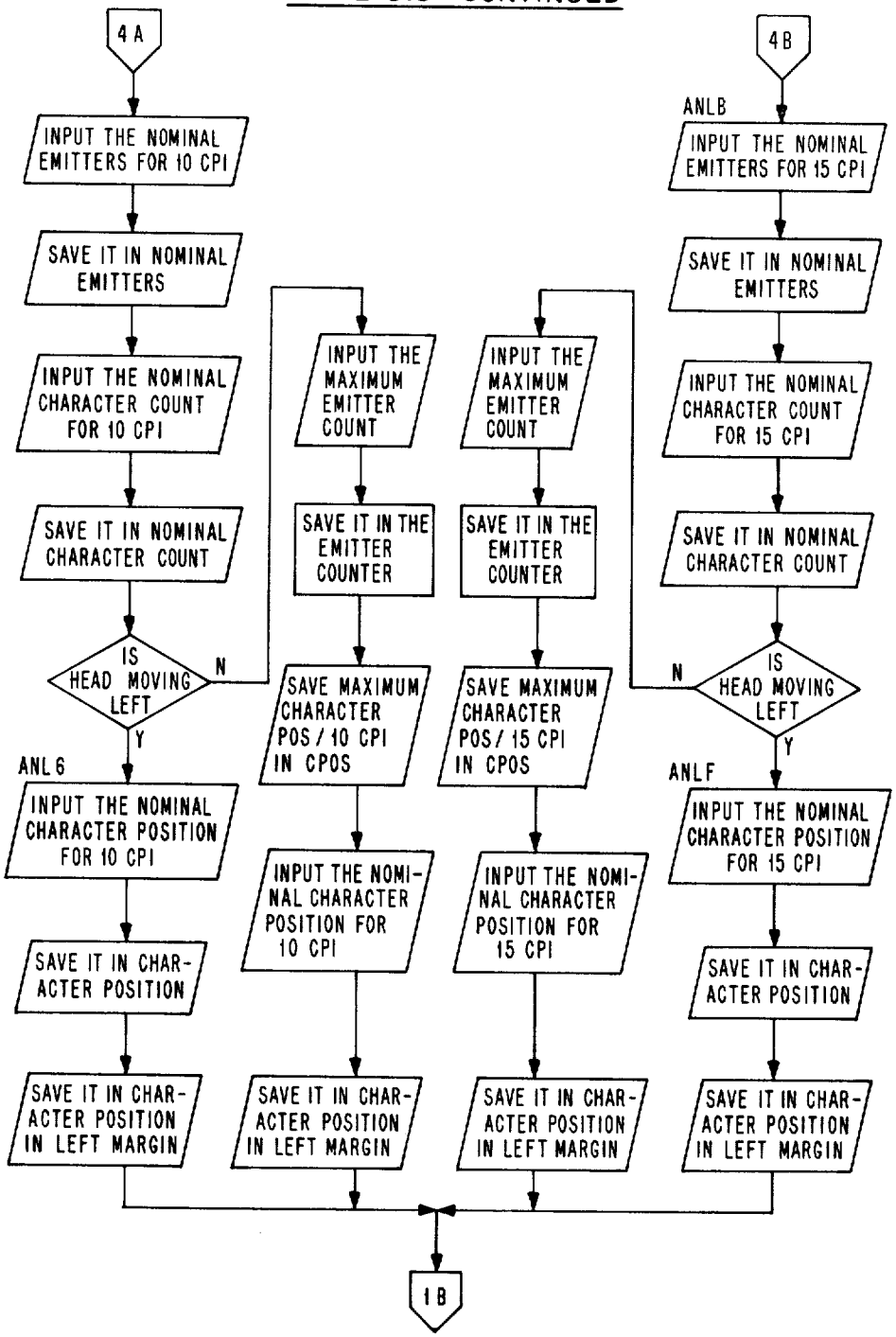

The logic in FIG. 68 shows the routine involved for switching the printer back and forth between 10 characters per inch and 15 characters per inch. At entry point 4A, the nominal emitters for 10 characters per inch are read and saved in the Nominal Emitter registers (maintained in Input/Output stack 227, FIG. 51B). The nominal character count for 10 characters per inch is inputted and again saved in the Nominal Character Count registers (maintained in Input/Output stack 227, FIG. 51B). A determination is then made if the print heads 34 are moving left or right. If they are moving left, an adjustment of the nominal character position for the 10 characters per inch is made and it is saved in the Character Position registers (maintained in Input/Output stack 227, FIG. 51B). Also the nominal character count is saved in the Character Position in Left Margin registers (maintained in Input/Output stack 227, FIG. 51B). If the print heads 34 are not moving left but are moving to the right, an input is made of the maximum emitter count and it is saved in the print emitter counter, FIG. 56. The maximum Character Position count for 10 characters per inch is saved in the Character Position register. An input of the nominal character position for 10 characters per inch is made and it is saved in the Character Position in Left Margin registers. At entry 4B, FIG. 68, the logic proceeds in a similar fashion except it is reversed, that is the new values are for 15 characters per inch and are substituted for the values for 10 characters per inch. All of the logical procedures remain the same.

Right Margin Routine

FIG. 69 illustrates the right margin routine that is utilized during the analysis procedures to determine the nominal emitters and character counts necessary for the partial line turnaround operation. That is, the purpose of this routine is to calculate the emitter count at the right margin for the present line in terms of the number of emitters involved. The entry point is right margin. The first step is to input the nominal character count and move it into the work registers for the Control microprocessor 210. An input of the nominal emitter count is made and this is saved in the Work registers R2–R4, FIG. 56, as well. The commanded character count for this print line is inputted next and compared to see if the commanded character count is greater than the nominal character count. If the commanded character count is greater than nominal, then the nominal character count is subtracted and the difference is multiplied by 9. That result is added to the nominal emitter count to determine the new right margin value. If the character count is less than or equal to the nominal character count, then the right margin value becomes the emitter count for the nominal character count. The result is moved to the Right Margin Value registers, FIG. 56, if the result is greater than the present value in the Right Margin Value registers, FIG. 56, and then the routine returns.

Head Moving Right In Print Area and Completion of Printing

FIGS. 70 and 71 illustrate the routines involved while printing is taking place and also at the completion of printing the determination of the turnaround point. It is assumed that the print heads 34 are moving to the right in the print area and that printing has been completed. Entry to the routine is at 3.0A. At 10 characters per inch, the character count is even which makes the timing entering this routine the same for both 10 and 15 characters per inch. This routine is called the Moving Right routine. The print emitters are read and saved and the Turnaround Okay flag is turned off. This is a flag that indicates when the printer is able to stop the heads 34 and turn them around going back in the opposite direction. The Wire Position counter not shown, but incorporated in the Head Image Generator 220 as described in detail in the Blanco et al application, is decremented and the Emitter counter incremented in this routine since the print heads 34 are still assumed to be moving to the right. The character and emitter counts are maintained just as if printing were taking place even though there is no longer any firing of the print wires 33. A check is made to see if a Density Change flag is on which means that the print density has been changed from 10 characters per inch to 15 characters per inch or vice versa and, if so, an exit is made to 1.7B not shown herein but involving driving the print heads 34 (carrier 31) to the margin before attempting to change the print density. If the density is not changed, the routine continues down, a timer, not shown, but indicated in FIG. 70, is set for 625 microseconds and a check is made of the Forms Start flag. If it is on, that is, a 1, a Branch and Link is made to the Forms Servo Start routine which resets the Forms Start flag. If the Forms Start flag is 0, that block is bypassed but in both cases a Branch and Link is made to the Forms routine to service forms. A check is then made of the Turnaround Okay flag. If it is 0, the routine continues down and checks the Print Pending flag. If the Print Pending flag is on, it indicates that a Print command for the following line of print has already been received. If it is not on, the routine proceeds to check the Print commend flag which again indicates that a Print command has been received but it has been received after the previous print was finished. In case both of these decision points are zero at RG70 in the listing and flowchart, a Branch and Link is made to the Analysis routine which attempts to acquire the next succeeding command from the Communications microprocessor 200. If the Print Pending flag is on, that is, is a 1, it indicates that at this time the head 34 is far enough right to begin printing the following cycle. Since during the previous print line cycle the next succeeding Print command is received, an adjustment can be made to the length of the current print line cycle to make sure it is always far enough to the right to turn around and start the next line to the left. If Print command is on then, the Control microprocessor 210 does not know yet if the print heads 34 are far enough to the right so that the decision block is reached "Is Head Far Enough Right?" A favorable decision here indicates that the print heads 34 are far enough to the right to start going back in the opposite direction, that is, to the left to print the next succeeding print line. If Print Pending is on or if the decision comes through the block indicating the heads 34 are far enough to the right then they both join at the block where the Turnaround Okay flag is turned on indicating that the print heads 34 at this point are far enough to the right to turn around and go in the opposite direction. Also, a check is made of the timer to see if time remains in the timer to execute the forms routine. If "Yes", a branch and link is made to service forms. If "No" indicating insufficient time remains, then the routine continues to RG80 for a check of whether density is 10 cpi or 15 cpi. If 15 cpi, 450 microseconds is added to the timer and a loop again made to the forms routine until the timer approaches zero. If at 10 cpi, 600 microseconds is added to the timer and an exit made via 3.1A to FIG. 71. At entry 3.1A, FIG. 71, a branch and link is made to the forms routine and a check made as to whether the TOK Flag is on. If the TOK Flag is equal to zero that means that either the head 34 is not far enough to the right to start printing back to the left or that another print command has not yet been received.

In either case, driving of the print heads 34 to the right continues until either right margin is reached or another print command is received. A check is then made to see if the print emitter is on. If it is, a double check is made to see if it is still on to eliminate the possibility of detecting a noise pulse. When the results of both tests are "Yes", the emitter and character pulses are counted and a return made back via 3.0B, FIG. 71, to 3.0B, FIG. 70. If a print emitter has not been detected, a test is made at Block RG110, Save Emitters, to see if the margin emitter is on. If the margin emitter is on, the routine goes to the right to circle B in FIG. 71. If the margin emitter is not on, a check is made to see if the timer has reached 0. If it has reached 0, an error has been detected. If it has not timed out yet, then a return is made to circle A back at the top of FIG. 71 to stay in this loop until a print emitter or margin emitter is detected. If the Turnaround Okay flag has been on, that is, a 1, the routine proceeds to the right and a check is made to see if the turnaround emitter changed. If it was a 0 and became a 1 or was a 1 and became 0, this check will indicate that change. If the result is No, the routine proceeds again to check whether the print emitter is on just as though the Turnaround Okay flag has been off. If a change of the Turnaround emitter has occurred, then the routine proceeds down the Yes leg and a signal issued to stop the print motor, turn on the left motor control and Branch and Link to the right margin routine to calculate a new right margin emitter count. This right margin count is moved to the emitter counter and an exit is made to 0.0 A which is the beginning of a program control loop, not shown.

Operation Codes

A number of operation codes are utilized by the microprocessors 200, 210. These are listed below.

| ALU OP CODES |
|---|
| — MODE VALUE — |
| REG TO REG 0_ |
| DAR TO DAR 1_ |
| REG TO DAR 2_ |
| DAR TO REG 3_ |
| MSK TO REG 4_ |
| MSK TO DAR 5_ |

| Function OP Codes | | |
|---|---|---|
| Add | A | _0_ |
| Add Carry | AC | _1_ |
| Move | M | _2_ |
| Clear (0) | CLR | _2_ |
| Subtract/Borrow | SB | _3_ |
| Subtract | S | _4_ |
| Compare | C | _5_ |
| Subtract Summary | SS | _6_ |
| Compare Summary | CS | _7_ |
| And | N | _8_ |
| Set Bit Off | SBF | _8_ |
| Test | T | _9_ |
| And Summary | NS | _A_ |
| Test Summary | TS | _B_ |
| Or | O | _C_ |
| Set Bit On | SBN | _C_ |
| Shift Right | SR | _D_ |
| Exclusive or | X | _E_ |
| Shift right Circular | SRC | _F_ |

| Conditional Branches | | |
|---|---|---|
| Branch Not Carry, Branch High | BNC,BH | C_ODD |
| Branch Carry, Branch Less Than Or Equal | BC,BLE | D_EVEN |
| Branch Not Zero, Branch Not Equal, Branch True | BNZ,BNE,Bt | E_ODD |
| Branch Zero, Branch Equal, Branch False | BZ,BE,BF | F_EVEN |

| Unconditional Branches | | |
|---|---|---|
| Branch and Wait | BAW | C_EVEN |
| Branch | B | D_ODD |
| Branch and Link | BAL | E_EVEN |
| Branch Via Link | RTN | F001 |
| Return and Link | RAL | F201 |
| Branch Via DAR | BVD | F301 |

| Select Data Address Registers (DAR"s) and Storage (STG) | | |
|---|---|---|
| Select memory Data Low | SDL | FC01 |
| Select memory Data High | SDH | FE01 |
| Select memory Inst Low | SIL | F481 |
| Select memory Inst High | SIH | F489 |
| Select Data Bit X Off | SXF | F441 |
| Select Data Bit X On | SXN | F445 |
| Select main DARS | SMD | F501 |
| Select Aux Dars | SAD | F701 |

| Input/Output, Load/Store Ops | | |
|---|---|---|
| Input From Device | IN | 68_ |
| Sense Device | SNS | 69_ |
| Output To Device | OUT | 78_ |
| Direct Input and Output | DIO | 7A_ |
| Load Registers | LDR | 89XY |
| Load Registers and DAR+1 | LDRP | 8BXY |
| Load DAR | LDD | 84XY |
| Load DAR and DAR+1 | LDDP | 86XY |
| Load Memory Indexed | LDI | 8AO_ |
| Memory to I/O Device | MIO | 8C_ |
| Memory to I/O Device and DAR+1 | MIOP | 8E_ |
| Load Link Register | LDL | 8000 E |
| Load Link Register and DAR+1 | LDLP | 8200 E |
| Load Absolute Address | LDA | 9_ |
| Store Registers | ST | A9XY |
| Store Registers and DAR+1 | STRP | ABXY |
| Store DAR | STD | A4XY |
| Store DAR and DAR+1 | STDP | A6XY |
| I/O Data To Memory | IOM | AC_ |
| I/O Data To Memory and DAR+1 | IOMP | AE_ |
| Store Memory Indexed | STI | AAO_ |
| Store Link High Order (Even Byte) | SLH | A000 |
| Store Link High Order and DAR+1 | SLHP | A200 |
| Store Link Low Order (Odd Byte) | SLL | A100 |
| Store Link Low Order and DAR+1 | SLLP | A300 |
| Store In Absolute Address | STA | B_ |

Equates—Control Microprocessor

The following equivalent expressions, that is, "equates", are used in connection with Control microprocessor program listings. These are used by an Assembler to fill in a number for the English-type expressions.

| Name | Definition |
|---|---|
| AUXCNT | Auxilliary Character Counter When Driving Right |
| CARPS | Rightmost Character Position for |

-continued

| Name | Definition |
|---|---|
| | Present Density |
| CD15 | Character Density Equals 15 CPI |
| CHACT | Character Count |
| CHDEN | Density 15 CPI |
| CMDTA | Command Data Register |
| CMREG | Command Register |
| CMVAL | Command Validity Bit |
| CPI15 | (IN R1) 15 CPI Head Drive Speed |
| CPOS | Rightmost Character Position |
| CPS10 | Rightmost Character Position in Left Margin, 10 CPI |
| CPS15 | Rightmost Character Position in Left Margin, 15 CPI |
| DNSCH | Density Change Flag |
| DTNT | Forms Detent Speed |
| ECCH | (In R1) Echo Check in Data Register |
| EMTT | Print Emitters and Motor Controls |
| FCT1 | Next Forms Command |
| FEA | Forms Emitter A |
| FEB | Forms Emitter B |
| FMCMD | Forms Command Flag |
| FRMCM | Forms Command |
| FRMST | Forms Start Flag |
| FWD | Forms Direction |
| HIGST | Head Image Generator Is To Start |
| HLATCH | Saves Last Command To Head Motor |
| LEFT | (In R1) Left Head Direction |
| LOBYT | Forms Command, Low Byte |
| MARGN | (IN RO) Margin Emitter |
| ME10A | Maximum Emitter Count 10 CPI, High |
| ME10B | Maximum Emitter Count 10 CPI, Low Byte |
| ME15A | Maximum Emitter Count 15 CPI, High Nibble |
| ME15B | Maximum Emitter Count 15 CPI, Low Byte |
| NCH10 | Nominal Character Count, 10 CPI |
| NCH15 | Nominal Character Count, 15 CPI |
| NE10A | Nominal Emitter Count, 10 CPI, High Nibble |
| NE10B | Nominal Emitter Count, 10 CPI, Low Byte |
| NE15A | Nominal Emitter Count, 15 CPI, High Nibble |
| NE15B | Nominal Emitter Count, 15 CPI, Low Byte |
| NMEM1 | High Nibble, Nominal Emitter Count |
| NMEM2 | Low Byte, Nominal Emitter Count |
| NOMCH | Nominal Character Count |
| PARK | Ramp Command Flag |
| PARTY | (In RO) Communications microprocessor Parity |
| PRBSY | (In RO) +Print Head Busy |
| PRCMD | Print Command Flag |
| PREM | (In RO) Print Emitter |
| PRPND | Print Command Is Pending |
| PRRUM | (In R1) Print Head Run) |
| PRTCM | (In R1) Print Command |
| RCVAL | Reset Command Validity |
| RUN | Forms Run |
| RV | Print Head Is Going Left (Reverse) |

-continued

| Name | Definition |
|---|---|
| SAVE1 | Temporary Storage Register |
| TEST | Test Command |
| TOK | Turn Around Is OK |
| TRNAR | (In RO) Turn Around Emitter |
| TSCMD | Test Command Flag |
| TSMDE | Test Mode Command |
| TXBUF | Head Image Generator Is To Use Text Buffer 2 |
| TXTBF | Text Buffer 2 |
| USTIM | Microsecond Timer (3 USEC/Step) |

Labels—Control Microprocessor

The following labels are used by the Control microprocessor 210. These serve, for example, as pointers for addressing or for branching purposes.

| Labels | | |
|---|---|---|
| ANALS | AN190 | RG160 |
| AN010 | AN200 | RG165 |
| AN020 | AN210 | RG170 |
| AN030 | ERREM | RG20 |
| AN040 | FORMS | RG30 |
| AN050 | PCTRS | RG40 |
| AN060 | PR400 | RG50 |
| AN070 | RG100 | RG60 |
| AN080 | RG105 | RG70 |
| AN090 | RG107 | RG80 |
| AN100 | RG110 | RG90 |
| AN110 | RG115 | RTMRG |
| AN120 | RG117 | RTMR1 |
| AN130 | RG118 | RTMR2 |
| AN140 | RG120 | RTMR3 |
| AN150 | RG130 | RTMR4 |
| AN160 | RG140 | RTMR5 |
| AN170 | RG15 | RTN |
| AN180 | RG150 | SSTRT |
| | | TIME1 |
| | | TURN |
| | | XAO |
| | | XEF |
| | | XF0 |
| | | X9F |

Program Listings

Program listings that relate to the flowcharts and routines described herein are presented below.

The Routine Reads The Command And Data Latches, Analyzes The Contents And Sets The Proper Flags To Perform The Operation.

| Label | Op Code | Arguments | Comment |
|---|---|---|---|
| X9F | EQU | | 10 CPI CHAR COUNT - 1 (159) |
| XEF | EQU | +1 | 15 CPI CHAR COUNT - 1 (239) |
| | DC | X'9FEF' | |
| ANALS | EQU | | ANALYSIS |
| | IN | CMREG | INPUT THE COMMAND REGISTER |
| | T | PARTY,I00 | IS THE PARITY BIT ON |
| | BT | AN010 | YES, GO SET UP TO RAMP |
| | T | CMVAL,I00 | IS IT A VALID COMMAND |
| | BF | RTN | NO, RETURN TO CALLER |
| | M | R0,R2 | MOVE COMMAND TO R2 AND R3 |
| | N | 1,R2 | AND CLEAR PARITY AND VALIDITY BITS |
| | M | R1,R3 | |
| | T | ATVAL,I00 | IS STATUS REG EMPTY |
| | BT | AN005 | NO, BYPASS ECHO CHECK |
| | IN | CMDTA | INPUT THE DATA REGISTER |
| | X | R2,R0 | EXCLUSIVE OR THE CONTENTS |

-continued

The Routine Reads The Command And Data Latches, Analyzes The Contents And Sets The Proper Flags To Perform The Operation.

| Label | Op Code | Arguments | Comment |
|---|---|---|---|
| | | | OF |
| | X | R3,R1 | THE COMMAND AND DATA REGS |
| | OUT | STDTA | OUTPUT IT TO THE CMA |
| | M | ECCH,R1 | TURN ON THE ECHO CHECK BIT |
| | M | X'0',R0 | |
| | OUT | STREG | OUTPUT IT TO THE CMA |
| AN005 | IN | CMDTA | GET COMMAND DATA BACK |
| | T | FRMCH,R3 | IS IT A FORMS COMMAND |
| | BT | AN020 | YES, GO SET UP FOR IT |
| | T | PRTCM,R3 | IS IT A PRINT COMMAND |
| | BT | AN040 | YES, GO SET UP FOR IT |
| | T | TEST,R2 | IS IT A TEST COMMAND |
| | BT | AN200 | YES, GO SET UP FOR IT |
| AN010 | T | PRCMD+FMCMD+TSCMD, CMDFL | IS A CMD BEING PERFORMED |
| | BT | RTN | YES, RETURN TO CALLER |
| | SBF | HHOME, PRERR | CLEAR HEAD HOME FLAG |
| | SBN | PARK,PHF | SET THE RAMP COMMAND FLAG |
| | B | AN210 | GO DO THE ECHO |
| AN020 | T | FMCMD,CMDFL | IS THERE A FORMS COMMAND BEING PERFORMED |
| | BT | RTN | YES, RETURN TO CALLER |
| | T | LOBYT,R3 | IS THIS THE LOW ORDER BYTE |
| | BT | AN030 | YES, GO HANDLE IT |
| | OUT | FCT1 | STORE THE HIGH ORDER BYTE |
| | B | AN210 | GO DO THE ECHO |
| AN030 | OUT | FCT2 | STORE THE LOW ORDER BYTE |
| | SBN | FMCMD,CMDFL | SET YTHE FORMS COMMAND FLAG |
| | SBN | FRMST,PHF | TURN ON FORMS START FLAG |
| | B | AN210 | GO DO THE ECHO |
| AN040 | T | PRCMD,CMDFL | IS PRINT COMMAND FLAG ON |
| | BT | AN180 | YES, GO AROUND |
| | T | CHDEN,R3 | IS DENSITY COMMAND 15 CPI |
| | BT | AN090 | YES, CHECK IF IT WAS |
| | T | CD15,FLG1 | WAS DENSITY 15 CPI |
| | BT | AN110 | YES, GO RAMP THE HEADS |
| AN050 | T | TXTBF,R3 | IS TEXT BUFFER 2 ON |
| | BT | AN100 | YES, GO TURN IT QN |
| | SBF | TXBUF,FLG1 | TURN OFF THE TEXT BUFFER 2 FLAG |
| AN060 | SBN | HIGST,FLG1 | TURN ON HEAD IMAGE GENERATOR START |
| | SBN | PRCMD,CMDFL | TURN ON THE PRINT COMMAND FLAG |
| | SBF | PRPND,CMDFL | TURN OFF THE PRINT PENDING FLAG |
| | SBF | DNSCH,PHF | TURN OFF THE DENSITY CHANGE FLAG |
| AN070 | T | CHDEN,R3 | IS DENSITY COMMAND 15 CPI |
| | BT | AN080 | YES, CONTINUE |
| | T | X'1',R1 | IS CHARACTER COUNT EVEN |
| | BF | AN080 | YES, CONTINUE |
| | A | X'1',R1 | MAKE THE CHARACTER COUNT EVEN |
| | AC | X'0',R0 | |
| AN080 | OUT | CHACT | STORE THE CHARACTER COUNT |
| | BAL | RTMRG | RIGHT MARGIN ROUTINE |
| | T | PRPND,CMDFL | IS PRINT PENDING |
| | BT | RTN | YES, RETURN TO CALLER |
| | B | AN210 | GO DO THE ECHO |
| AN090 | T | CD15,FLG1 | WAS DENSITY 15 CPI |
| | BF | AN190 | NO, GO RAMP THE HEADS |
| | B | AN050 | GO CHECK THE TEXT BUFFER FLAG |
| AN100 | SBN | TXBUF,FLG1 | TURN ON TEXT BUFFER 2 FLAG |
| | B | AN060 | |
| AN110 | IN | HLATCH | INPUT THE ACTUATOR MOTOR CONTROLS |
| | SBF | CPI15,R1 | TURN OFF CPI15 ON THE MOTOR CONTROLS |
| | SBF | CD15,FLG1 | TURN OFF THE 15 CPI FLAG |
| AN120 | OUT | EMTT | OUTPUT THE MOTOR CONTROLS |
| | OUT | HLATCH | STORE IN STACK |

-continued

The Routine Reads The Command And Data Latches, Analyzes The Contents And Sets The Proper Flags To Perform The Operation.

| Label | Op Code | Arguments | Comment |
|---|---|---|---|
| | T | CD15,FLG1 | WAS DENSITY 15 CPI |
| | BT | AN140 | YES, GO SET UP FOR IT |
| | IN | NE10A | INPUT NOM EMITT, HIGH BYTE FOR 10 CPI |
| | OUT | NMEM1 | SAVE IT IN NOMINAL EMITTERS 1 |
| | IN | NE10B | INPUT NOM EMITT, LOW BYTE FOR 10 CPI |
| | OUT | NMEM2 | SAVE IT IN NOMINAL EMITTERS 2 |
| | IN | NCH10 | INPUT NOM CHAR COUNT FOR 10 CPI |
| | OUT | NOMCH | SAVE IT IN NOMINAL CHARACTER COUNT |
| | T | RV,FLG1 | IS PRINT HEAD MOVING LEFT |
| | BT | AN130 | YES, GO SET UP CHAR POSITION |
| | IN | ME10A | INPUT HIGH BYTE OF MAX EMITTERS |
| | M | IO1,EMCT1 | MOVE IT TO THE EMITTER COUNTER |
| | IN | ME10B | INPUT LOW BYTE OF MAX EMITTERS |
| | M | IO0,EMCT2 | MOVE IT TO THE EMITTER COUNTER |
| | M | IO1,EMCT3 | MOVE IT TO THE EMITTER COUNTER |
| | LDA | X9F | LOAD MAX CHAR POSITION FOR 10 CPI |
| | OUT | CPOS | SAVE IT IN CHARACTER POSITION |
| | IN | CPS10 | INPUT NOM CHAR POS FOR 10 CPI |
| | OUT | CARPS | |
| | B | AN160 | GO SET DENSITY CHANGE FLAG |
| AN130 | IN | CPS10 | INPUT NOM CHAR POS FOR 10 CPI |
| | OUT | CPOS | SAVE IT IN CHARACTER POSITION |
| | OUT | CARPS | |
| | B | AN160 | GO SET DENSITY CHANGE FLAG |
| AN140 | IN | NE15A | INPUT NOM EMITT, HIGH BYTE FOR 15 CPI |
| | OUT | SAVE IT IN NOMINAL | |
| | NMEM1 | | |
| | | | EMITTERS 1 |
| | IN | NE15B | INPUT NOM EMITT, LOW BYTE FOR 15 CPI |
| | OUT | NMEM2 | SAVE IT IN NOMINAL EMITTERS 2 |
| | IN | NCH15 | INPUT NOM CHAR COUNT FOR 15 CPI |
| | OUT | NOMCH | SAVE IT IN NOMINAL CHARACTER COUNT |
| | T | RV,FLG1 | IS PRINT HEAD MOVING LEFT |
| | BT | AN150 | YES, GO SET UP CHAR POSITION |
| | IN | ME15A | INPUT HIGH BYTE OF MAX EMITTERS |
| | M | IO1,EMCT1 | MOVE IT TO THE EMITTER COUNTER |
| | IN | ME15B | INPUT LOW BYTE OF MAX EMITTERS |
| | M | IO0,EMCT2 | MOVE IT TO THE EMITTER COUNTER |
| | M | IO1,EMCT3 | MOVE IT TO THE EMITTER COUNTER |
| | LDA | XEF | LOAD MAX CHAR POSITION FOR 15 CPI |
| | OUT | CPOS | SAVE IT IN CHARACTER POSITION |
| | IN | CPS15 | INPUT NOM CHAR POS FOR 15 CPI |
| | OUT | CARPS | |
| | B | AN160 | GO SET DENSITY CHANGE FLAG |
| AN150 | IN | CPS15 | INPUT NOM CHAR POS FOR 15 CPI |

-continued

| Label | Op Code | Arguments | Comment |
|---|---|---|---|
| | | The Routine Reads The Command And Data Latches, Analyzes The Contents And Sets The Proper Flags To Perform The Operation. | |
| | OUT | CPOS | SAVE IT IN CHARACTER POSITION |
| | OUT | CARPS | SAVE IT |
| AN160 | SBN | DNSCH,PHF | SET THE DENSITY CHANGE FLAG |
| | RTN | , | RETURN TO CALLER |
| AN170 | T | CD15,FLG1 | WAS DENSITY 15 CPI |
| | BF | AN160 | NO, SET THE DENSITY CHANGE FLAG |
| | B | AN070 | YES, GO COMPUTE RIGHT MARGIN |
| AN180 | SBN | PRPND,CMDFL | TURN ON PRINT COMMAND PENDING FLAG |
| | T | RV,FLG1 | IS PRINT HEAD MOVING LEFT |
| | BT | RTN | YES, RETURN TO CALLER |
| | T | CHDEN,R3 | IS DENSITY COMMAND 15 CPI |
| | BT | AN170 | YES, CHECK IF IT WAS |
| | T | CD15,FLG1 | WAS DENSITY 15 CPI |
| | BF | AN070 | NO, GO COMPUTE RIGHT MARGIN |
| | B | AN160 | YES, GO AROUND |
| AN190 | IN | HLATCH | INPUT THE ACTUATOR MOTOR CONTROLS |
| | SBN | CPI15,R1 | TURN ON CPI 15 ON THE MOTOR CONTROLS |
| | SBN | CD15,FLG1 | TURN ON THE 15 CPI FLAG |
| | B | AN120 | GO OUTPUT ACTUATOR CONTROLS |
| AN200 | OUT | TSMDE | SAVE IT |
| | SBN | TSCMD,CMDFL | TURN ON TEST COMMAND FLAG |
| AN120 | OUT | RCVAL | RESET COMMAND VALIDITY BIT |
| RTN | RTN | , | RETURN TO CALLER |
| | HIGC1 | | INSERT HIG MACRO |

Right Margin Routine

This routine is entered whenever it is necessary to determine where right margin is.

| Label | Op Code | Arguments | Comment |
|---|---|---|---|
| RTMRG | EQU | | RIGHT MARGIN ROUTINE |
| | IN | NOMCH | INPUT NOMINAL CHARACTER COUNT |
| | M | R0,R2 | MOVE R0 TO R2 |
| | M | R1,R3 | MOVE R1 TO R3 |
| | IN | NMEM1 | INPUT HIGH NIBBLE OF THE NOMINAL EMITTER |
| | M | R1,D0 | COUNT AND SAVE IT IN D0 |
| | IN | NMEM2 | INPUT LOW BYTE OF THE NOMINAL EMITTER |
| | M | R0,D1 | COUNT AND SAVE IT IN D1 AND D2 |
| | M | R1,D2 | |
| | IN | CHACT | INPUT COMMANDED CHARACTER COUNT |
| | C | R0,R2 | IS COMMANDED LESS OR EQUAL TO NOMINAL |
| | BH | RTMR3 | NO, GO FIND NEW RIGHT MARGIN |
| | BE | RTMR5 | GO CHECK LOW NIBBLE IF ITS EQUAL |
| RTMR1 | C | D0,RM1 | IS HIGH NIBBLE OF NEW RIGHT MARGIN |
| | BH | RTMR2 | GREATER THAN PRESENT RIGHT MARGIN |
| | BNE | RTN | IS IT LESS |
| | C | D1,RM2 | IS THE MIDDLE NIBBLE GREATER |
| | BH | RTMR2 | YES, GO SET THE NEW RIGHT MARGIN |
| | BNE | RTN | IF LESS, LEAVE OLD RIGHT MARGIN |

-continued

| Label | Op Code | Arguments | Comment |
|---|---|---|---|
| | C | D2,RM3 | IS THE LOW NIBBLE GREATER |
| | BLE | RTN | YES, LEAVE THE OLD RIGHT MARGIN |
| RTMR2 | M | D0,RM1 | MOVE THE NEW RIGHT MARGIN EMITTER COUNT |
| | M | D1,RM2 | INTO THE RIGHT MARGIN REGISTERS |
| | M | D2,RM3 | |
| | RTN | , | RETURN TO CALLER |
| RTMR3 | S | R3,R1 | SUBTRACT THE NOMINAL FROM THE COMMANDED |
| | SB | R2,R0 | CHARACTER COUNT |
| | M | R1,R4 | SETUP THREE REGISTERS TO MULTIPLY |
| | M | R0,R3 | THE RESULTS |
| | M | X'0',R2 | |
| | OUT | SAVE1 | SAVE THE RESULTS OF THE SUBTRACT |
| | M | X'3',R0 | SET THE LOOP COUNTER |
| RTMR4 | A | R4,R4 | MULTIPLY THE RESULTS OF THE SUBTRACT |
| | AC | R3,R3 | BY 8 |
| | AC | R2,R2 | |
| | S | X'1',R0 | DECREMENT THE LOOP COUNTER |
| | BNZ | RTMR4 | |
| | IN | SAVE1 | RESTORE THE RESULTS OF THE SUBTRACT AND |
| | A | R1,R4 | ADD IT TO THE RESULTS OF THE MULTIPLY |
| | AC | R0,R3 | BY 8 |
| | AC | X'0',R2 | THIS IS THE SAME AS MULTIPLYING BY 9 |
| | A | R4,D2 | ADD THE RESULTS TO THE NOMINAL |
| | AC | R3,D1 | EMITTER COUNT |
| | AC | R2,D0 | |
| | B | RTMR1 | GO CHECK THIS AGAINST |

-continued

| Label | Op Code | Arguments | Comment |
|---|---|---|---|
| | | | PRESENT RIGHT MARG |
| RTMR5 | C | R1,R3 | IS LOW NIBBLE GREATER |
| | BH | RTMR3 | YES, GO FIND NEW RIGHT MARGIN |
| | B | RTMR1 | GO CHECK THE NEW AGAINST THE PRESENT |
| | FORC1 | | INSERT FORMS CONTROL ROUTINE |

Head Moving Right In Print Area; Printing Complete

This routine is entered when printing is complete and the print heads 34 were moving to the right.

Get and Save the Print Emitters

| Label | Op Code | Arguments | Comment |
|---|---|---|---|
| RG10 | IN | EMTT | GET THE EMITTERS |
| | SBF | PRBSY,IO0 | MASK OFF BUSY BIT |
| | M | IO0,PEMT | MOVE EMITTERS TO SAVE REGISTER |
| | SBF | TOK,FLG2 | RESET TURN AROUND FLAG |
| | S | 1,WIPOS | SUBTRACT ONE FROM WIRE POSITION |
| | SBF | HATNA,PRERR | CLEAR HEAD AT TURNAROUND FLAG |

Increment the Emitter Counters

| Label | Op Code | Arguments | Comment |
|---|---|---|---|
| | A | 1,EMCT3 | ADD ONE |
| | AC | 0,EMCT2 | TO THE |
| | AC | 0,EMCT1 | EMITTER COUNTERS |

Adjust the Position

| Label | Op Code | Arguments | Comment |
|---|---|---|---|
| | IN | CPOS | GET RIGHTMOST CHARACTER POSITION |
| | S | X'1',IO1 | SUBTRACT 1 FROM IT |
| | SB | 0,IO0 | |
| | OUT | AUXCNT | STORE IN AUX COUNTER |
| RG15 | T | DNSCH,PHF | DID DENSITY CHANGE? |
| | BT | PR400 | BRANCH IF YES (DRIVE HEADS TO MARGIN) |

Set the Timer For 625 Micro Seconds

| Label | Op Code | Arguments | Comment |
|---|---|---|---|
| | LDA | TIME1 | GET HEX 625 MICRO SECONDS |
| | OUT | USTIM | LOAD THE TIMER |
| | T | FRMST,PHF | IS FORMS START ON |
| | BF | RG20 | BRANCH IF NOT |
| | BAL | SSTRT | ELSE GO START THE FORMS |
| RG20 | BAL | FORMS | FORMS CONTROL ROUTINE |
| | T | TOK,FLG2 | IS TURN AROUND FLAG ON? |
| | BT | RG30 | BRANCH IF YES |
| | T | PRPND,CMDFL | IS THERE A PRINT COMMAND PENDING? |
| | BT | RG28 | BRANCH IF THERE IS |
| | T | PRCMD,CMDFL | DO WE HAVE A PRINT |

-continued

Set the Timer For 625 Micro Seconds

| Label | Op Code | Arguments | Comment |
|---|---|---|---|
| | | | COMMAND? |
| | BF | RG70 | BRANCH IF NOT |

Is Head Far Enough Right To Turn Around?

| Label | Op Code | Arguments | Comment |
|---|---|---|---|
| RG25 | M | EMCT3,R3 | MOVE EMITTER COUNT TO WORK REG |
| | M | EMCT2,R2 | |
| | M | EMCT1,R1 | |
| | S | RM3,R3 | SUBTRACT RIGHT MARGIN VALUE |
| | SB | RM2,R2 | |
| | SB | RM1,R1 | |
| | BNC | RG30 | BRANCH IF EM CT >= RIGHT MARG |
| RG28 | SBN | TOK,FLG2 | TURN ON TURNAROUND FLAG |
| RG30 | IN | USTIM | GET THE TIMER |
| | T | X'C',IO0 | ENOUGH TIME TO RUN FORMS? |
| | BF | RG80 | BRANCH IF NOT |
| | BAL | FORMS | FORMS CONTROL ROUTINE |
| | B | RG30 | LOOP AS LONG AS TIME REMAINS |

Go See If There Is Another Command And Density Change

| Label | Op Code | Arguments | Comment |
|---|---|---|---|
| RG70 | BAL | ANALS | ANALYSIS ROUTINE |
| | T | DNSCH,PHF | WAS THERE A DENSITY CHANGE? |
| | BF | RG30 | BRANCH IF NOT |
| | B | PR400 | ELSE DRIVE HEADS TO MARGIN |

Update Timer For 10 Or 15 CPI

| Label | Op Code | Arguments | Comment |
|---|---|---|---|
| RG80 | T | CD15,FLG1 | ARE WE AT 15 CPI? |
| | BF | RG100 | BRANCH IF NOT |
| | IN | USTIM | GET THE TIMER |
| | A | 6,IO1 | ADD 450 MICRO SECONDS |
| | AC | 9,IO0 | |
| | OUT | USTIM | STORE THE RESULTS IN THE TIMER |

Check If There Is Enough Time To Run Forms

| Label | Op Code | Arguments | Comment |
|---|---|---|---|
| RG90 | IN | USTIM | GET THE TIMER |
| | T | X'C',IO0 | IS THERE ENOUGH TIME? |
| | BF | RG100 | BRANCH IF NOT ENOUGH TIME |
| | BAL | FORMS | FORMS CONTROL ROUTINE |
| | B | RG90 | LOOP IF ENOUGH TIME |
| RG100 | IN | USTIM | GET THE TIMER |
| | A | 8,IO1 | ADD 600 MICRO SECONDS |
| | AC | X'C',IO0 | |
| | BC | RG100 | LOOP IF OVERFLOW |
| | OUT | USTIM | STORE THE RESULTS IN THE TIMER |
| RG105 | BAL | FORMS | FORMS CONTROL ROUTINE |
| | IN | EMTT | READ PRINT EMITTERS |
| | T | TOK,FLG2 | IS TURNAROUND FLAG ON? |

-continued

Check If There Is Enough Time To Run Forms

| Label | Op Code | Arguments | Comment |
|---|---|---|---|
| | BT | RG120 | BRANCH IF ON |
| RG107 | T | PREM,IO0 | IS PRINT EMITTER ON |
| | BF | RG110 | BRANCH IF NOT ON |
| | IN | EMTT | READ PRINT EMITTERS |
| | T | PREM,IO0 | IS PRINT EMITTER ON? |
| | BT | RG140 | BRANCH IF ON |
| RG110 | M | IO0,PEMT | SAVE THE EMITTER READINGS |
| | T | MARGN,IO0 | IS MARGIN ON? |
| | BT | RG115 | BRANCH IF ON |
| | IN | USTIM | GET THE TIMER |
| | BNZ | RG105 | BRANCH IF NOT ZERO |
| | B | ERREM | ERROR |

Head At Right Margin, Set Character Count To Max

| Label | Op Code | Arguments | Comment |
|---|---|---|---|
| RG115 | T | CD15,FLG1 | ARE WE AT 15 CPI |
| | BT | RG117 | YES, SET UP COUNT FOR 15 |
| | LDA | XA0 | SET UP COUNT FOR 10 |
| | B | RG118 | |
| RG117 | LDA | XF0 | LOAD COUNT FOR 15 |
| RG118 | OUT | AUXCNT | STORE CHARACTER COUNT |
| | B | RG130 | GO STOP THE HEAD MOTOR |
| XF0 | EQU | | 15 CPI MAX CHARACTER COUNT |
| XA0 | EQU | 1 | 10 CPI MAX CHAR COUNT |
| | DC | A(X'F0A0') | |
| RG120 | M | IO0,REG2 | MOVE EMITTERS TO REG 2 |
| | X | PEMT,REG2 | DID TURNAROUND EMITTER CHANGE |

-continued

Head At Right Margin, Set Character Count To Max

| Label | Op Code | Arguments | Comment |
|---|---|---|---|
| | T | TRNAR,REG2 | |
| | BF | RG107 | BRANCH IF NO CHANGE |

Set Head Stopped At Turnaround Flag

| Label | Op Code | Arguments | Comment |
|---|---|---|---|
| | SBN | HATNA,PRERR | TURN ON FLAG |
| | SBF | TEDGE,PRERR | CLEAR EDGE FLAG |
| | N | TRNAR,IO0 | CLEAR ALL BUT TURNAROUND EMITTER |
| | O | IO0,PRERR | OR INTO FLAG |

Motor Controls (Stopping)

| Label | Op Code | Arguments | Comment |
|---|---|---|---|
| RG130 | IN | HLATCH | GET MOTOR CONTROLS |
| | SBF | PRRUN,IO1 | TURN OFF RUN |
| | SBN | LEFT,IO1 | TURN ON LEFT |
| | OUT | EMTT | OUTPUT MOTOR CONTROLS |
| | OUT | HLATCH | STORE IN STACK |
| | IN | CPOS | GET RIGHT MOST CHAR POSITION |
| | S | 1,IO1 | SUBTRACT ONE |
| | SB | 0,IO0 | |
| | OUT | CPOS | STORE IT |
| | IN | AUXCNT | GET AUX CHAR COUNTER |
| | OUT | CHACT | STORE IN CHARACTER COUNTER |
| | BAL | RTMRG | RIGHT MARGIN ROUTINE |

Move Margin Count To Emitter Count

| Label | Op Code | Arguments | Comment |
|---|---|---|---|
| | M | RM3,EMCT3 | MOVE RIGHT |
| | M | RM2,EMCT2 | MARGIN COUNT TO |
| | M | RM1,EMCT1 | EMITTER COUNT |
| | M | O,PT1 | CLEAR FORMS COMMAND COUNTER |
| | T | HATNA,PRERR | DID HEAD STOP AT TURN-AROUND EMIT |
| | BF | PCTRS | BRANCH IF NO |
| | LDA | HEXOD | SET TIMER TO 20 |
| | OUT | MILLISECONDS | |
| | MSTIM | | |
| | B | PC020 | RETURN TO MAJOR LOOP |
| RG135 | BAL | FORMS | GO TO FORMS ROUNTINE |
| | IN | MSTIM | GET THE TIMER |
| | BNZ | RG135 | LOOP IF NOT ZERO |
| | B | PCTRS | RETURN TO MAJOR LOOP |
| RG140 | T | CD15,FLG1 | ARE WE AT 15 CPI? |
| | BT | RG150 | BRANCH IF YES |
| | M | 2,REG2 | PUT A TWO IN REG TWO |
| | B | RG160 | JUMP OVER NEXT INSTRUCTION |
| RG150 | M | 3,REG2 | PUT A THREE IN REG 2 |
| RG160 | IN | CPOS | GET RIGHTMOST CHAR POSITION |
| | S | REG2,WIPOS | SUBTRACT REG 2 FROM WIPOS |
| | BNC | RG170 | BRANCH IF NO CARRY |
| | BZ | RG170 | BRANCH IF ZERO |
| RG165 | A | REG2,EMCT3 | ADD REG TWO TO EMITTER COUNTER |
| | AC | 0,EMCT2 | |
| | AC | 0,EMCT1 | |
| | B | RG15 | |
| RG170 | A | 9,WIPOS | ADD NINE TO WIRE POSITION |
| | A | 1,IO1 | INCREMENT CHAR POSITION |
| | AC | 0,IO0 | PLUS ONE |
| | OUT | CPOS | AND STORE RESULTS |

-continued

| Label | Op Code | Move Margin Count To Emitter Count<br>Arguments | Comment |
|---|---|---|---|
| | IN | AUXCNT | GET THE CHARACTER COUNT |
| | A | 1,IO1 | INCREMENT IT |
| | AC | 0,IO0 | PLUS ONE |
| | OUT | AUXCNT | STORE IN AUX COUNTER |
| | B | RG165 | |
| REG2 | EQU | R2 | |
| TIME 1 | DC | X'D000' | |
| | ANLC1 | | INSERT ANALYSIS MACRO |

While a preferred embodiment of the invention has been illustrated and described, it is to be understood that there is no intention to limit the invention to the precise constructions herein disclosed and the right is reserved to all changes and modifications coming within the scope of the invention as definted in the appended claims.

We claim:

1. A line turnaround arrangement for a printer, comprising:

a printer unit, said printer unit incorporating forms feed assembly means for moving a form for printing at a print line, and said printer unit further having a ribbon drive assembly;

a wire matrix print assembly in said printer unit, said print assembly incorporating print wires and print wire actuators arranged in print heads spaced at regular predetermined intervals, said print assembly being mounted for reciprocated printing movement along said print line;

wire image means for providing signals on a selective basis to said printer unit to activate said print wire actuators to produce characters by means of dots on said forms during printing operations, said signals being supplied to said print assembly as said print assembly moves along said print line;

control means for producing turnaround input signals indicative of the number of print heads in said print assembly, the character density, the print head spacing, and the starting point of the last print head in said print assembly;

said control means utilizing said turnaround input signals to produce stopping and turnaround control signals indicative of printing operations of said print assembly requiring (1) a nominal line of printing defined as the number of print positions a print head can print times the number of print heads in said print assembly, (2) less than a nominal line of printing, and (3) an extended line of printing involving printing of characters beyond a nominal line of printing up to a predetermined maximum line length, said stopping and turnaround control signals being indicative of selected stopping and turnaround points for said print assembly in individual lines to be printed;

means responsive to Print Commands to move said print assembly along said print line in order to print characters in individual lines of printing;

emitter means operable during movement of said print assembly along said print line to provide emitter signals indicative of the positional location of said print assembly and for defining successive stopping and turnaround points in a line of printing in said printer unit during printing operations; and said control means further being responsive to said stopping and turnaround control signals and emitter signals from said emitter means to control stopping, turnaround and movement of said print assembly for printing of (1) a nominal line of printing, (2) less than a nominal line of printing, and (3) an extended line of printing.

2. The arrangement of claim 1, wherein:

said control means further produces, utilizes, and responds to signals to control stopping and turnaround of said print assembly relative to both left and right margin areas of printing.

3. The arrangement of claim 1 wherein movement of said print assembly is right to left and conversely in relation to a form to be printed, wherein said print heads are arranged in an array that is relatively positioned in parallel from left to right relative to the print lines, and wherein the last print head is the rightmost print head.

4. The arrangement of claim 1, further comprising:

a printer subsystem incorporating said printer unit;

a host data processing system, said host data processing system providing both control and data signals to said printer subsystem for use during printing operations; and wherein said control means incorporates a microprocessor, said microprocessor performing necessary line turnaround calculations.

5. The arrangement of claim 1, wherein said print assembly has said print wires arranged in groups of two, four, six, and eight print heads, each print head comprising eight print wires.

6. The arrangement of claim 5, wherein said emitter means is structured to provide dot matrix location emitters, turnaround emitters, margin emitters, and other emitters, the physical dimensions of said emitter means being of different lengths dependent upon the physical head spacing of the print heads, longer emitter means being used for fewer print heads and conversely.

7. The arrangement of claim 1, further comprising:

an emitter registration means incorporated in said emitter means, said registration means including turnaround emitter areas spaced at distances that are correlated with the spacing of the characters in individual print lines.

8. The arrangement of claim 7, wherein said print wires are spaced two character locations apart and wherein said turnaround emitter areas on said emitter registration means are also spaced two character locations apart at 10 characters per inch, and three character locations apart at 15 characters per inch.

9. The arrangement of claim 1, wherein said control means processes factors and makes turnaround decisions with respect to a right margin area only.

10. The arrangement of claim 9, wherein said right margin area is defined by said control means for each individual print line as received and independently of the other print lines preceding or succeeding said each individual print line.

11. The arrangement of claim 1, further comprising:

storage means for storing information representative of the signals produced by said control means for access during printing operations.

12. The arrangement of claim 11, wherein:

said control means incorporates a microprocessor, said microprocessor performing calculations utilizing the information in said storage means to determine optimum line turnaround and said microprocessor monitoring movement of said print assembly in order to determine the points of turnaround required during printing of individual print lines.

13. The arrangement of claim 12, wherein:

said microprocessor performs a right margin calculation for each line of characters printed during printing operations; and wherein said storage means is operable to store counts representative of optimum line turnaround factors.

14. The arrangement of claim 1, further comprising:

means for moving said print assembly at a slower rate for character printing of greater density such as 15 characters per inch and at a relatively faster rate for characters of less density, such as 10 characters per inch.

15. The arrangement of claim 14, wherein:

said control means incorporates a microprocessor for analyzing emitter signals produced at relatively different speeds during the printing of characters at greater and less densities.

16. A line turnaround arrangement for a printer, comprising:

a printer unit, said printer unit incorporating forms feed assembly means for moving a form for printing at a print line, and said printer unit further having a ribbon drive assembly;

a wire matrix print assembly in said printer unit, said print assembly incorporating print wires and print wire actuators arranged in print heads spaced at regular predetermined intervals, said print assembly being mounted for reciprocal printing movement along said print line;

wire image means for providing signals on a selective basis to said printer unit to activate said print wire actuators to produce characters by means of dots on said forms during printing operations, said signals being supplied to said print assembly as said print assembly moves along said print line;

control means for producing turnaround input signals indicative of the number of print heads in said print assembly, the character density (characters per inch), the print head spacing, and the starting point of the last print head in said print assembly;

said control means utilizing said turnaround input signals for producing stopping and turnaround signals indicative of selected stopping and turnaround points for said print assembly in individual lines to be printed, said individual lines to be printed being categorized into a plurality of defined line lengths and said line turnaround arrangement being operable in accordance with the following definitions:

(1) Definition of less than nominal line and STOP formula for less than nominal line:

$CHCT < (HDSP)\ (CPI)$ $STOP = (CHCT) + (HDSP)\ (CPI)\ (\#HD - 1) + (K)\ (CPI),$ (2) Definition of nominal line length and STOP formula for nominal line length:

$CHCT < (\#HD)\ (HDSP)\ (CPI) - (K)\ (CPI)$ $STOP = (KC)\ (CPI) + (HDSP)\ (CPI)\ (\#HD),$ (3) Extended line printing is anything not covered by 1 or 2 and having an extended line printing STOP formula:

$STOP = (CHCT) + (K)\ (CPI)\ (2),$ wherein CHCT = Character Count, HDSP = Head Spacing, CPI = Characters per inch, #HD = number of print heads, K = A constant representing the distance between print wires at extremities of each print head, and STOP = the print position the last print head must print to complete a given character count;

means responsive to Print Commands to move said print assembly along said print line in order to print characters in individual lines of printing;

emitter means operable during movement of said print assembly along said print line to provide emitter signals indicative of the positional location of said print assembly and for defining successive stopping and turnaround points in a line of printing in said printer unit during printing operations; and said control means further being responsive to said stopping and turnaround signals and emitter signals from said emitter means to control stopping and turnaround of said print assembly.

* * * * *